US012281646B2

(12) United States Patent
Shampine et al.

(10) Patent No.: US 12,281,646 B2
(45) Date of Patent: Apr. 22, 2025

(54) INSTRUMENTED FRACTURING PUMP SYSTEMS AND METHODS

(71) Applicant: Schlumberger Technology Corporation, Sugar Land, TX (US)

(72) Inventors: Rod W. Shampine, Houston, TX (US); Carlos Urdaneta, Houston, TX (US); Mohammad Hajjari, Houston, TX (US); Thomas J. Rebler, Richmond, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/248,457

(22) PCT Filed: Oct. 25, 2021

(86) PCT No.: PCT/US2021/056425
§ 371 (c)(1),
(2) Date: Apr. 10, 2023

(87) PCT Pub. No.: WO2022/093676
PCT Pub. Date: May 5, 2022

(65) Prior Publication Data

US 2023/0392592 A1 Dec. 7, 2023

Related U.S. Application Data

(60) Provisional application No. 63/105,749, filed on Oct. 26, 2020.

(51) Int. Cl.
*F04B 51/00* (2006.01)
*E21B 43/26* (2006.01)

(52) U.S. Cl.
CPC ..... *F04B 51/00* (2013.01); *E21B 43/2607* (2020.05)

(58) Field of Classification Search
CPC ..... F04B 51/00; F04B 47/02; E21B 43/2607
See application file for complete search history.

(56) References Cited

U.S. PATENT DOCUMENTS 7,143,016 B1 * 11/2006 Discenzo ..... G05B 13/0265 703/3
7,186,094 B2 * 3/2007 Edlund ..... F04B 51/00 417/63
7,240,547 B2 7/2007 Brown
7,668,411 B2 2/2010 Davies
8,306,797 B2 11/2012 Furem
(Continued)

OTHER PUBLICATIONS

International Preliminary Report on Patentability of International Patent Application No. PCT/US2021/056425 dated May 11, 2023, 6 pages.

(Continued)

*Primary Examiner* — Christopher S Bobish
(74) *Attorney, Agent, or Firm* — Jeffrey D. Frantz

(57) ABSTRACT

Pumps for conveying fluid at a wellsite, such as fracturing or other stimulation pumps, are instrumented with sensors to measure or estimate pump parameters. In some instances, pump sensors are used to detect wear or failure or assess remaining useful life of pump components. The sensors can also or instead be used to assess, and in some cases optimize, pump performance.

15 Claims, 50 Drawing Sheets

(56) References Cited

U.S. PATENT DOCUMENTS

| | | | | |
|---|---|---|---|---|
| 9,536,122 | B2 * | 1/2017 | Potyrailo | H04Q 9/00 |
| 9,656,012 | B2 * | 5/2017 | Gagel | A61M 1/1686 |
| 9,915,585 | B2 * | 3/2018 | Pettersson | G01M 13/04 |
| 9,920,615 | B2 * | 3/2018 | Zhang | G01L 5/0061 |
| 10,298,100 | B2 * | 5/2019 | Donolo | H02K 11/25 |
| 10,581,974 | B2 | 3/2020 | Sustaeta | |
| 10,914,698 | B2 * | 2/2021 | Potyrailo | G01N 33/1893 |
| 11,060,889 | B2 * | 7/2021 | Ji | G01D 5/2415 |
| 11,401,929 | B2 * | 8/2022 | Stewart | F04B 49/00 |
| 11,499,547 | B2 * | 11/2022 | Zhang | E21B 43/26 |
| 11,788,931 | B2 * | 10/2023 | Garnier | F01D 21/003 73/112.01 |
| 2004/0167738 | A1 * | 8/2004 | Miller | F04B 51/00 702/114 |
| 2005/0022589 | A1 | 2/2005 | Du | |
| 2007/0132603 | A1 * | 6/2007 | Edlund | F04B 51/00 340/665 |
| 2007/0140869 | A1 * | 6/2007 | St. Michel | F04B 49/22 417/63 |
| 2015/0322765 | A1 | 11/2015 | Clem | |
| 2016/0140432 | A1 * | 5/2016 | Lehovetzki | B25B 13/04 235/492 |
| 2016/0168979 | A1 * | 6/2016 | Zhang | E21B 43/26 73/152.61 |
| 2017/0091358 | A1 * | 3/2017 | Zhang | G06F 30/23 |
| 2017/0175516 | A1 | 6/2017 | Eslinger | |
| 2017/0362928 | A1 * | 12/2017 | Kang | E21B 41/00 |
| 2018/0040226 | A1 | 2/2018 | Zhang et al. | |
| 2018/0058443 | A1 | 3/2018 | Doy | |
| 2018/0087499 | A1 | 3/2018 | Zhang | |
| 2018/0202423 | A1 | 7/2018 | Zhang | |
| 2018/0209415 | A1 | 7/2018 | Zhang | |
| 2018/0223831 | A1 | 8/2018 | Zhang | |
| 2019/0120024 | A1 * | 4/2019 | Oehring | E21B 44/00 |
| 2020/0300065 | A1 | 9/2020 | Christinzio | |
| 2022/0145876 | A1 * | 5/2022 | Stewart | F04B 49/065 |
| 2023/0044928 | A1 * | 2/2023 | Harris | F04B 51/00 |
| 2023/0311359 | A1 * | 10/2023 | Midura | B26F 3/004 83/53 |

OTHER PUBLICATIONS

Muthuvel et al., "Magnetic-Capacitive Wear Debris Sensor Plug for Condition Monitoring of Hydraulic Systems", IEEE Sensors Journal, vol. 18, No. 22, Nov. 15, 2018, pp. 9120-9127.

Zhang et al., "Breakdown Voltage of Transformer Oil Contaminated with Iron Particles at Pulsating DC Voltage", Electric Power Compnents and Systems, vol. 46, 2018, Issue 11-12, pp. 1321-1329.

Search Report and Written Opinion of International Patent Application No. PCT/US2021/056425 dated Feb. 15, 2022; 9 pages.

Lime Instruments, 2019, https://www.linkedin.com/feed/update/um:li:activity:6389452351404601345; 2 pages.

Power Technology, Micafluid: BDVSensor for Synthetic Oil, available at: <https://www.power-technology.com/contractors/filtration/micafluid/pressreleases/bdv-sensor-synthetic-oil-monitoring/>; 11 pages.

Substantive Exam issued in Saudi Arabia Patent Application No. 523440513 dated May 30, 2024, 13 pages with English translation.

* cited by examiner

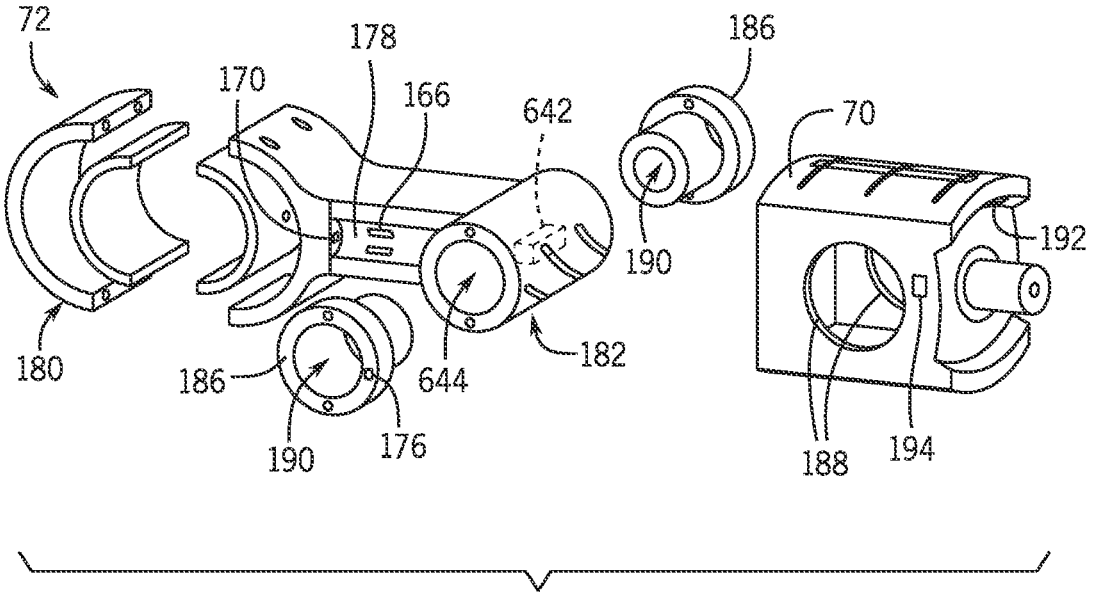
FIG. 65
FIG. 66
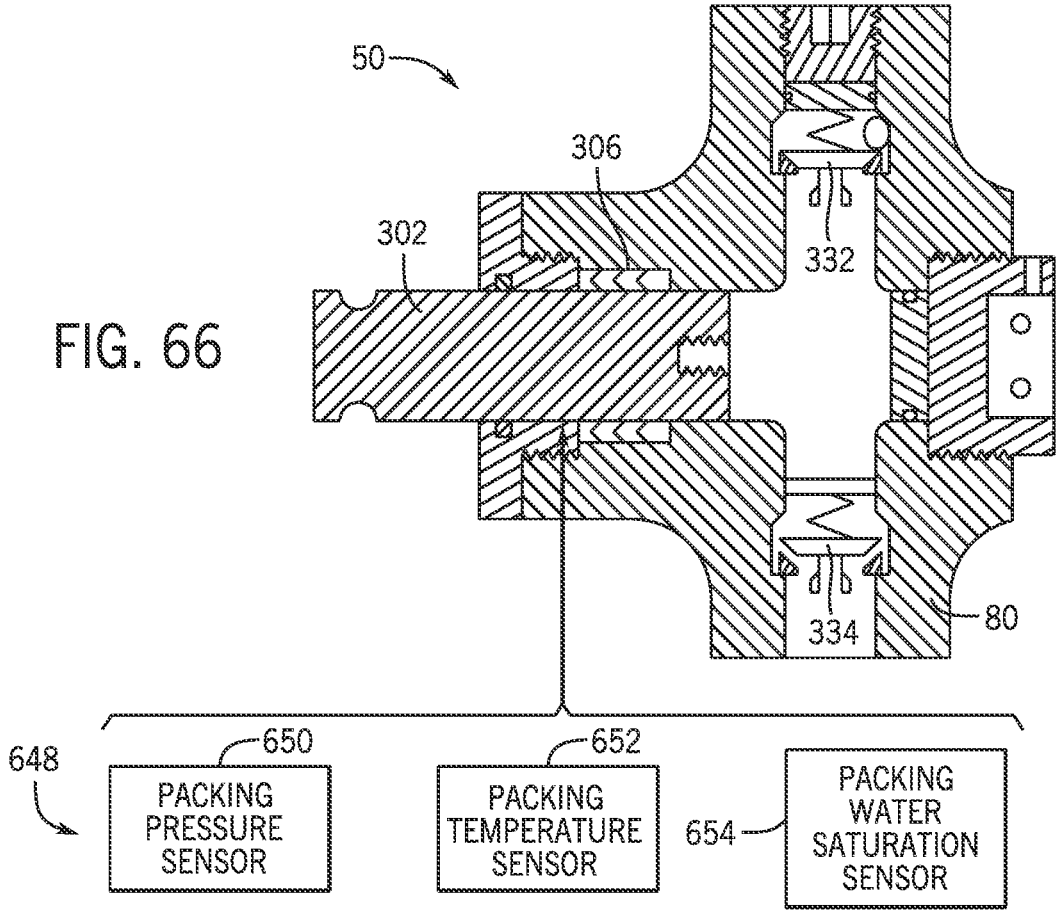

INSTRUMENTED FRACTURING PUMP SYSTEMS AND METHODS

CROSS-REFERENCE TO RELATED APPLICATION

This application is a U.S. National Stage of PCT Application Number PCT/US2021/056425, filed on Oct. 25, 2021, which claims priority to and benefit of U.S. Provisional Patent Application No. 63/105,749, filed Oct. 26, 2020, which is incorporated by reference herein in its entirety.

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in searching for and extracting oil, natural gas, and other subterranean resources from the earth. Particularly, once a desired subterranean resource is discovered, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, valves, fluid conduits, and the like, that control drilling or extraction operations.

Additionally, such wellhead assemblies may use a fracturing tree and other components to facilitate a fracturing process and enhance production from a well. As will be appreciated, resources such as oil and natural gas are generally extracted from fissures or other cavities formed in various subterranean rock formations or strata. To facilitate extraction of such resources, a well may be subjected to a fracturing process that creates one or more man-made fractures in a rock formation. This facilitates, for example, coupling of pre-existing fissures and cavities, allowing oil, gas, or the like to flow into the wellbore. Fracturing processes can use fracturing pumps to inject a fracturing fluid-which is often a mixture including proppant (e.g., sand) and water-into the well to increase the well's pressure and form the man-made fractures. The high pressure of the fluid increases crack size and crack propagation through the rock formation to release oil and gas, while the proppant prevents the cracks from closing once the fluid is depressurized. A fracturing system can include a supply manifold (e.g., a missile trailer) with lines for routing fracturing fluid to and from the fracturing pumps. A wellsite can include other pumps, such as different stimulation pumps, cement pumps, and mud pumps.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Certain embodiments of the present disclosure generally relate to pumps for conveying fluid at a wellsite. More specifically, some embodiments relate to pumps, such as fracturing or other stimulation pumps, instrumented with sensors to measure or estimate pump parameters. In some instances, pump sensors are used to detect wear or failure or assess remaining useful life of pump components. The sensors can also or instead be used to assess, and in some cases optimize, pump performance.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein:

FIG. 65 depicts a connecting rod, crosshead, and wrist pin instrumented with sensors in accordance with one embodiment;

FIG. 66 depicts a fluid end of a pump instrumented with a sensor assembly in accordance with one embodiment;

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
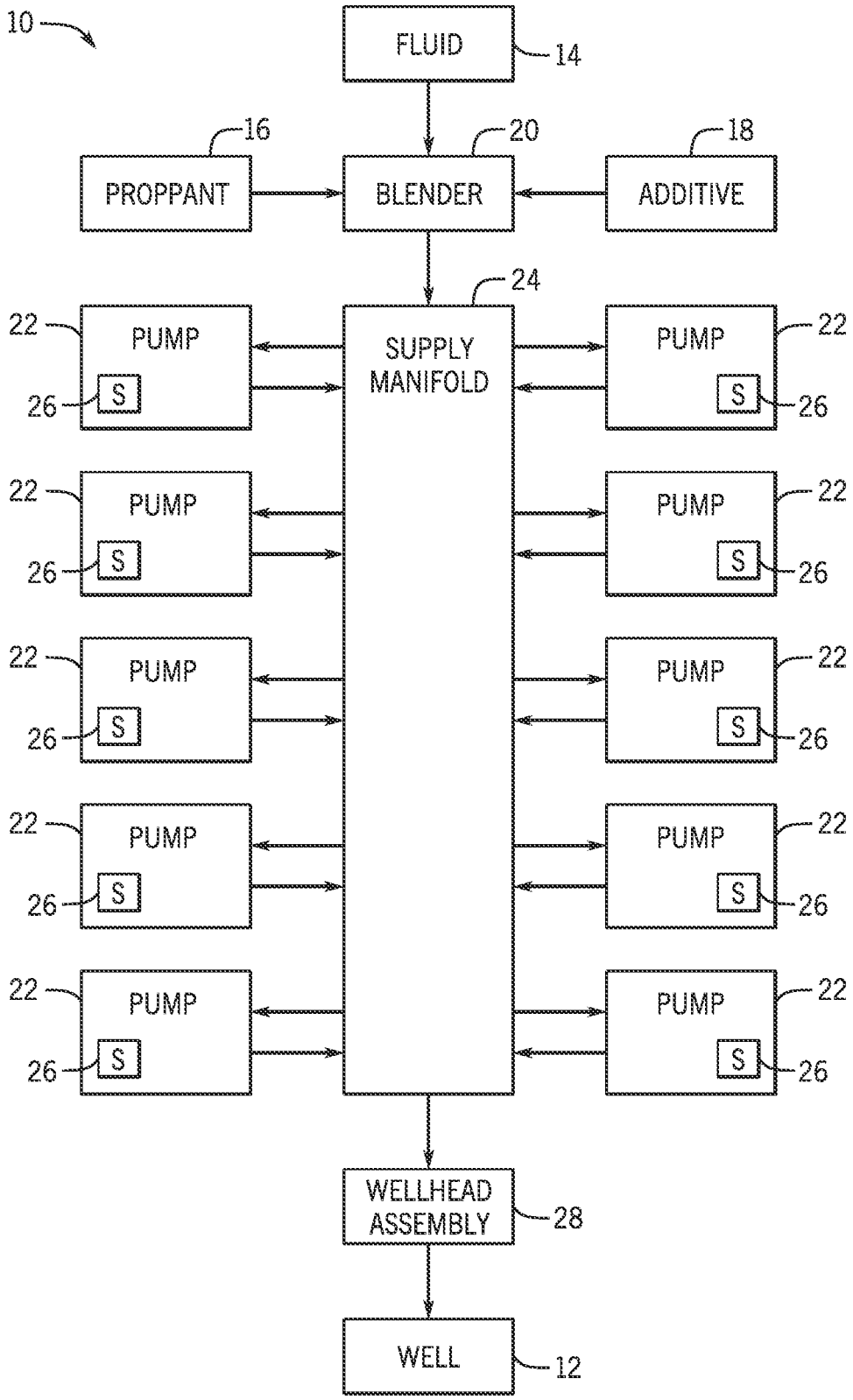
FIG. 1 generally depicts a fracturing system having pumps in accordance with an embodiment of the present disclosure.

Turning now to the drawings, an example of a fracturing system 10 is provided in FIG. 1 in accordance with certain embodiments. The fracturing system 10 facilitates extraction of natural resources, such as oil or natural gas, from a subterranean formation via a well 12. Particularly, by injecting a fracturing fluid into the well 12, the fracturing system 10 increases the number or size of fractures in a rock formation or strata to enhance recovery of natural resources present in the formation. Well 12 is a surface well in some embodiments, but it will be appreciated that resources may be extracted from other wells 12, such as platform or subsea wells.

The depicted fracturing system 10 includes a blender 20 for producing fracturing fluid by mixing a fluid 14 (e.g., water) with proppant 16 (e.g., sand) and additive 18 (e.g., a chemical additive). Pumps 22, which may be mounted on trucks, are used to increase the pressure of the fracturing fluid received from the blender 20 to an appropriate pressure for fracturing the well 12. In some instances, the fracturing pressure may be 10,000-15,000 psi (approximately 70,000-100,000 kPA). A supply manifold 24 (e.g., a frac missile trailer) may be used to route fluid to and from the pumps 22. For instance, the supply manifold 24 can route low-pressure fracturing fluid from the blender 20 to the pumps 22 for pressurization. High-pressure fracturing fluid from the pumps 22 may be returned to the supply manifold 24 and then routed into a well 12 through a wellhead assembly 28 (e.g., a wellhead and a fracturing tree). In some embodiments, and as discussed in greater detail below, the pumps 22 include sensors 26 for monitoring pump health and operation.

Figure 2:
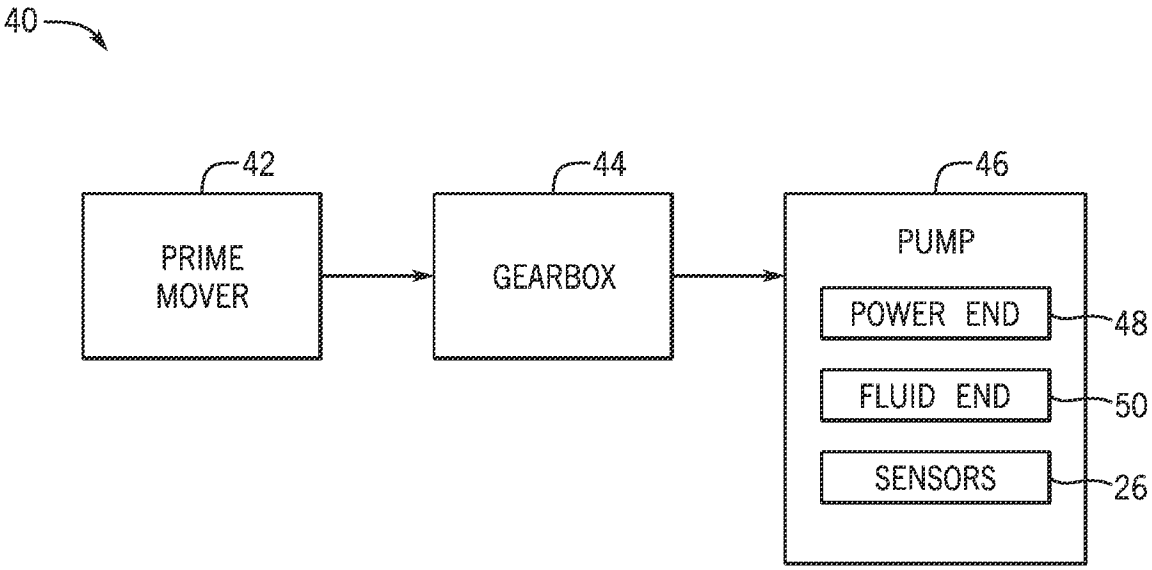
FIG. 2 is a block diagram of components of a pump system that may be used as a pump of FIG. 1 in accordance with one embodiment.

The pumps 22 in some instances are positive displacement pumps, such as triplex or quintuplex plunger pumps, but may take a different form in other instances, such as centrifugal pumps or progressing cavity pumps. One example of a pump system 40 that may be used for pump 22 in the fracturing system 10 is generally depicted in FIG. 2 as having a prime mover 42 (e.g., a diesel, electric, or hydraulic motor) connected by a gearbox 44 to provide torque to a positive displacement pump 46. The provided torque drives power transmission components in the power end 48 of the pump 46 to cause pressurization of a fluid (e.g., fracturing fluid or another stimulation fluid) in the fluid end 50 of the pump 46. The pump 46 may be instrumented with sensors 26, which may be used for measuring operational parameters, diagnosing wear of pump components, estimating remaining life of pump components, or optimizing pump operation, as discussed in greater detail below.

Figure 3:
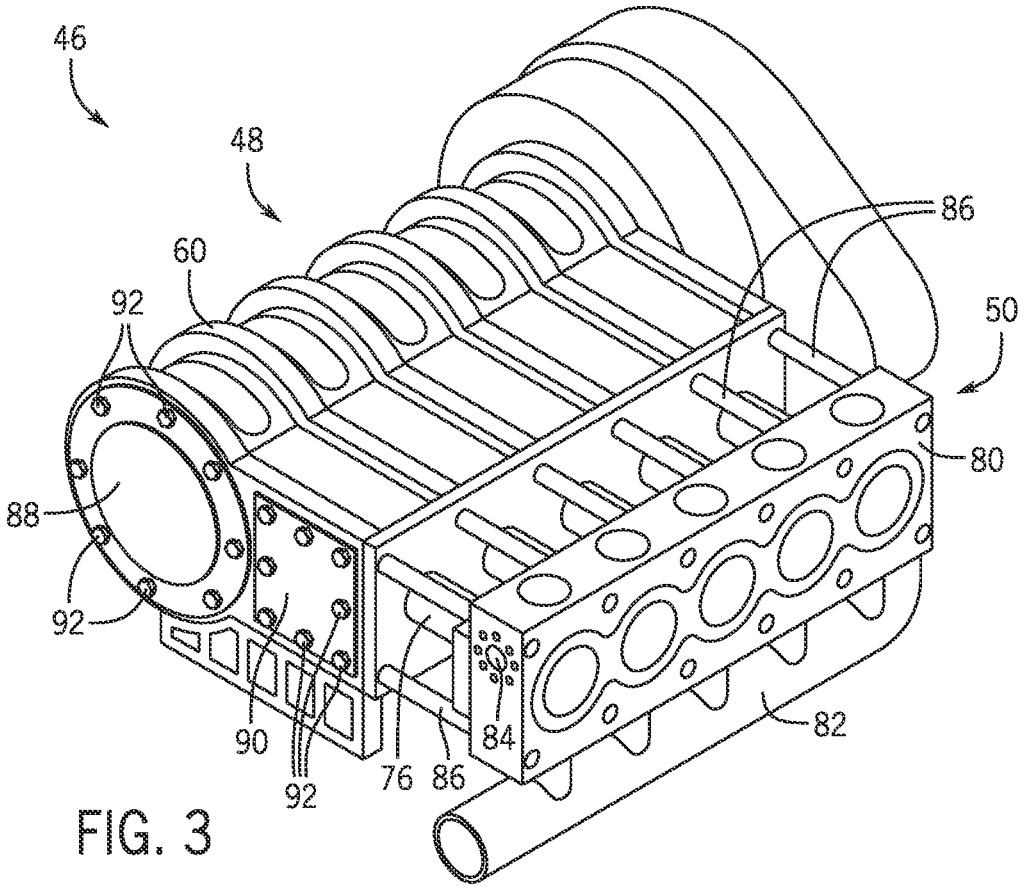
FIG. 3 is a perspective view of a quintuplex plunger pump in accordance with one embodiment.
Figure 4:
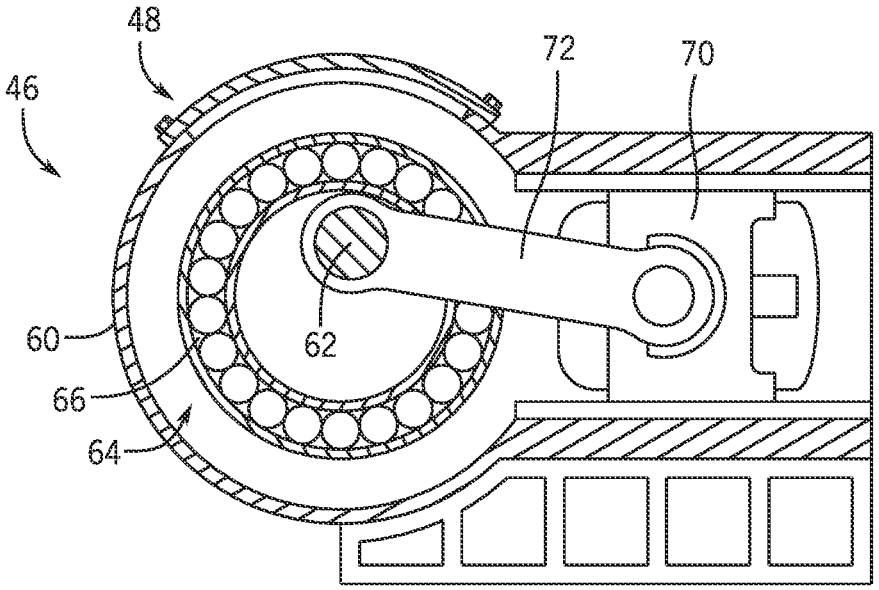
FIG. 4 is a cross-section of the quintuplex plunger pump of FIG. 3 in accordance with one embodiment.

An example of a pump 46 in the form of a quintuplex plunger pump is depicted in FIGS. 3 and 4 in accordance with one embodiment. The depicted pump 46 includes a power end housing 60 and a crankshaft 62 disposed within an internal cavity 64. Bearings 66 (e.g., roller bearings) support and allow rotation of the crankshaft 62 to drive reciprocal motion of crossheads 70 via connecting rods 72. While one connecting rod 72 and crosshead 70 is depicted in FIG. 4, it will be appreciated that each of the other four crossheads 70 of the quintuplex pump can be coupled to the crankshaft 62 by another connecting rod 72. Pony rods 76 transmit the reciprocal motion of the crossheads 70 to plungers that pressurize fluid in the fluid-end body 80. Reciprocal motion of the plungers draws fluid (e.g., fracturing fluid) into the body 80 through a suction manifold 82, pressurizes the fluid, and discharges the fluid out of the body 80 via a discharge manifold 84. The fluid-end body 80 can be connected to the power end 48 via stay rods 86. Certain internal components of the power end 48 may be accessed through side cover plates 88 and 90, which may be secured to the housing 60 with fasteners 92 (e.g., bolts) or in any other suitable manner.

Figure 5:
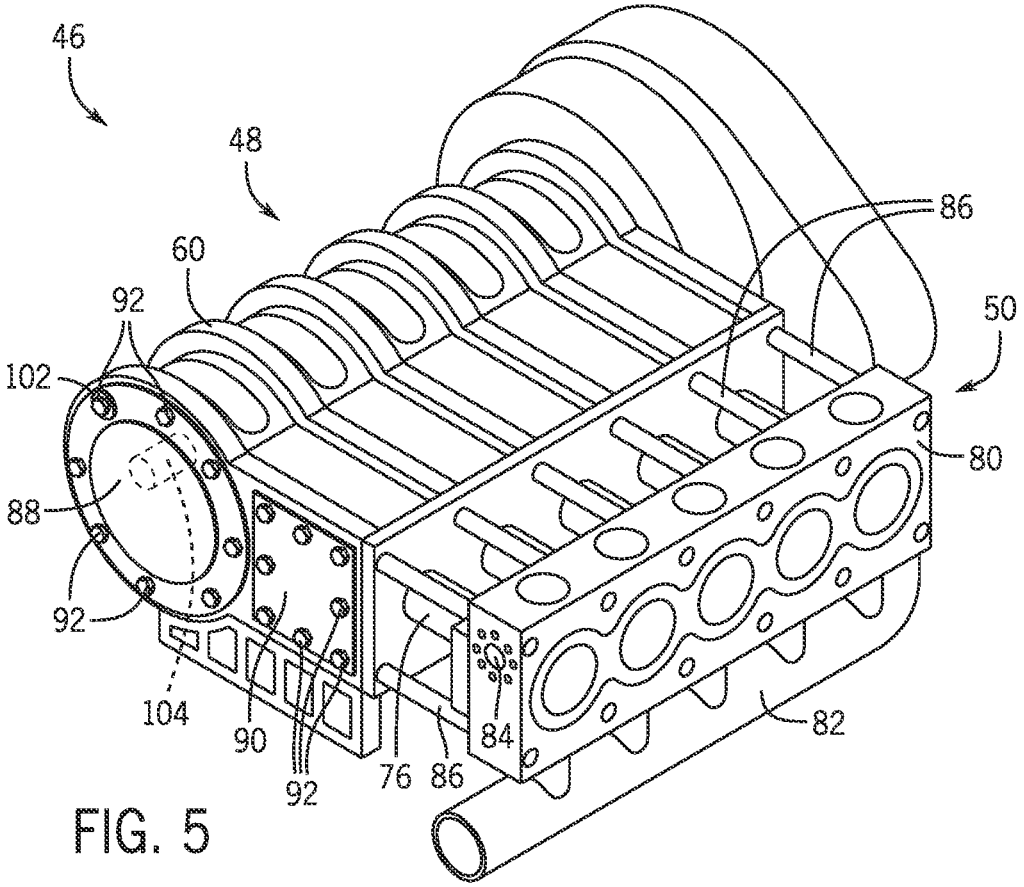
FIG. 5 depicts a quintuplex plunger pump having a load washer and a crankshaft encoder in accordance with one embodiment.

In one embodiment generally illustrated in FIG. 5, the pump 46 includes a load washer 102 to measure axial thrust load of the crankshaft 62. The load washer 102 may be installed on a bolt 92 in the side plate 88. As depicted in FIG. 5, the pump 46 may also include a crankshaft encoder 104 for detecting angular position of the crankshaft 62 within the housing 60. The crankshaft encoder 104 may be coupled to the crankshaft in any suitable manner. In one instance, for example, the encoder 104 is a hollow-shaft encoder that is slid onto an extension adapter connected to the crankshaft 62 at a lubricating swivel end.

Figure 6:
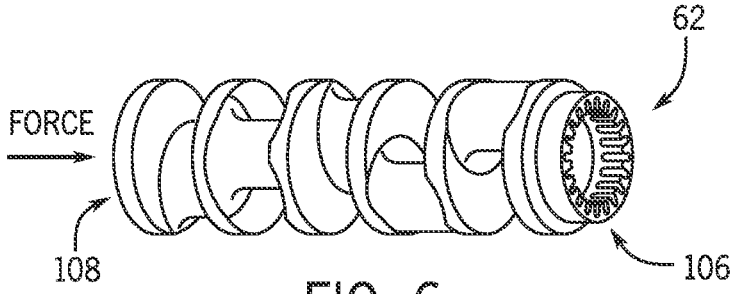
FIGS. 6 and 7 depict axial loading of a crankshaft of a quintuplex plunger pump in accordance with one embodiment.
Figure 7:
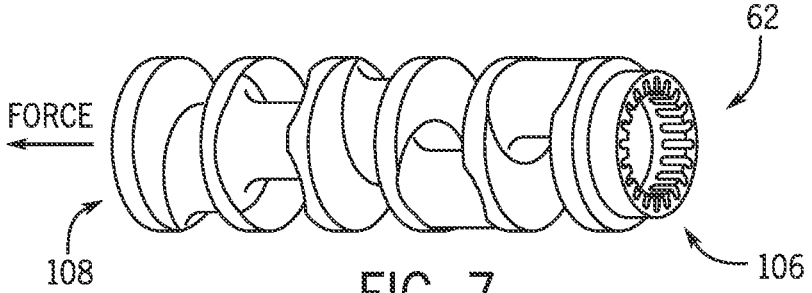
Figure 8:
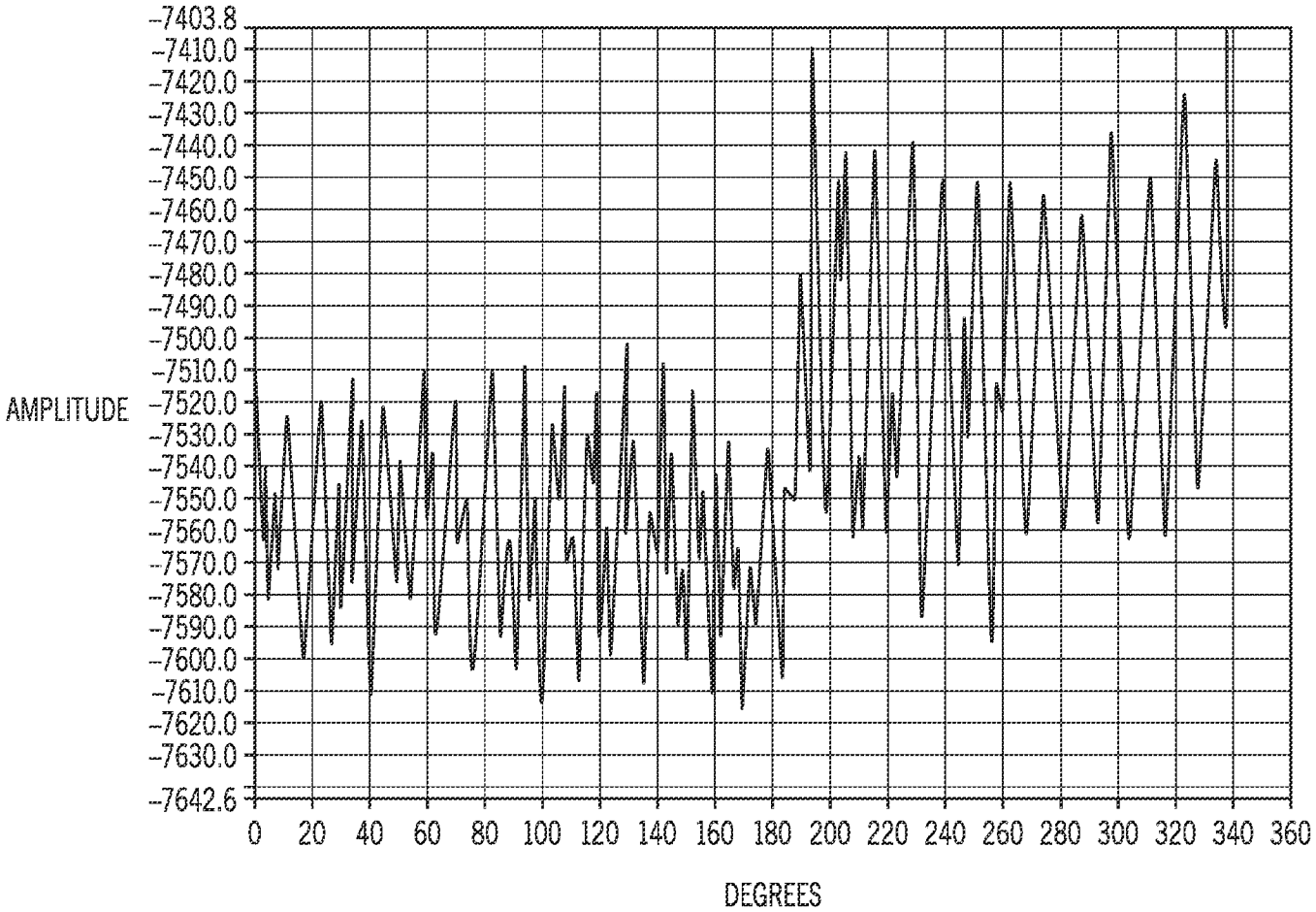
FIG. 8 is a graph depicting measured axial load of the crankshaft as a function of angle in accordance with one embodiment.

A crankshaft 62 in accordance with one embodiment is depicted in FIGS. 6 and 7 as having a splined end 106 (which may facilitate driving of the crankshaft 62) and an opposite end 108. As the crankshaft is loaded by the connecting rods the total length of the crankshaft may be reduced. Further, non-uniformities in the main bearings may also cause both overall axial motion and compression of the length. This can be captured as a reduction in axial load per crankshaft angle or other parameter by the load washer as generally shown in FIG. 6. Conversely, as the crankshaft loading relaxes under reduced connecting rod loading or the non-uniformities in the main bearings shift, the increase in axial length or motion of the crankshaft may be captured as an increase in the load seen by the load washer, as generally shown in FIG. 7. It will be appreciated that the change in length or position of the crankshaft 62 is greatly exaggerated in FIGS. 6 and 7 for illustrative purposes and that the depictions of the crankshaft 62 are not scaled identically in these figures. The rate of change of load can be proportional to the torsional load, connecting rod load, bearing non-linearity, or other pumping parameters in pump 46. The high-resolution angle provided by the encoder 104 can be used to analyze the sensor data (e.g., axial load) in the angle domain, such as shown in FIG. 8.

Figure 9:
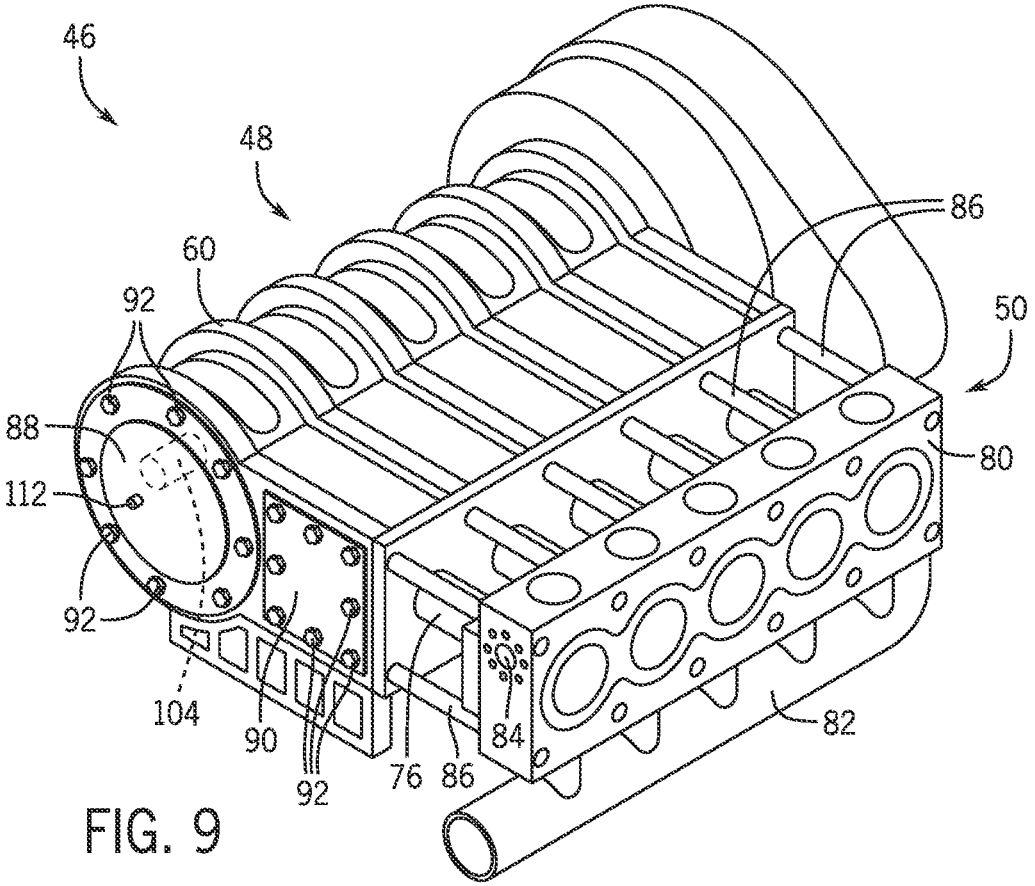
FIG. 9 depicts a quintuplex plunger pump having a proximity sensor and a crankshaft encoder in accordance with one embodiment.

In another embodiment, a proximity sensor may be used to detect axial displacement of the crankshaft 62. As shown in FIG. 9, for example, the pump 46 is instrumented with a proximity sensor 112. In at least some instances, the proximity sensor is mounted on a hole in the side plate 88 of the power end 48 to have visibility of internal rotating crankshaft components (e.g., the crankshaft 62 or components thereof). The pump 46 may also include a crankshaft encoder 104, such as described above.

Figure 10:
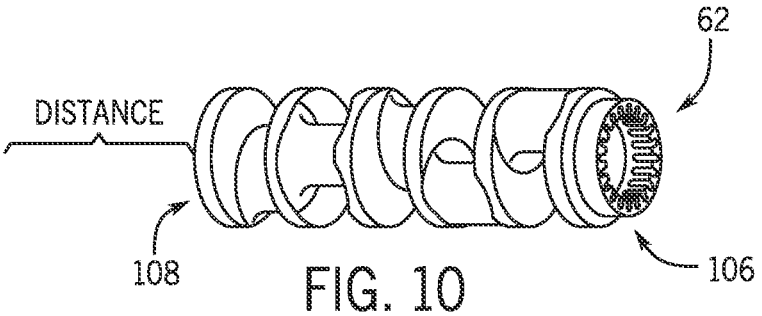
FIGS. 10 and 11 depict change in axial length or movement of a crankshaft of a quintuplex plunger pump in accordance with one embodiment.
Figure 11:
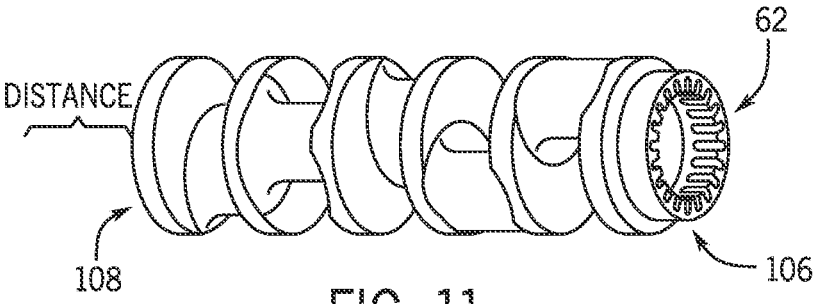
Figure 12:
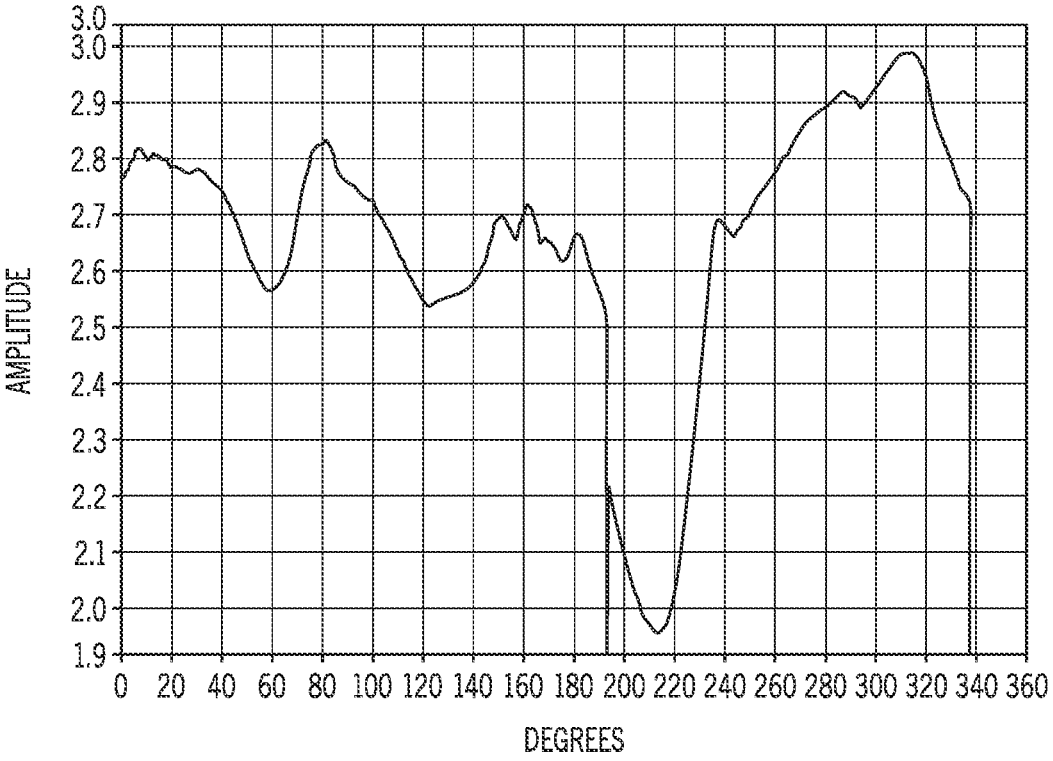
FIG. 12 is a graph depicting an axial distance, measured by a proximity sensor, as a function of crankshaft angle in accordance with one embodiment.

As the crankshaft 62 is loaded by the connecting rods the total length of the crankshaft may be reduced. Further, non-uniformities in the main bearings may also cause both overall axial motion and compression of the length. This can be captured as an increase in axial distance per crankshaft angle or other parameter by the proximity sensor 112, as generally shown in FIG. 10. Conversely, as the crankshaft loading relaxes under reduced connecting rod loading or the non-uniformities in the main bearings shift, the increase in axial length or motion may be captured as a decrease in axial distance seen by the proximity sensor 112, as generally shown in FIG. 11. It will be appreciated that the change in length or position of the crankshaft 62 is greatly exaggerated in FIGS. 10 and 11 for illustrative purposes and that the depictions of the crankshaft 62 are not scaled identically in these figures. The rate of change of load can be proportional to the torsional load, connecting rod load, bearing non-linearity, or other pumping parameters in pump 46. The high-resolution angle provided by the encoder 104 can be used to analyze the sensor data (e.g., axial distance) in the angle domain, such as shown in FIG. 12.

Oilfield equipment vibration can be measured and used to assess various equipment characteristics, such as performance and condition. For example, a sensor (e.g., an accelerometer or velocity sensor) can be placed at a fixed location on oilfield equipment to measure vibration along one or more linear axes, with the position of each axis being stationary with reference to the equipment frame. In the case of equipment driven by a rotating shaft, spring-like elastic properties of driveshaft material can cause torsional vibrations that may negatively impact equipment performance or health. A vibration measurement by an accelerometer or velocity sensor at a fixed location on the equipment includes various sources of vibration that happen to align with the axis of the sensor, of which driveshaft torsion can be just one of many sources. But in some embodiments a system includes electrical or mechanical components that allow measurement of torsional vibration of equipment driven by a rotating shaft in oilfield equipment, such as fracturing, cementing, or mud positive displacement pumps, centrifugal pumps, hydraulic motors, electrical motors, transmissions, and gear boxes. Torsional vibration may be measured separately from other forms of equipment vibration through a rotating frame of reference aligned with the rotating driveshaft, which allows other non-torsional vibration sources to be filtered. In some embodiments, the measured torsional vibration can be used for equipment health monitoring or as a parameter in a condition-based maintenance program or digital twin model of the equipment. The present technique may also be applied to non-oilfield rotating equipment, which may include other pumps (e.g., refining pumps) or motors.

Figure 13:
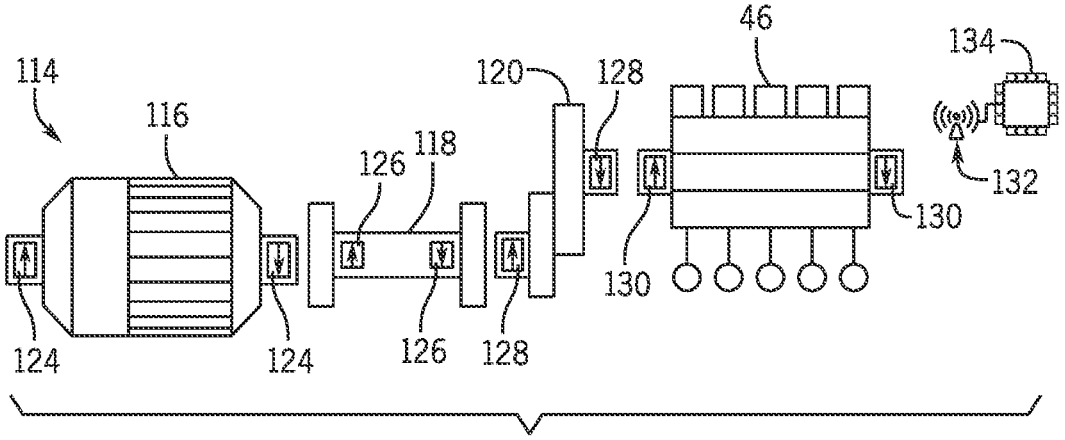
FIG. 13 is a system having a motor, driveshaft, gearbox, and pump instrumented with accelerometers in accordance with one embodiment.

In one embodiment generally depicted in FIG. 13, a system 114 includes a motor 116 interfaced through a driveshaft 118 to a gearbox 120 that is connected to a pump 46. The pump 46 is generally depicted as a quintuplex pump but may take any other suitable form in different embodiments. Accelerometers 124, 126, 128, and 130 (e.g., wireless triaxial accelerometers) are placed across opposite ends of the driveshafts of each of the aforementioned components with opposite-axes orientations. The accelerometers interface wirelessly to an access point 132, which sends the acceleration data to a controller 134, such as a programmable logic controller. The controller 134 compares (e.g., adds) the acceleration values of any two adjacent accelerometers to analyze the torsional vibration of the driveshaft section between those accelerometers. For example, comparing the acceleration data of the accelerometers 124 of the motor 116 provides the torsional vibration across the motor shaft. Similarly, comparing the acceleration data of the accelerometers 126 provides the torsional vibration across the driveshaft 118. Likewise, comparing the acceleration data of accelerometers 128 provides the torsional vibration across the gearbox 120, and comparing the acceleration data of accelerometers 130 provides the torsional vibration across the pump 46.

Figure 14:
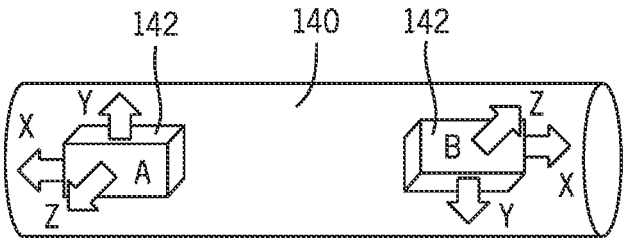
FIGS. 14-16 generally depict accelerometers at opposite ends of a shaft of the system of FIG. 13 in accordance with one embodiment.
Figure 15:
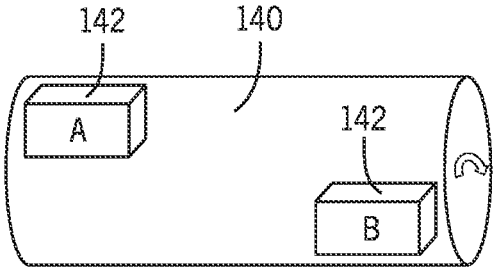
Figure 16:
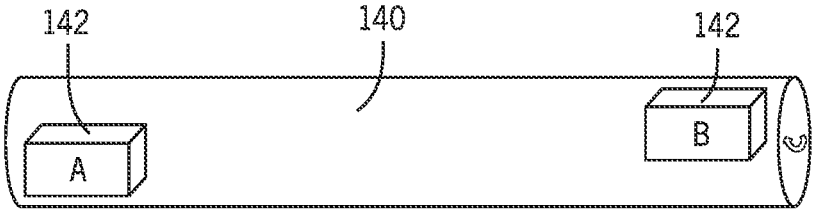

Once the system is operational and the motor 116 begins to rotate, the elastic spring-like properties of the shafts for the motor 116, the driveshaft 118, the gearbox 120, and the pump 46 can cause the accelerations measured by the accelerometers 124, 126, 128, and 130 to differ. The difference between two accelerometers on the same shaft can be proportional to the torsional vibrations experienced by the shaft. As an example, FIG. 14 depicts a shaft 140 (e.g., a shaft of the motor 116, the driveshaft 118, the gearbox 120, or the pump 46) with two accelerometers 142 (e.g., accelerometer 124, 126, 128, or 130) at opposite ends and with opposite-axes orientations. If the shaft 140 does not experience torsional vibration once it starts to rotate, the addition of the accelerometer values would be zero. However, as shown in FIGS. 15 and 16, the elastic spring-like properties of the shaft 140 may result in the accelerometers 142 having offsets along all axes. The shaft 140 may compress or extend along the X-axis. The shaft may develop displacement along the rotational Y-axis. Lastly, the shaft may even experience offsets along the Z-axis.

The measurement of the torsional vibrations may be used during product development to avoid or compensate for natural resonant frequencies that can result in equipment damage and instability. Additionally, the measurement of torsional vibrations across the equipment life can be used to feed into a digital twin model for data-driven capture of the torsional vibration increase with usage and during different operational conditions. Lastly, the measurement of torsional vibrations during equipment life can help identify excessive torsional vibrations which signal imminent equipment failure and thus allow maintenance teams to remove the equipment from service for maintenance prior to it failing during the job and causing downtime.

Figure 17:
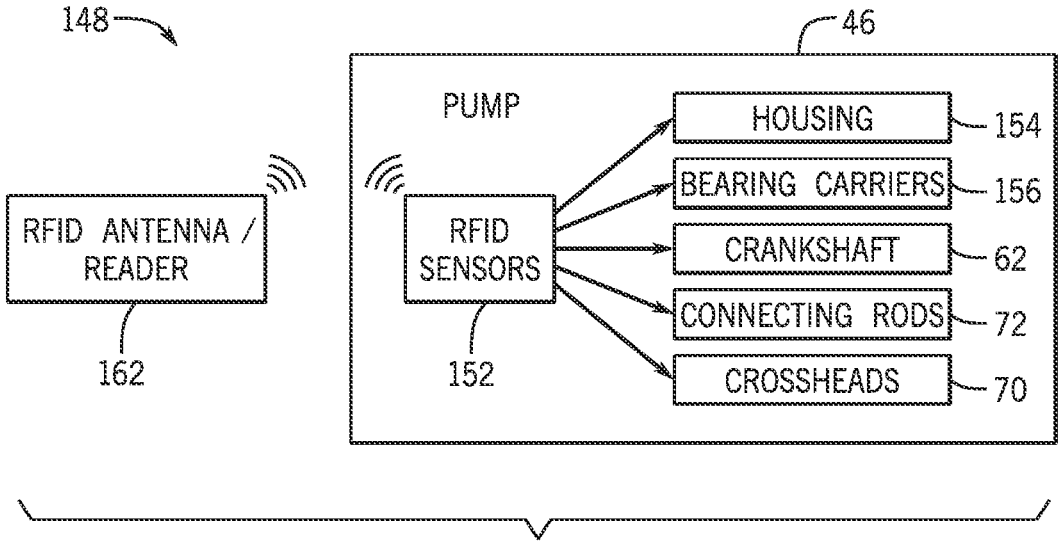
FIG. 17 is a system having a pump instrumented with RFID sensors in accordance with one embodiment.

In some embodiments, oilfield equipment can include radio-frequency identification (RFID) sensors used to sense temperature, vibration, strain, or other parameters. By way of example, a system 148 is generally illustrated in FIG. 17 as having a pump 46 instrumented with RFID sensors 152 positioned on various components. The pump 46 may take various other forms, but in the present example the pump 46 is a positive displacement pump, such as a triplex or quintuplex pump. The pump 46 may also have other sensors, such as a crankshaft encoder 104, an accelerometer, or other sensors described herein. RFID sensors 152 can be positioned on the crankshaft 62, the connecting rods 72, the crossheads 70, a pump housing 154 (e.g., the power-end housing 60 or the fluid-end body 80), bearing carriers 156 (e.g., for bearings supporting the crankshaft 62), or other desired components of the pump 46. In some instances, mounting brackets (e.g., 3-D printed mounting brackets) are used to facilitate installation of the RFID sensors in the pump 46.

The RFID sensors 152 communicate wirelessly with one or more RFID antennas 162, which may be positioned apart from the pump 46. In some instances, the RFID sensors 152 do not have batteries (e.g., passive RFID sensors). In such cases, the RFID antenna 162 can wirelessly power the RFID sensors 152 and periodically poll the sensor values. In other instances, however, some or each of the RFID sensors 152 may include a battery (e.g., active or battery-assisted passive RFID sensors) to facilitate operation. The RFID antenna 162 may be integrated within an RFID reader (as generally represented by the RFID antenna/reader 162 in FIG. 17), or a separate RFID reader may be used.

Figure 18:
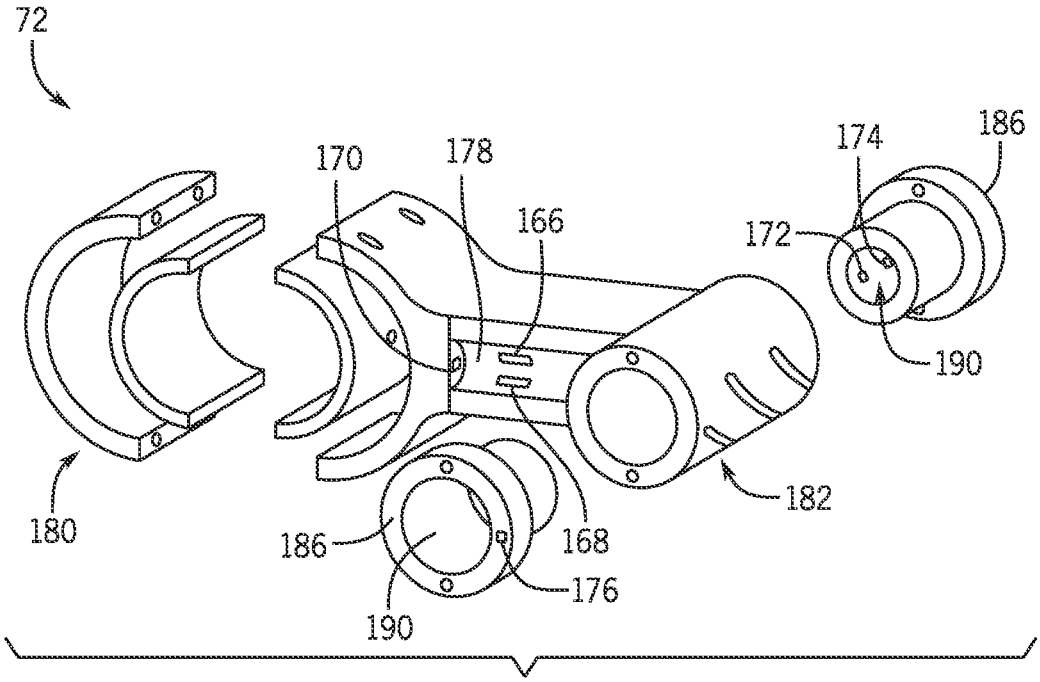
FIG. 18 depicts a connecting rod of the pump of FIG. 17 with RFID sensors in accordance with one embodiment.

The RFID sensors 152 may be positioned at various locations on pump components of interest. For instance, as depicted in FIG. 18, RFID sensors 152 may include RFID sensors 166, 168, 170, 172, 174, and 176. The RFID sensors 166 and 168 are shown mounted on an elongate side 178 of a connecting rod 72 (between a power end 180 and a crosshead end 182 of the connecting rod 72) and the RFID sensor 170 is shown mounted on a side of the power end 180. The RFID sensors 172, 174, and 176 are shown mounted on a wrist pin 186. The depicted wrist pin 186 includes opposing portions that may be installed in apertures 188 (FIG. 19) of the crosshead 70 to extend into a bore of the crosshead end 182 and secure the connecting rod 72 to the crosshead 70. The RFID sensors 172 and 174 are shown mounted within an internal cavity 190 of the wrist pin 186, while RFID sensor 176 is mounted on an exterior surface of the wrist pin 186. With the wrist pin 186 installed, the RFID sensors 172 and 174 may be positioned within the bore of the crosshead end 182 that receives the wrist pin 186. Other RFID sensors could also or instead be installed in the bore of the crosshead end 182. The RFID sensors in FIG. 18 can be of any suitable type or form, but in one embodiment the RFID sensor 166 is an RFID strain gauge, the RFID sensors 168 and 174 are RFID accelerometers, and the RFID sensors 170, 172, and 176 are RFID temperature sensors. And while a single connecting rod 72 and associated wrist pin 186 are depicted in FIG. 18 as an example, it will be appreciated that other connecting rods 72 and wrist pins 186 of the pump 46 may also be instrumented with one or more RFID sensors 152. In some cases, each of the connecting rods 72 (and associated wrist pin 186) of a pump 46 are identically instrumented.

Figure 19:
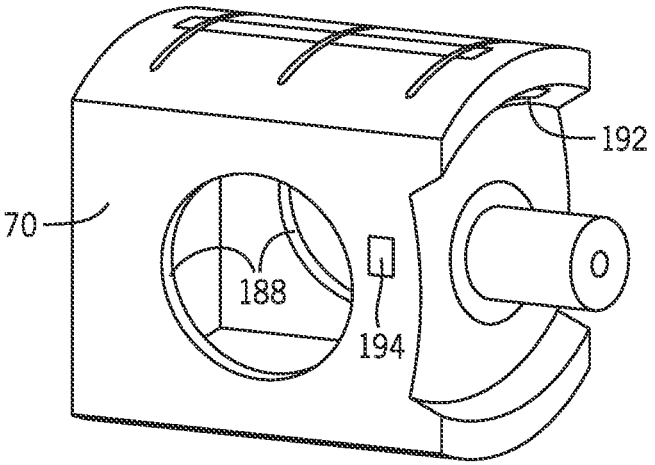
FIG. 19 depicts a crosshead of the pump of FIG. 17 with RFID sensors in accordance with one embodiment.

Crossheads 70 may also carry RFID sensors 152. In FIG. 19, for example, a crosshead 70 includes RFID sensors 192 and 194. The RFID sensor 192 is shown on the underside of a front lip of the crosshead 70 and the RFID sensor 194 is shown on a side of the crosshead 70. But these or other RFID sensors may be positioned at any suitable location (outside or inside) of the crosshead 70, and the RFID sensors of the crosshead 70 may be of any suitable type or form. In one embodiment, the RFID sensors 192 and 194 are RFID temperature sensors. While a single crosshead 70 is depicted in FIG. 19, some or all of the crossheads 70 of a pump 46 may be instrumented similarly or identically with RFID sensors. Further, to facilitate communication between the RFID sensors and external devices (e.g., RFID antenna 162), the cover 90 (FIG. 3) of the power-end housing 60 may be made with a radio-frequency (RF) transparent material, such as acrylic or some other plastic.

Figure 20:
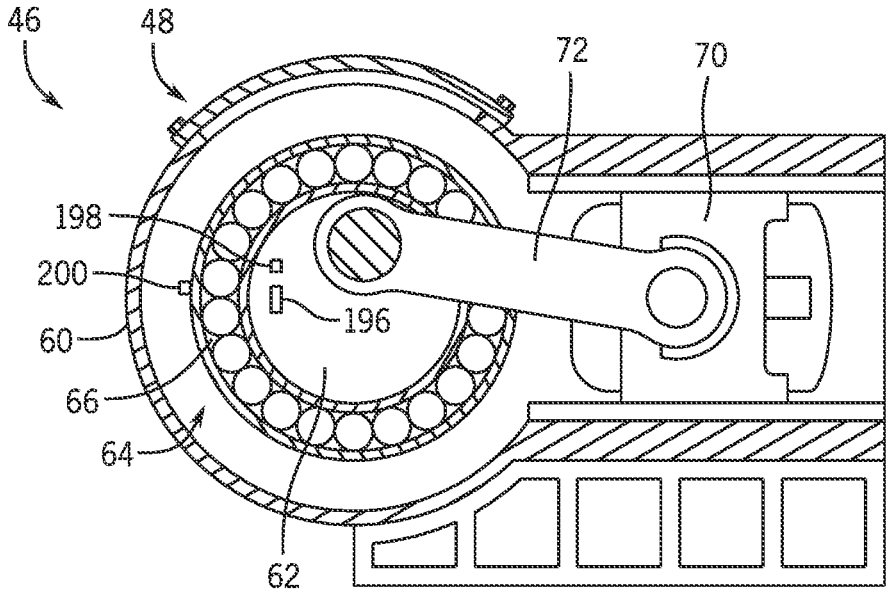
FIG. 20 depicts a power-end housing of a pump with RFID sensors in accordance with one embodiment.

As depicted in FIG. 20, the RFID sensors 152 can include RFID sensors 196, 198, and 200 mounted within cavity 64 of the power-end housing 60. More specifically, the sensors 196 and 198 are shown mounted on the crankshaft 62, while the RFID sensor 200 may be mounted elsewhere (e.g., on a bearing carrier 156 supporting a bearing 66). In one embodiment, the RFID sensor 196 is an RFID accelerometer and the RFID sensors 198 and 200 are RFID temperature sensors, but the RFID sensors can be of any suitable type or form and positioned at any suitable location (e.g., elsewhere on or within the power end 48 or fluid end 50 of the pump 46). In some instances, RFID accelerometers are positioned at multiple axial locations along the crankshaft 62 (e.g., on opposite ends), such as to measure torsional vibration along the crankshaft 62.

Connecting rod, crosshead, crankshaft, and wrist pin wear can occur in the form of temporary elastic and permanent plastic deformations caused by structural stress resulting from crankshaft rotation and plunger motion. Deformations can eventually lead to fractures or cracks that eventually prevent the rotation of the crankshaft from pushing the plunger and thus keep the pump from moving anymore.

Figure 21:
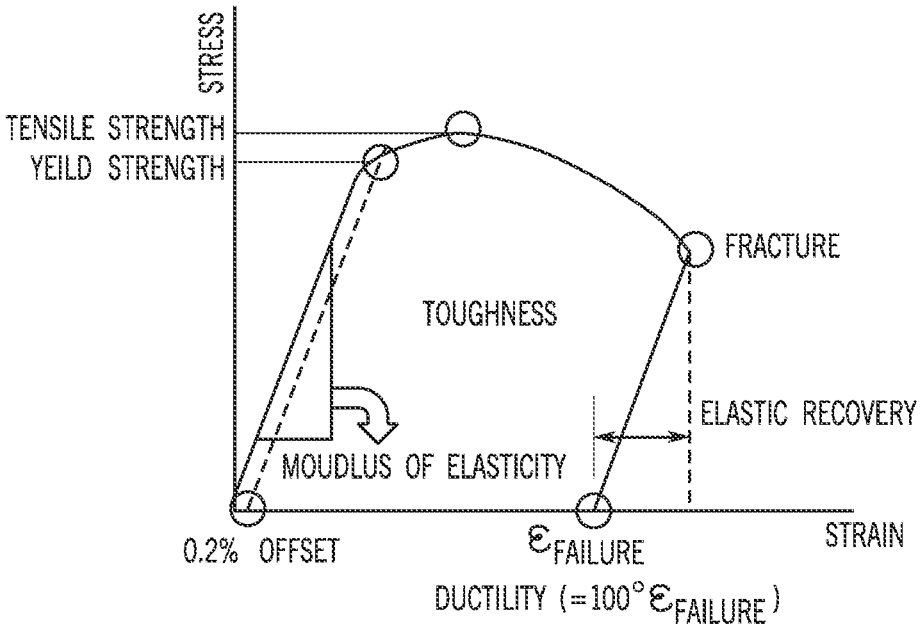
FIG. 21 is a stress-strain curve in accordance with one embodiment.

In some embodiments of the pump 46, connecting rod wear is analyzed through abnormal strain and temperature RFID sensor signatures (e.g., from RFID sensors 166 and 170). Temperatures higher than expected can be used to estimate higher wear. Also, angle domain analysis of strain gauge signatures allows determination of whether the amount of stress experienced is within the plastic or elastic region, or under an endurance limit of the connecting rod, and thus estimation of how close to a fracture the connecting rod is and at which time the connecting rod should be replaced during maintenance. When load is increased during high-torque periods, the rate of change of strain per angle is used to identify a threshold at which permanent plastic deformation is occurring. When load is reduced during low-torque periods, strain vs. angle is compared to previous high load cases to estimate how much stress has become permanent and thus it is accumulated as permanent plastic deformation and assigned a wear score. An example of a stress-strain curve is shown in FIG. 21.

Figure 22:
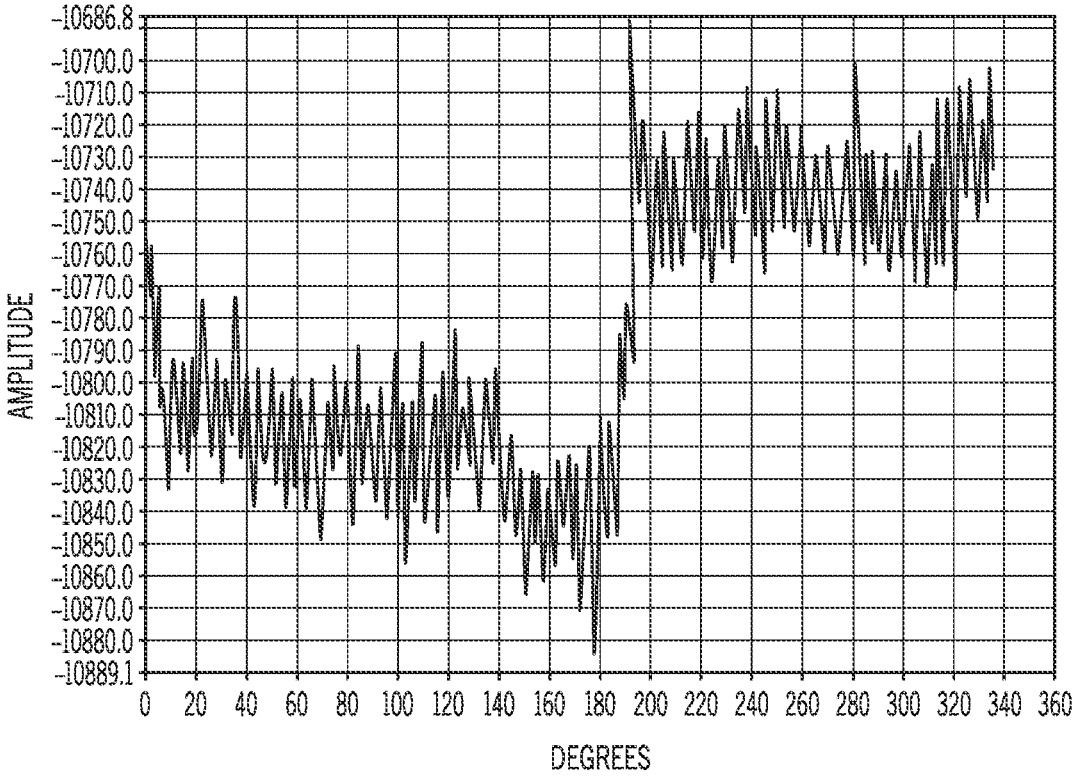
FIG. 22 is a graph depicting stress on a connecting rod as a function of crankshaft angle in accordance with one embodiment.

The reciprocal nature of the pump 46 means that within one pump cycle, the strain gauge (e.g., RF sensor 166) located on the connecting rod 72 experiences different amounts of stress. However, the amount of stress acquired will be periodic within one pump revolution, as shown in FIG. 22.

Figure 23:
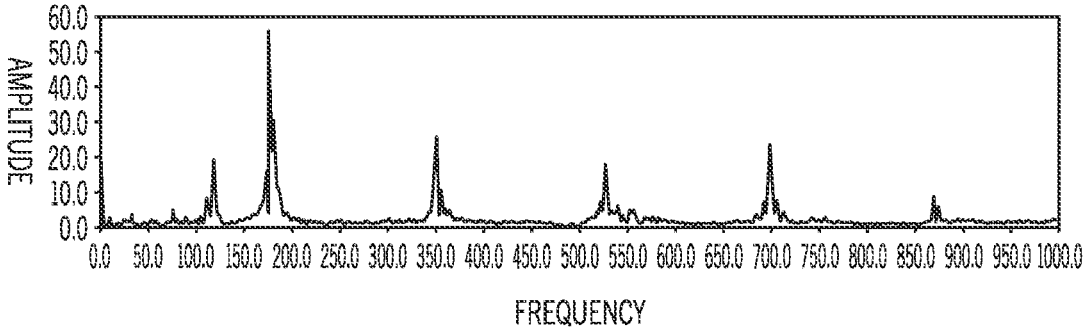
FIG. 23 depicts a vibration signature that may be measured by an RFID accelerometer of the pump in accordance with one embodiment.
Figure 24:
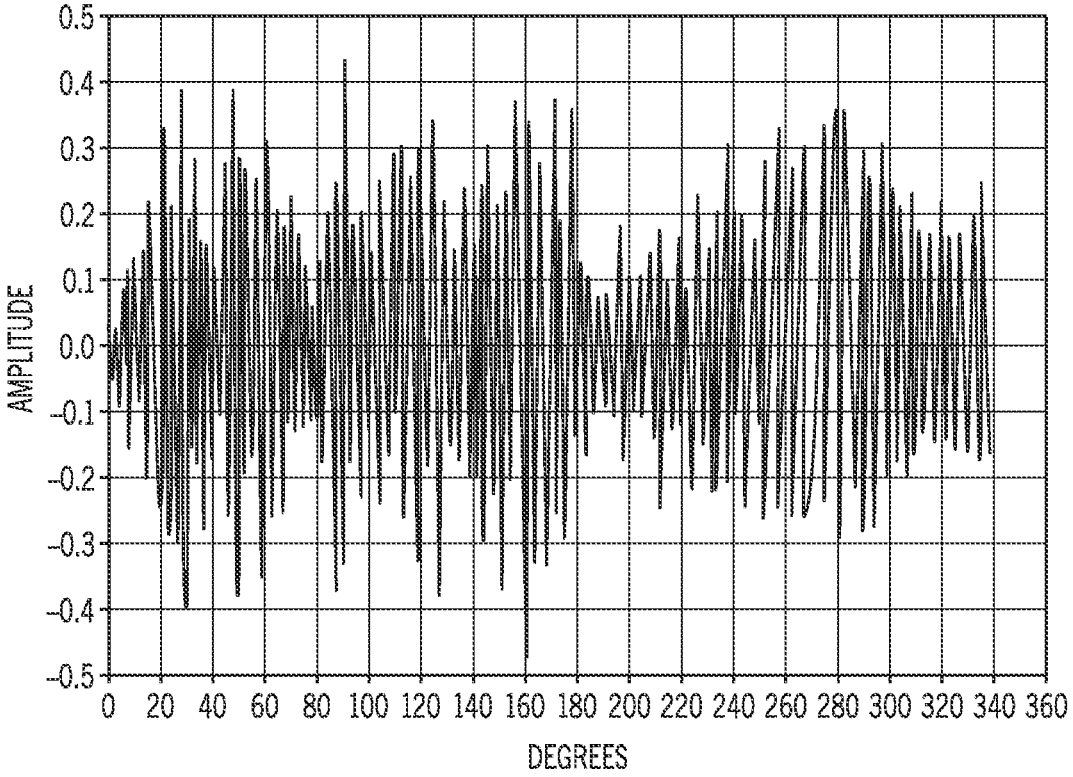
FIG. 24 shows an amplitude of torsional vibration as a function of crankshaft angle in accordance with one embodiment.

Deformations closer to the wrist pin 186 result in abnormal vibrations and temperatures that are acquired by an RFID accelerometer (e.g., RFID sensor 174) and RFID temperature sensor (e.g., RFID sensor 172) located inside of the wrist pin 186. An example of a vibration signature that may be measured by an RFID accelerometer is shown in FIG. 23. In another example, two RFID accelerometers (e.g., two RFID sensors 196) are installed on opposite ends of the crankshaft 62 (e.g., at identical locations and orientations on opposite ends). The difference of vibration measured by the accelerometers can be used to calculate the amplitude of the torsional vibration, as shown in FIG. 24.

Figure 25:
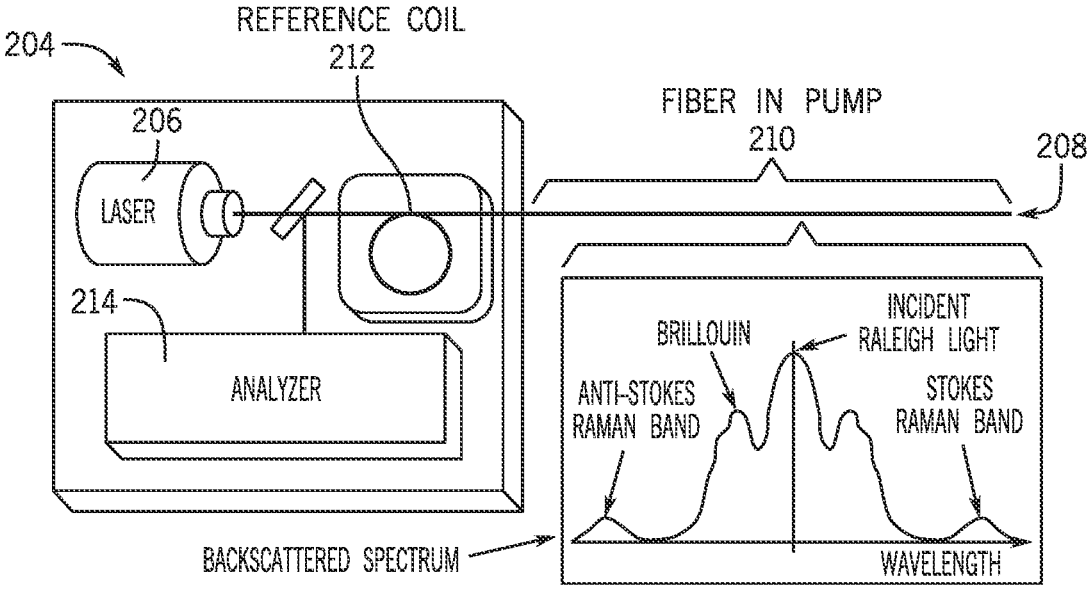
FIG. 25 depicts a measurement system with optical fiber for measuring pump parameters in accordance with one embodiment.
Figure 26:
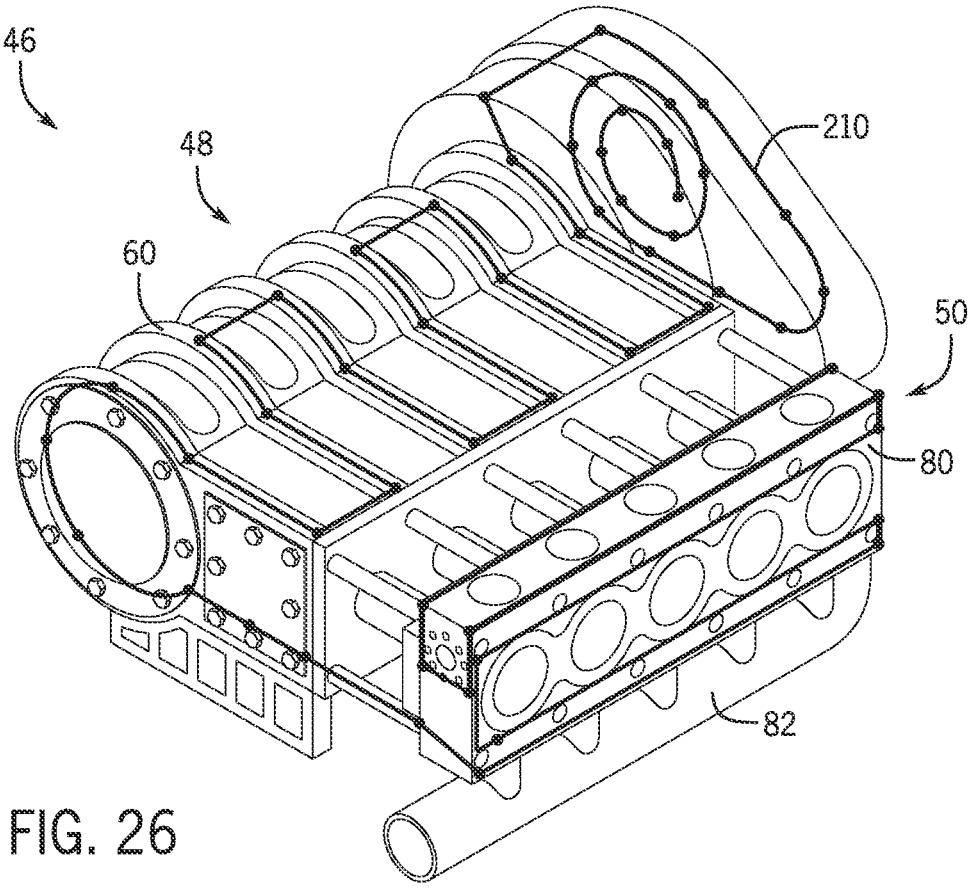
FIG. 26 depict locations of a pump at which parameters may be sensed with the measurement system of FIG. 25 in accordance with one embodiment.

In some cases, optical fiber is installed in a pump 46 (e.g., a fracturing pump) for distributed measurement of temperature, vibration, and strain via detected changes in backscattered light from within the optical fiber. As an example, a measurement system 204 is generally depicted in FIG. 25 as an optical fiber distributed sensing system having a laser 206 (or other source of optical energy) and optical fiber 208. The optical fiber 208 can include a portion 210 installed on or within a pump 46 and at least one reference coil 212. In one embodiment, the measurement system 204 can be an optical time domain reflectometry system in which a pulse of optical energy (e.g., from the laser 206) is emitted into the optical fiber 208 and backscattered optical energy is observed over time by an analyzer 214. The portion 210 of the optical fiber 208 may be positioned in any desired manner at the pump 46 to sense parameters (e.g., strain, vibration, or temperature) at locations along the portion 210. Examples of such locations are generally indicated in FIG. 26 as points along the portion 210 in a pump 46, but the portion 210 can be arranged in any desired manner to measure parameters at points of interest at the pump 46.

Lack of power end lubrication efficacy can result in premature wear of power end components, which can result in pump failure (e.g., failure that prevents the crankshaft from pushing the plunger and an inability to provide pressure and flowrate at the discharge manifold). When a component has proper lubrication, the lubrication oil has a specific temperature range which may result in other beneficial lubricating oil properties, such as viscosity. On the other hand, if lubrication is not distributed properly, a certain pump area will increase in temperature. Therefore, temperature changes at the pump 46 captured by optical fiber 208 give insight into how effective lubrication quality and distribution is in the pump and allow estimation of component wear and remaining useful life, such as described in greater detail below.

Vibration changes give insight into torque loads, equipment resonance, and component wear. For instance, roller bearing cracks and deformations lead to increased vibration and harmonics associated with the number of features arising in the bearing that is deformed. Increased vibration can be captured by optical fiber 208 mounted on the external surface of the bearing due to the radial motion of the bearing.

Fluid end monoblock and power end frame wear occurs in the form of temporary elastic and permanent plastic deformations caused by the pressure and flowrate stress inside of the chamber as well as due to pushing and pulling plunger motion from the power end. Deformations can eventually lead to fractures that cause the pump to stop. Strain captured by optical fiber 208 gives insight into plastic and elastic deformations leading to component wear.

Figure 27:
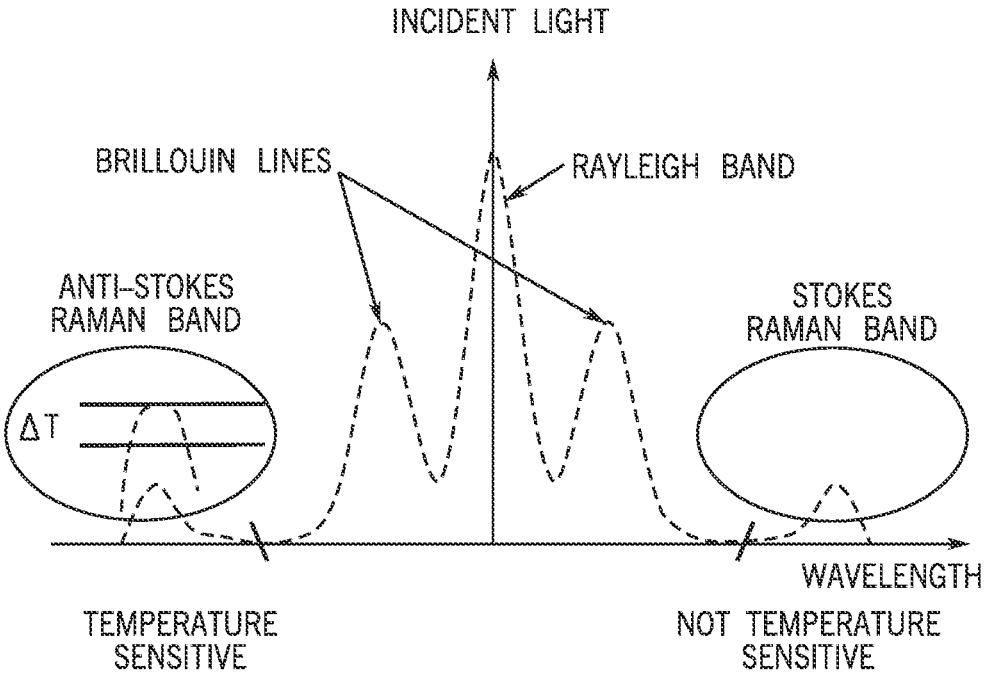
FIG. 27 is a backscattered light spectrum associated with the measurement system of FIG. 25 in accordance with one embodiment.
Figure 28:
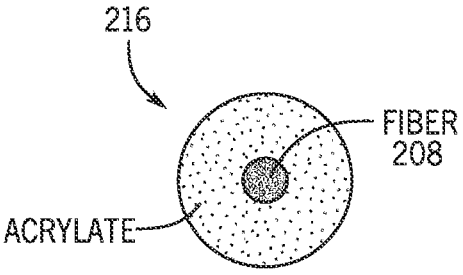
FIGS. 28-30 depict fiber optic cables that may be used by the measurement system of FIG. 25 in accordance with several embodiments.
Figure 29:
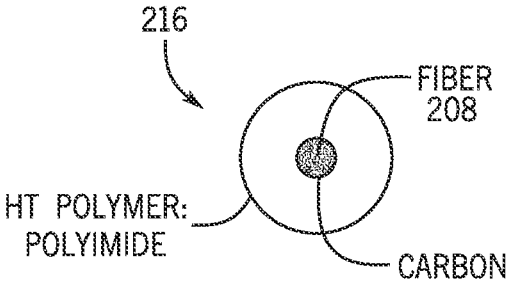
Figure 30:
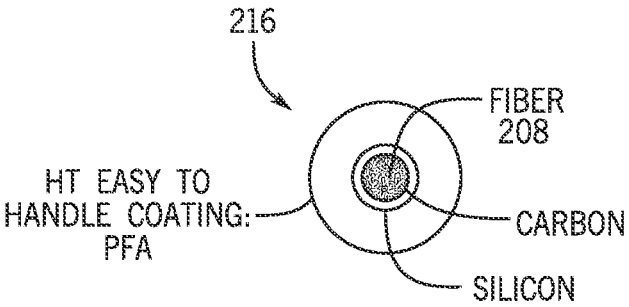

Fiber optics distributed temperature, vibration, and strain sensing may be used to provide a fuller picture of the parameter distribution across numerous areas in the pump 46 through a single fiber optic cable (e.g., a fiber optic cable with optical fiber 208) and acquisition point (e.g., at analyzer 214). In other instances, multiple fiber optic cables could be used. In at least some embodiments, the optical fiber measurement principle may be optical time domain reflectometry. Short laser pulses are launched into the fiber 208 and the returning (i.e., backscattered) light is optically filtered, digitally processed, and converted to a temperature reading. An example of a backscattered light spectrum is generally depicted in FIG. 27. Emission-to-sampling time is used to define position. Backscattered light intensity at a point gives temperature, vibration, and strain. Temperature, vibration, and strain sensitivity may be increased by considering relation between Stokes and Anti-Stokes Raman Scattered Light. The optical fiber 208 may be the core of a fiber optic cable 216, several examples of which are generally depicted in FIGS. 28-30. The fiber optic cable 216 can include the optical fiber 208 surrounded one or more additional materials (e.g., cladding or protective layers). In some instances, these additional materials include acylate, carbon, a high-temperature polymer (e.g., polyimide), silicon, or a polymer coating (e.g., a perfluoroalkoxy alkane coating).

Figure 31:
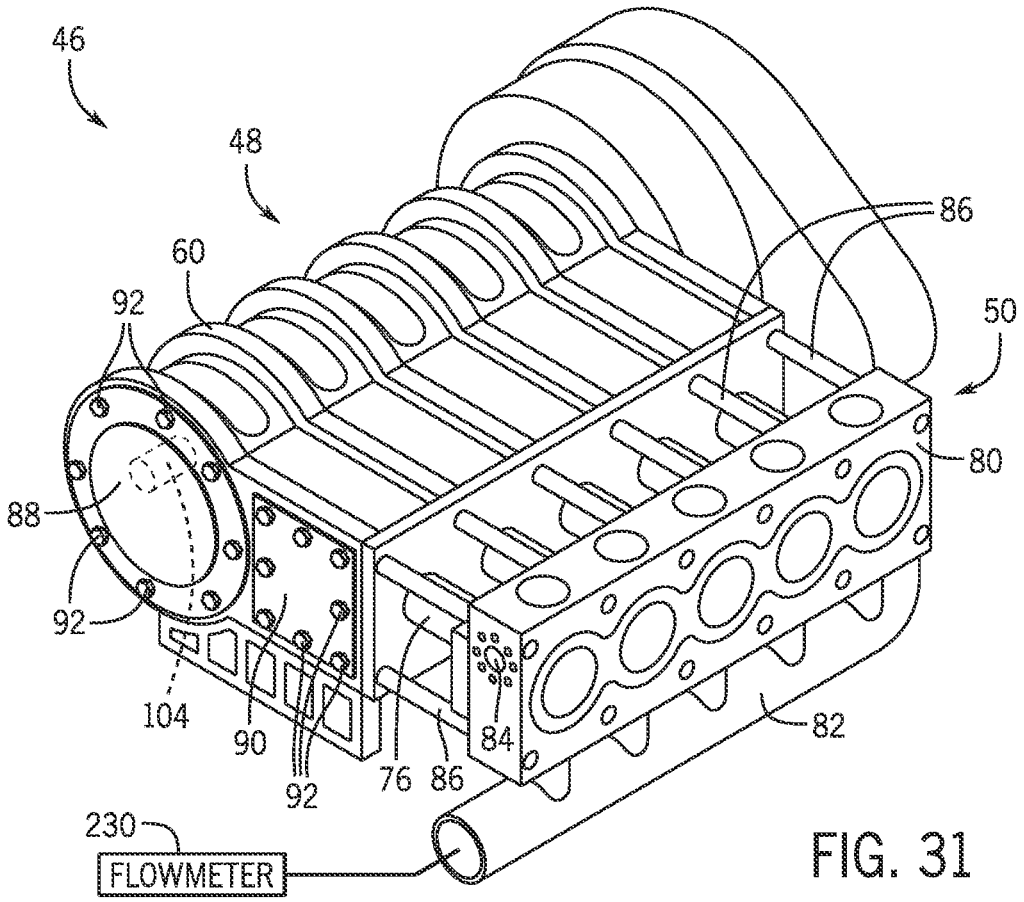
FIG. 31 depicts a flowmeter connected to a suction manifold of a quintuplex plunger pump in accordance with one embodiment.

As depicted in FIG. 31, a flowmeter 230 can be connected to the suction manifold 82 to sense flowrate of fluid flowing into the pump 46. In some instances, the flowmeter 230 is a high-frequency flowmeter, with AC or pulsed DC excitation at a frequency at or above 100 or 200 Hz (e.g., 500-1000 Hz). In one embodiment, the flowmeter 230 is a high-frequency, pulsed-DC-excitation flowmeter with an excitation frequency of 500-1000 Hz, such as an "IZMSG" electromagnetic flowmeter available from Anderson Instrument Company Inc. of Fultonville, New York.

The high-frequency flowmeter sensing principle may be based on Faraday's law of induction which states that when a conductor moves across a magnetic field, a voltage is induced across the conductor per the following equation:

$$U=K\times B\times V\times D$$

where: U=induced voltage
K=proportionality constant
B=magnetic field strength
V=average flow velocity
D=distance between the electrodes (flow tube diameter)

Figure 32:
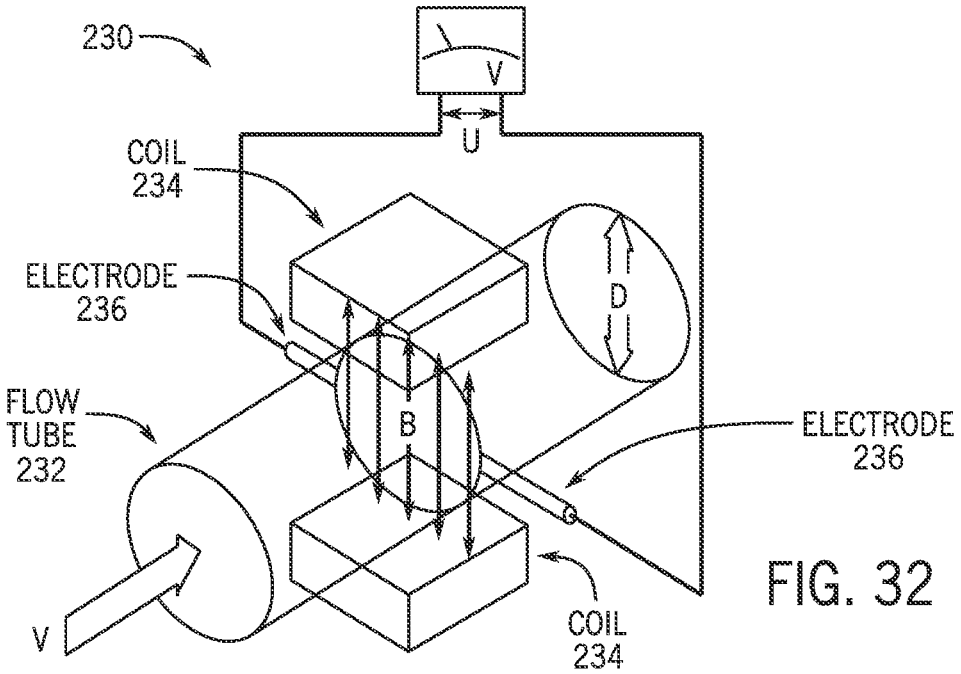
FIG. 32 depicts components of the flowmeter of FIG. 31 in accordance with one embodiment.

In the flowmeter example shown in FIG. 32, the suction fluid passing through a flow tube 232 acts as the conductor and a constant magnetic field is supplied (via excitation of coils 234) through a predefined probe distance (between sensing electrodes 236). The proportionality constant can be measured during calibration routines. With the proportionality constant, magnetic field strength, and distance between the electrodes known, the average flow velocity may be calculated as a function of the measured voltage and the flowrate can be calculated (as the product of the average flow velocity and a cross-sectional area of the flow tube diameter).

Figure 33:
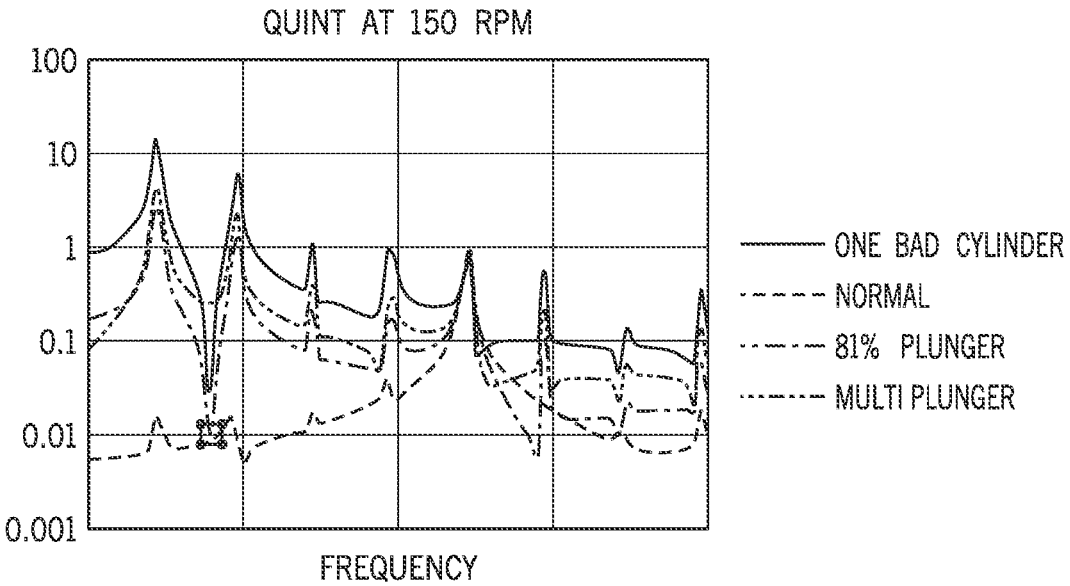
FIG. 33 is a graph of various flowrates and the associated plunger health level for a quintuplex pump in accordance with one embodiment.
Figure 34:
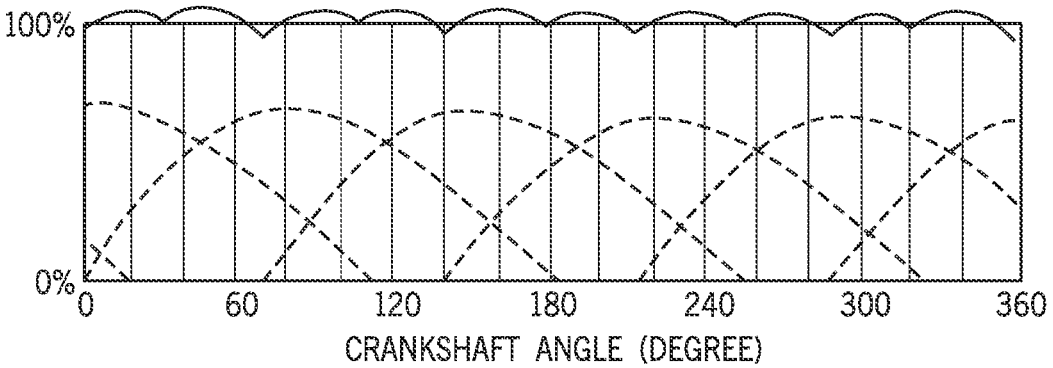
FIG. 34 is a graph depicting frequency pulses from each plunger in a quintuplex pump, along with a flowrate signature of the pump, in accordance with one embodiment.

High-frequency flowrate sensing allows capture of the flow changes due to each plunger movement and thus allows identification of a plunger having atypical flowrate characteristics suggesting health failures or operational inefficiencies. Various flowrates and the associated plunger health level for a quintuplex pump 46 are shown in FIG. 33 as an example. The frequency pulses from each of the five plungers in a quintuplex pump overlap in the discharge manifold and can form the flowrate signature (which can be acquired by high-frequency flowmeter 230) shown in FIG. 34 when plotted against the angle acquired from the crankshaft encoder 104. Different pressures and flowrate setpoints, different fluid compressibility, and different valve wear levels will cause an impact to the actual shape of the curve.

In one embodiment, the present technique enables precisely tracking the flowrate signature of each plunger over time and versus the angle of the crankshaft. A baseline level of flowrate characteristics is measured for each plunger. Over time, the deviation from the baseline level is calculated as a percentage which is considered as a wear value. Once the percentage of wear exceeds a configured threshold tested to be a safe for pump operation, the operator is alerted to request maintenance of a specific plunger assembly.

Figure 35:
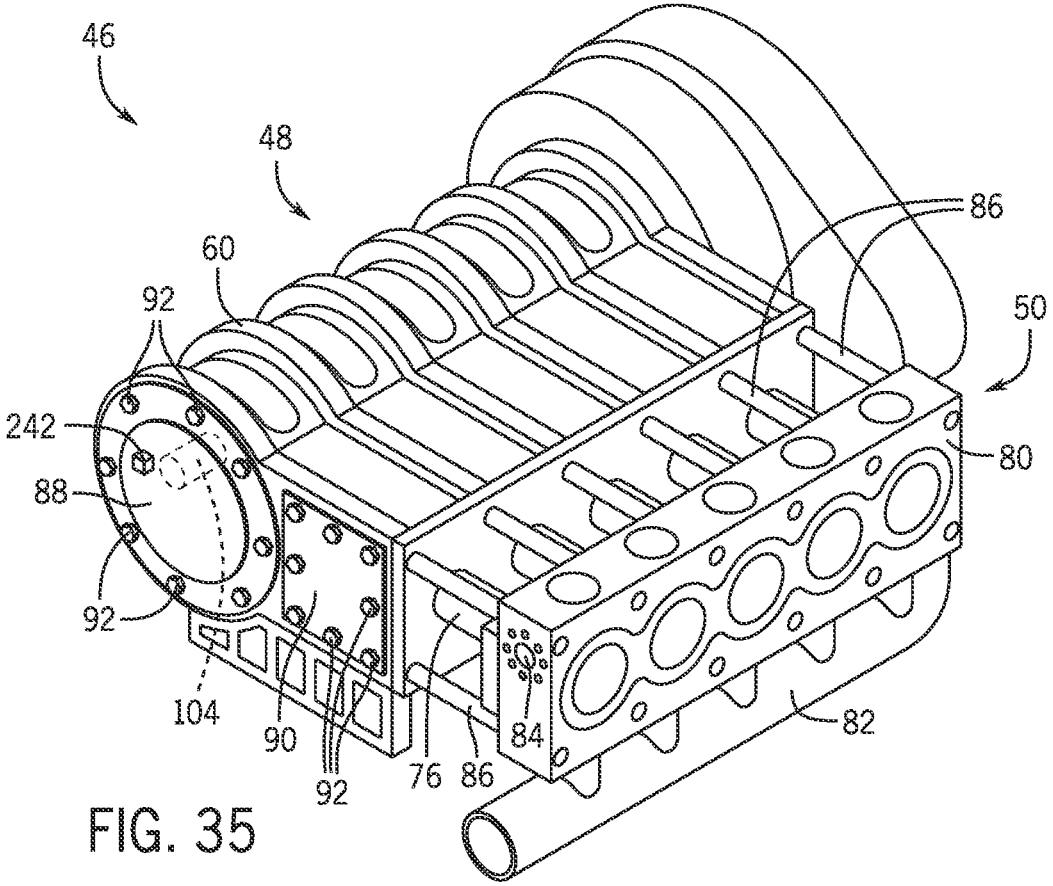
FIG. 35 depicts a quintuplex pump having an accelerometer and a crankshaft encoder in accordance with one embodiment.

In some instances, parameters of the pump 46 may be indirectly sensed based on signatures from a pump vibration signal. As shown in FIG. 35, in one embodiment the pump 46 is instrumented with an accelerometer 242 and a crankshaft encoder 104. The accelerometer 242, which may be a wireless accelerometer, can be mounted on the power-end side plate 88 or at any other suitable location of the pump 46. The accelerometer 242 may be a triaxial accelerometer that captures vibration, such as from the power end 48, the fluid end 50, or gearbox 120, in any direction (i.e., in three dimensions).

Rather than directly measuring certain parameters with other sensors, the vibration detected by the accelerometer 242 can be used to estimate the parameters. Examples of pump parameters that may be estimated from the vibration detected by the accelerometer 242 include crankshaft angle, crankshaft torque, toothed wheels angle difference, surface strain, axial thrust load, axial distance, torsional vibration, slurry discharge pressure, slurry suction pressure, power end lubrication pressure, power end lubrication flowrate, power end lubrication differential pressure, packing pressure, surface temperature, and magnetic suction flowrate. While these parameters could be measured directly through other techniques (including some discussed elsewhere herein), in some instances any (or all) of these parameters may also or instead be measured indirectly by estimating the parameters based on vibration detected by the accelerometer 242. For instance, depending on the level of confidence desired, any of these parameters could be estimated through the power end vibration signature to provide operational insight without an additional sensor for directly measuring the parameter.

Figure 36:
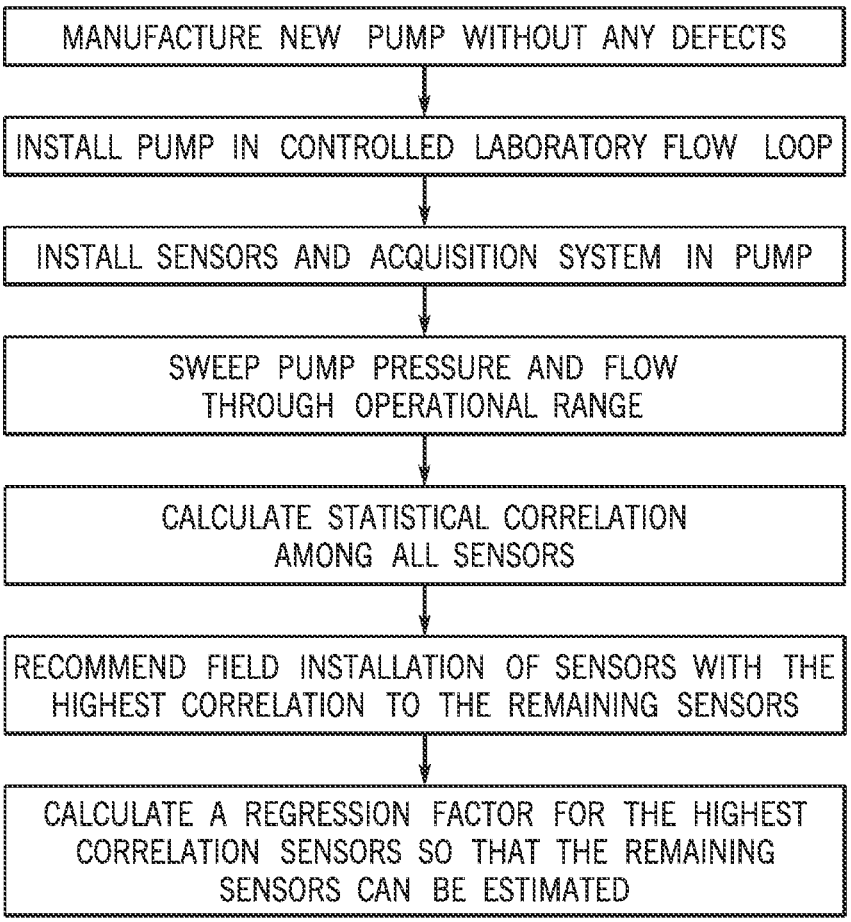
FIG. 36 is a flowchart representing a process for identifying pump parameters to be measured directly with sensors and facilitating estimation of other pump parameters indirectly in accordance with one embodiment.

As an example, a process for identifying pump parameters to be measured directly with sensors and facilitating estimation of other parameters indirectly (e.g., with the power end vibration signature from an accelerometer 242) is represented by the flowchart of FIG. 36. In order to have a robust estimation algorithm, data can be acquired for all the sensors in a test platform (e.g., a new pump 46 instrumented with a full complement of sensors, such as the numerous sensors described herein) during different operational conditions and the correlation may be found between the power end vibration sensor and the other sensors. In order to increase the sensitivity of the power end vibration signal to changes in the estimated parameters, features can be extracted from the signal. While any suitable features may be used, in one embodiment the following features are used from each axis: time domain vibration (as acquired from the power end vibration sensor), vibration frequency spectrum (due to fast Fourier transform of vibration signal), vibration cepstrum (due to inverse fast Fourier transform of the logarithm of the signal), and vibration bispectrum (due to Fourier transform of third order cumulant of the vibration signal). The features can be fed to a machine learning algorithm, which can then calculate the weights necessary for a neural network to transform the input power end vibration into the estimated parameters.

A mathematical model can be used to estimate the pump parameters as a function of the power end vibration signal. A neural network generative model may be chosen as the mathematical model to describe the dynamic of the systems. Different neural network topologies may be used, including recurrent neural networks, feed forward neural networks, convolutional neural networks, and mixtures of these types. Various hyper-parameters and design choices may be investigated, including learning rate, number of units, number of layers, amount of input data, amount of training epochs, and amount of regularization. In one embodiment, the simulation tool used is a program written in Python while making use of Keras library running on top of TensorFlow library, and a convolutional recurrent neural network with a topology of an input layer of 120 inputs may be used. The topology can be trained using Adam optimizer, and mean squared error loss.

Figure 37:
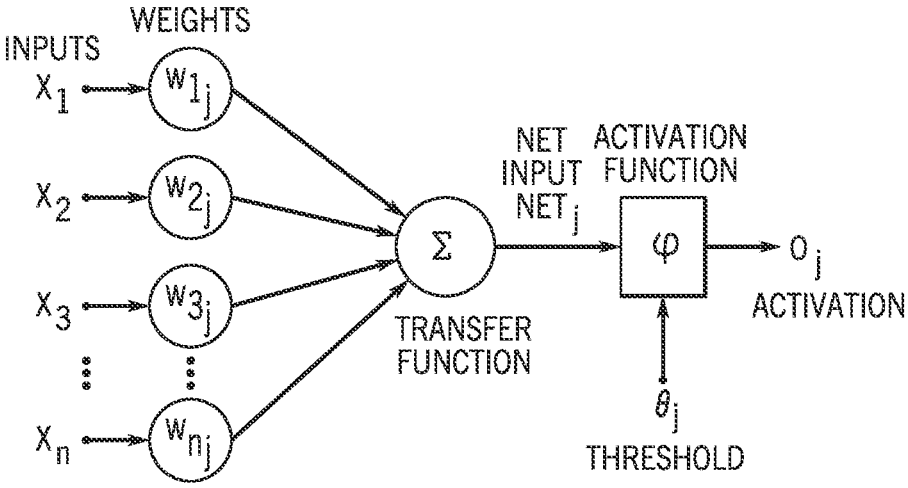
FIG. 37 is a neural network in accordance with one embodiment.
Figure 38:
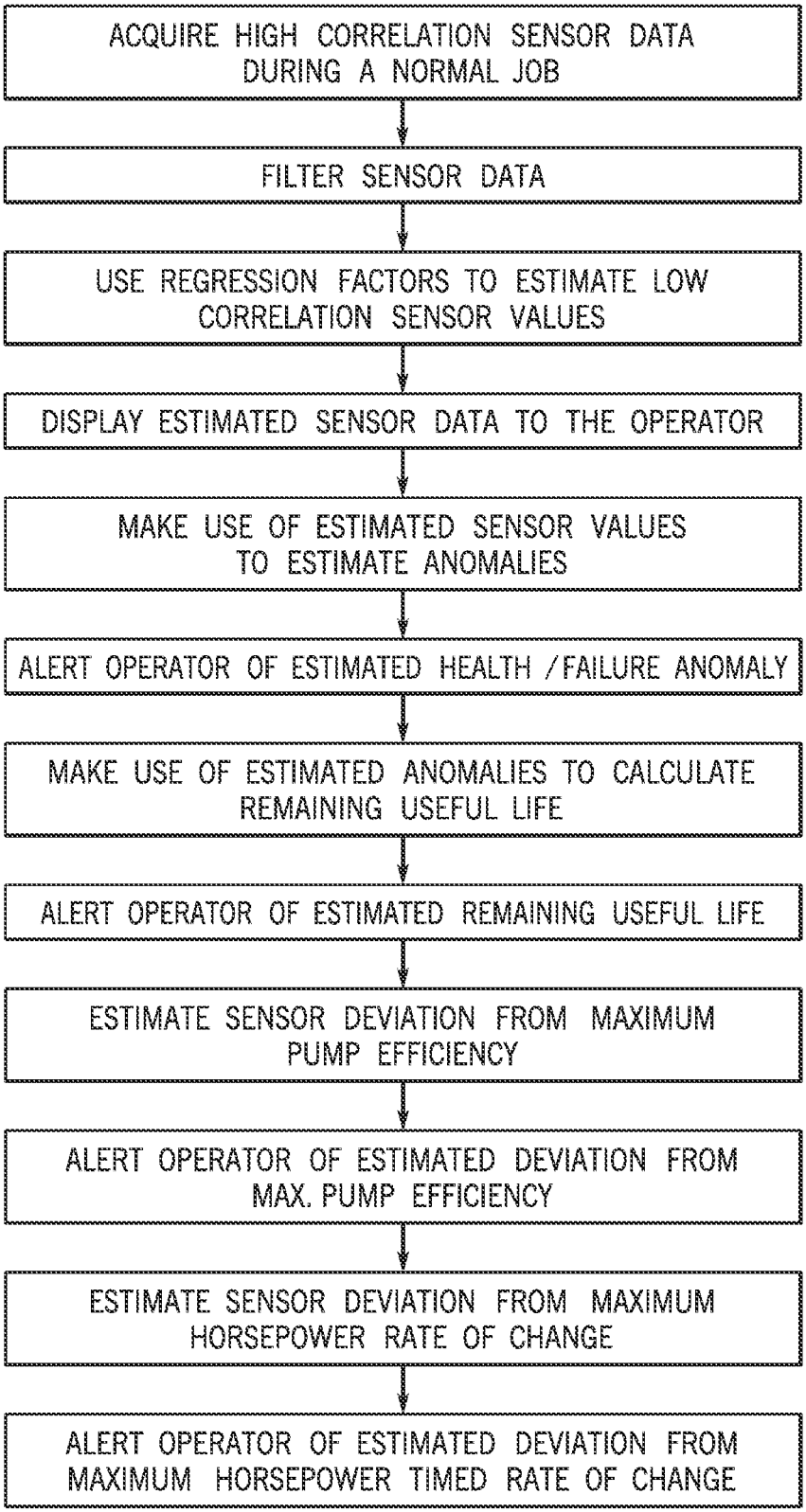
FIG. 38 is a flowchart representing a process for estimating pump parameters from power end vibration to facilitate operational decision-making in accordance with one embodiment.

A simple neural network is composed of inputs which are multiplied by weights and added a bias term which then is taken through a non-linear activation function, as illustrated in FIG. 37. In one embodiment, the input values to the neural network are the power end vibration (three-axis) sampled at 25,000 samples per second for different input windows to the past, and the model estimates the corresponding fracturing pump parameter as the output. In this example, the model transfer functions are weights and biases and they can translate the inputs of vibration signal axis to a corresponding output value of fracturing pump parameter. The neural network makes use of activation functions to capture the non-linear behavior of the system. The input parameters can be normalized between 0 to 1 while fed to the neural network and the output can be converted back to the original scale for plotting and analysis. As represented in FIG. 38, during pump operation (e.g., in the field at a wellsite), pump parameters can be measured indirectly (estimated) from the power end vibration and provided to an operator (along with any other pump parameters directly measured) to facilitate operational decision-making. The estimated values can be used for other purposes, such as to identify health or failure anomalies, estimate remaining useful life of pump components, and estimate sensor deviation from maximum pump efficiency and maximum horsepower timed rate of change, as described in greater detail below.

In some embodiments, sensors of the pump 46 may be used to determine pump component wear, monitor pump health, and provide early detection of potential failure. The sensor data may be interpreted by a real time system, which can provide alerts or other notifications to a user. In some cases, the system may also or instead automate a procedure to remedy a problem identified via the sensor data.

By way of example, in one embodiment the pump 46 includes a packing lubrication failure prevention system having a set of sensors located around the fluid end lubricating reservoir, packing, and plungers. These sensors can be used along with smart software diagnostics to mitigate packing failures. The lubrication system operation can be monitored with the use of pressure and level sensors. The pressure sensor can be positioned at the delivery point of the fluid end 50 to ensure proper fluid pressure. The level sensor can be used to measure the fluid level in the lubrication fluid reservoir. Smart software can receive the sensor data and interpret it with rules developed to discern a multitude of cases in which failure is impending. These rules can be based on previous failure experiences and capture the particular circumstances that led to a failure. The software can also have a set of alarms that warn the user of a possible failure scenario and suggest corrective actions to take.

Figure 39:
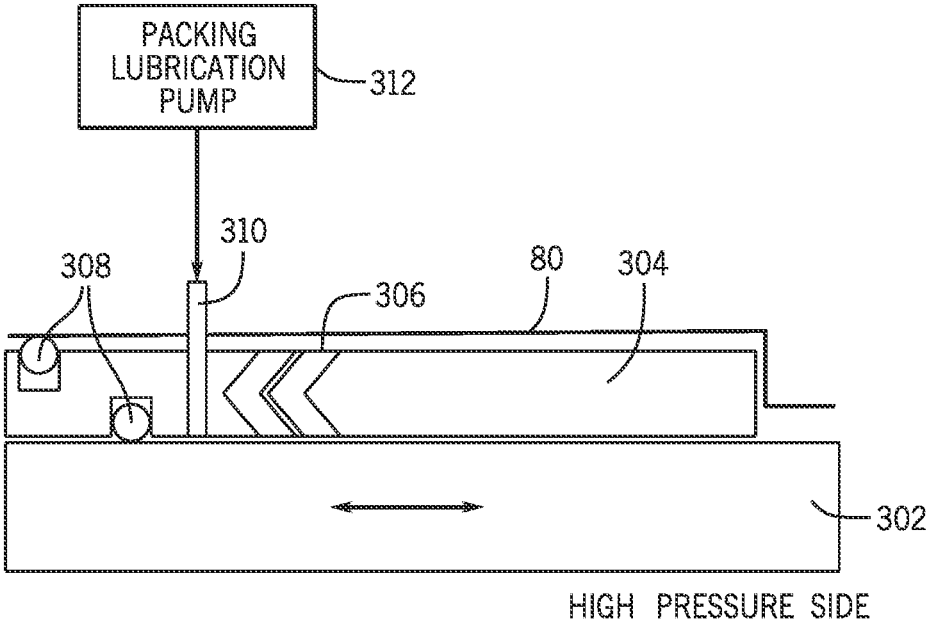
FIG. 39 depicts a fluid end pump plunger rod and packing sleeve in a fluid end main body of a pump in accordance with one embodiment.

An example of a fluid packing operation and lubrication action is generally depicted in FIG. 39 as having a fluid end pump plunger rod 302 and a packing sleeve 304 within a fluid end main body 80. Packings 306 are positioned in the sleeve 304, which includes seals 308 (e.g., O-rings). The lubrication system fluid can be pumped through access point 310.

The operation of the fluid is through the movement of the pump plunger rod 302 in a cyclical motion, moving back and forth as indicated in FIG. 39. This action creates friction between the rod 302 and the packing sleeve 304 which by lubricating these surfaces friction is reduced. The packing action is to isolate the high-pressure side of the fluid end from the low-pressure side and allow the pumping action to take place without discharging the fracturing slurry.

It may be desirable to disperse the lubricant fully along the sleeve so that the packings 306 become well lubricated and thus reduce wear due to the pumping action. The rod 302 moving back and forth can be used to draw the lubricant to the packings 306. The seals 308 prevent the loss of lubricant and lubricant pressure.

Figure 40:
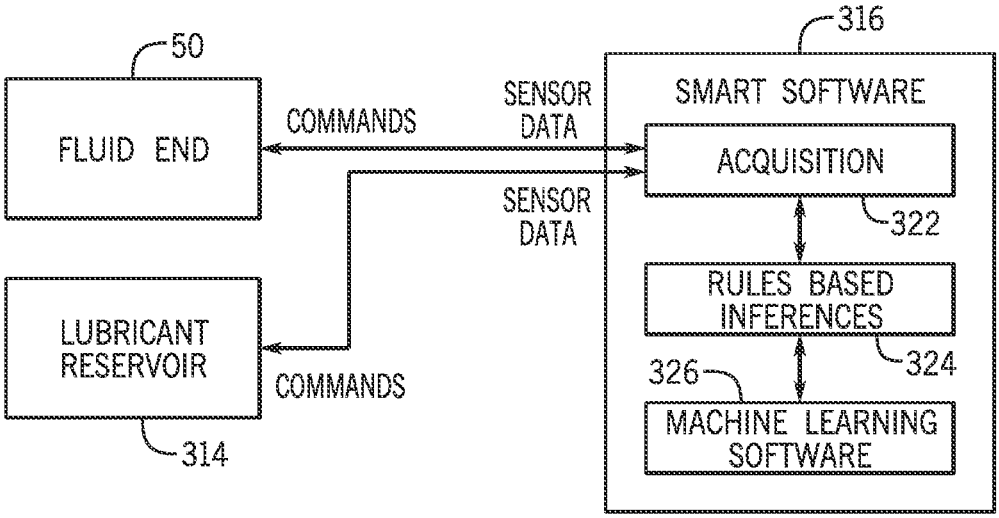
FIG. 40 depicts a lubricant reservoir for providing lubricant to the fluid end of FIG. 39, along with software for monitoring parameters and predicting failure, in accordance with one embodiment.

A lubricant reservoir 314 (FIG. 40) providing lubricant to the fluid end 50 can be monitored with level sensors and pressure sensors to determine if lubricant is present and if the delivery pressure to the fluid end 50 is adequate. This reservoir 314 can deliver the lubricant to the fluid end access point 310. The reservoir pump to fluid end 50 can have separate pumps (e.g., packing lubrication pump 312) for each cylinder. The pump can be driven by pneumatic or electric sources and can have stroke sensors on each pump. In at least some instances, the reservoir pump will maintain controlled flow at all times, including during the suction stroke.

The current to an electric source that drives the pump can be measured and monitored. If the amperage that is drawn is higher than a given threshold, it indicates high lubrication pressure and can send alarm to the software.

Delivery of the lubrication to the fluid packing 306 can be monitored with pressure and temperature sensors. A pressure sensor can be located on the low-pressure access point 310. If failure is imminent, this sensor may capture the pressure of the wellhead (i.e., a severe increase from expected pressure). The pressure delivered can be closely monitored to determine if it is sufficient to reach the packings 306. This pressure value can be recorded and interpreted by the smart software 316 (FIG. 40) and used to "learn" pressure levels that lead to failures.

A temperature sensor can be located near the packing 306 to measure its temperature and determine if it is operating in nominal conditions. If the temperature rises to a predetermined level (e.g., given from manufacturer) then failure can be predicted by the smart software 316. The temperature of the packings 306 can be correlated with the temperature of the oil reservoir to determine the difference. The temperature sensors can be placed on the top and bottom of the fluid end 50 to measure temperature from both.

In case of lubricant loss, the lubricant reservoir level sensor can detect a drop in fluid level. Based on the detected fluid level drop, the smart software 316 can send appropriate alarms to system users and may increase strokes to keep correct pressure at the fluid end access point 310. This action may reduce the amount of lubricating fluid to preserve the integrity of the packings 306. The increase in temperature may also increase circulation of lubricant around the packings 306.

The plunger rod 302 can also have a temperature sensor to measure increase in temperature and provide an alternative to the temperature sensor located near the packing 306. Another sensor can be a stroke sensor to determine the number of strokes between failures and feed the smart software 316 with this information to enable the "learning" process. Strokes can also be used to determine when the lubricant needs to be replaced to maintain its quality.

An acoustic sensor can be placed along the sleeve 304 to detect anomalies between it and the plunger rod 302. If there is excessive friction between these two components, the acoustic sensor may detect the departure from a baseline of nominal operation. The smart software 316 can read the acoustic sensor data and detect any degradation over time to determine safe operation thresholds. The acoustic sensor may also be used to detect a leak in the packing assembly.

Lubrication fluid leaks may be detected with infra-red (IR) sensing or video imaging. This information can be sent to the smart software 316 to automatically interpret the status of the leaks.

The images captured (e.g., by an appropriate IR or video imaging sensor) can be compared to images that do not have leaks and that are stored in the smart software 316. Differences can be interpreted as potential leaks. Subsequent monitoring may confirm if there is a leak by comparing images and looking for growth in the footprint or temperature changes.

Fiber optic string may be embodied in grooves that are cut in the fluid end body 80 or along the lubrication path. The fiber optic string can collect information by measuring an optical property and transmit the data for analysis to the smart software 316. High-speed fiber optic measurements can provide temperature variation at different positions of the fluid end body 80 that may indicate high friction due to misalignment of the plungers and the pistons.

The smart software 316 can run on a processor-based device (e.g., a personal computer or programmed logic controller) that is connected (e.g., via Ethernet link or an industrial communication bus) to the fluid end 50 and the lubricant reservoir 314. The smart software 316 can read sensor data from fluid end and lubrication reservoir sensors (such as those described above) and send commands to a motor driving the fluid end 50 and to the lubricating pump system. The sensor data may be captured by an acquisition component 322. The data may be sampled at any suitable rates, and those rates may differ for various sensors. In one embodiment, for example, the acquisition component 322 acquires data at 1 Hz for some sensors but at a greater rate (e.g., several kHz) for other sensors (e.g., accelerometer and acoustic sensor). These data may be stored in a memory device (e.g., a flash memory, a hard disk drive, or a solid-state drive) of the smart software host computer for later analysis.

The smart software 316 can have a rules-based inference engine 324 in which the data from the sensors can be matched to rules that are already predefined in the software 316 to match for known conditions that these sensors will be measuring. Once these conditions are matched or are close to being matched, the software can trigger a set of commands that will be sent back to the fluid end 80 or the lubricant reservoir 314 to address the conditions found and avert packing failure.

Machine learning software 326 can be used to capture the sensor data and commands issued to determine new failure modes. Failures not detected by the system will be flagged so that the learning software 326 can analyze the captured data and determine the inputs pertaining to the failure so it can detect the failure in the future and create the proper response. In this way, new failure mode rules can be created and used in the rules-based engine 324.

In some instances, loads and bearing health in a pump 46 (e.g., a fracturing pump) can be measured to facilitate monitoring of, and in some cases improving, pump operation. Three measurements of rod load (or connecting rod load) are proposed: hoop strain in the bearing carriers, fluid film thickness, and connecting rod strain.

Figure 41:
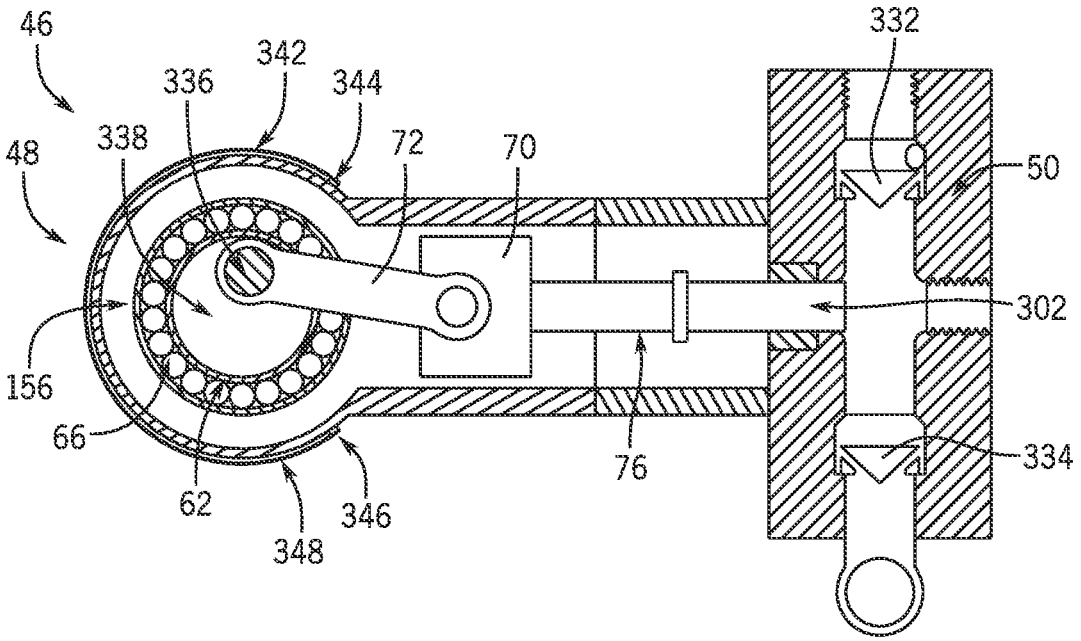
FIG. 41 is a cross-section of a frac pump showing discharge and suction valves of the fluid end in accordance with one embodiment.

In FIG. 41, a frac pump cross section is shown, with the fluid end 50 having valves 332 and 334 (discharge and suction valves). Plunger 302 is moved in and out of the fluid end 50 by pony rod 76, driven by crosshead 70. Connecting rod 72 couples the crank throw 336 to the crosshead 70. The crank throw 336 is on crankshaft disc 338, each of which are part of crankshaft 62. Disc 338 is supported by bearing 66 and bearing carrier 156. Load on plunger 302 is carried by varying tensile loads in bearing carrier 156. A strain sensing means (here shown as a metallic strip 342) is coupled to the bearing carrier 156 at two locations 344 and 346. A strain sensing means is positioned at location 348. While a strip 342 is shown, other means could be used. Whether a strip 342 or some other stain sensing device is used, in at least some embodiments the device spans a significant distance about the bearing carrier 156 to magnify motion and simplify measurement, and any additional non-sensing length has a coefficient of thermal expansion matching the bearing carrier material.

Figure 42:
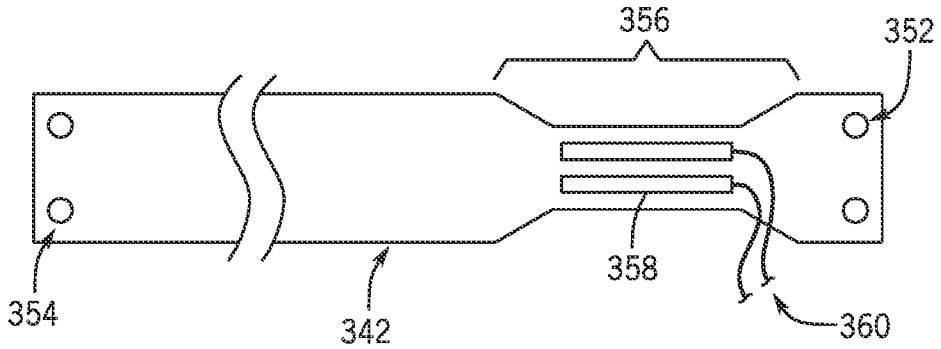
FIG. 42 depicts a metallic strip for sensing strain on the pump of FIG. 41 in accordance with one embodiment.

In FIG. 42, the strip 342 is shown with attachment ends 352 and 354. A sensing section 356 is shown with a reduced cross section to concentrate strain into this section. A strain gauge (or other sensing means) 358 is located on this section 356 and provided with a signal output means, such as a cable or wires 360. The strip 342 may be attached in any suitable manner, such as welding or gluing. By sensing the six bearing carrier stresses/strains, the rod loading may be measured on a continuous basis. Changes in rod loading are the result of changes in operation of the pump 46. While output pressure may change all of the rod loads in the same amount, cavitation may change the whole pump or just a few cylinders. A leaking valve will alter the loads on a few bearings.

Figure 43:
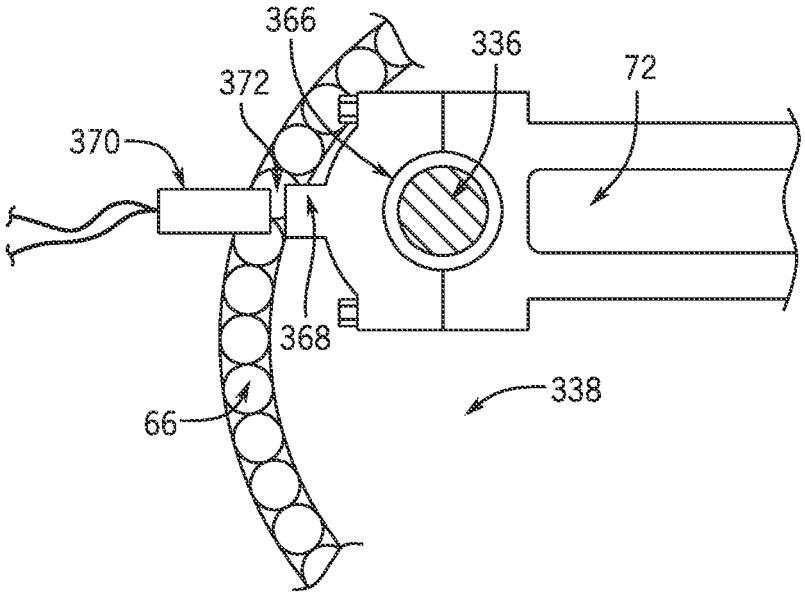
FIG. 43 depicts a proximity sensor and a connecting rod of a pump in accordance with one embodiment.

In FIG. 43, a connecting rod 72 is shown on a crank throw 336. Oil film 366 couples the two together. The connecting rod 72 is provided with a target 368 which approaches a proximity sensor 370, leaving gap 372 to be measured. Bearing 66 supports the crank disc 338. As the load on the oil film 366 and bearing 66 vary, the connecting rod 72 moves relative to the sensor 370. At each pass, the minimum gap 372 may be measured to evaluate a combination of the oil film and the bearing load. It will be appreciated that this technique does not require rotating sensors.

Figure 44:
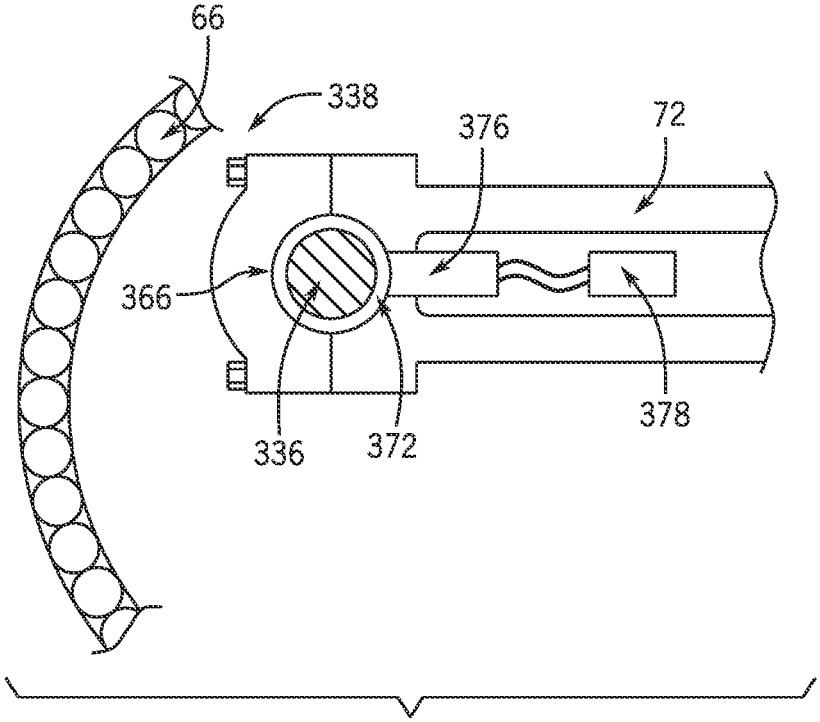
FIG. 44 depicts a connecting rod with a sensor for measuring an oil film between the connecting rod and a crank throw in accordance with one embodiment.

In FIG. 44, a connecting rod 72 is provided with a sensor 376 sensing the oil film 366 between the connecting rod 72 and the crank throw 336. A data acquisition device 378 takes the measurement of the oil film thickness (via shaft motion) and transmits it to a stationary device for further action. The data acquisition device 378 may perform processing and storage steps on the film data to reduce communication demands.

Figure 45:
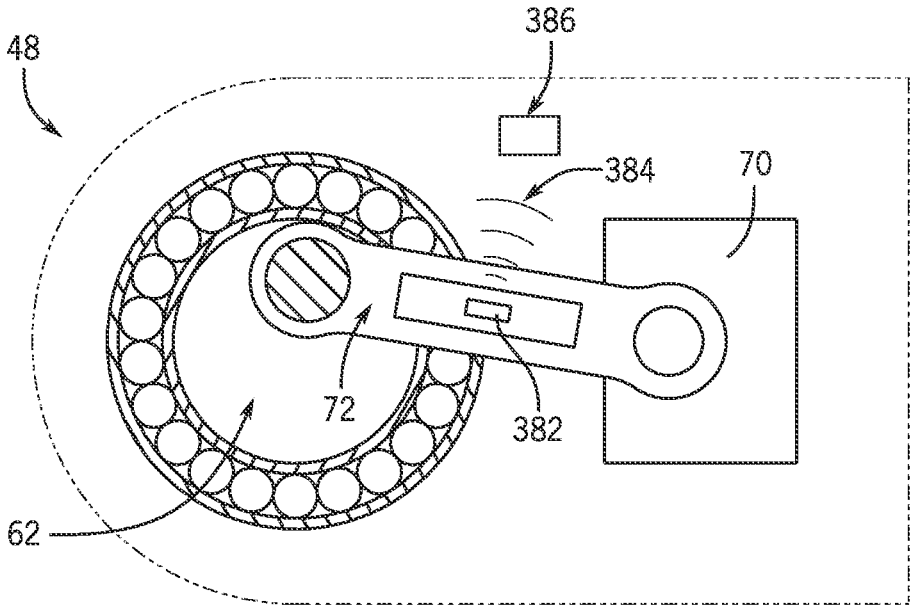
FIG. 45 depicts a connecting rod fitted with a strain gauge in accordance with one embodiment.

In FIG. 45, the connecting rod 72 is fitted with a strain gauge 382 to directly measure the load passing through the connecting rod 72. Wireless communication from the strain gauge 382 (or other acquisition device) mounted on the connecting rod 72 is shown as wave 384 to a stationary sensing system 386.

Figure 46:
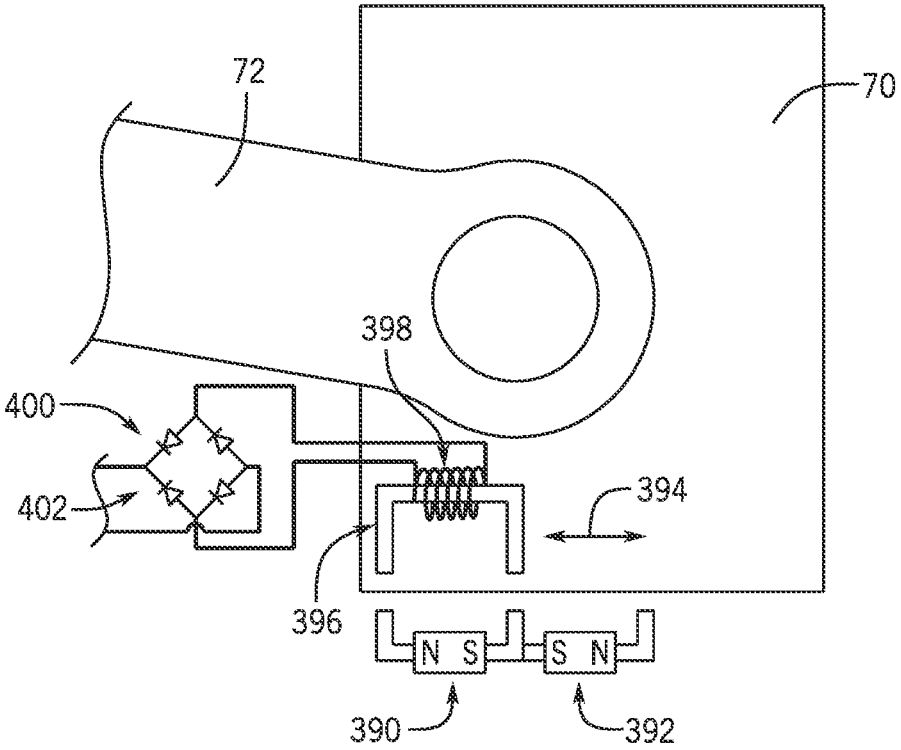
FIG. 46 shows a pump arrangement in which non-moving magnetic sources power a moving sensor, such as the strain gauge of FIG. 45, in accordance with one embodiment.

FIG. 46 shows a means of powering a moving sensor (e.g., strain gauge 382) using non-moving magnetic sources 390 and 392. Crosshead or connecting rod motion 394 moves a generating means (e.g., magnetic material 396 and coil 398) past the magnetic sources 390 and 392. Voltage is rectified by rectifier 400 and feeds the moving data acquisition system (e.g., strain gauge 382 or other sensor) via leads 402. Many other configurations are possible where there is relative motion between a magnet and a generating means, with the magnetic field in the generating means being caused to vary. Alternatively, the generating means may incorporate a magnet and the motion varies the reluctance of the system, thus varying the magnetic field through a coil of wire. A time-varying magnetic field may also be used to couple power to the moving parts without the need for permanent magnets. Further, power may be transmitted wirelessly to the moving part using one or more of electromagnetic fields, magnetic fields, or acoustic fields.

In accordance with some embodiments, loads, bearing health, and fluid end health in a in a pump 46 (e.g., a fracturing pump) are directly measured for monitoring, and in some cases improving, pump operation. Two measurements of rod load (or connecting rod load) are proposed: hoop strain in the bearing carriers and stay rod strain/load.

Figure 47:
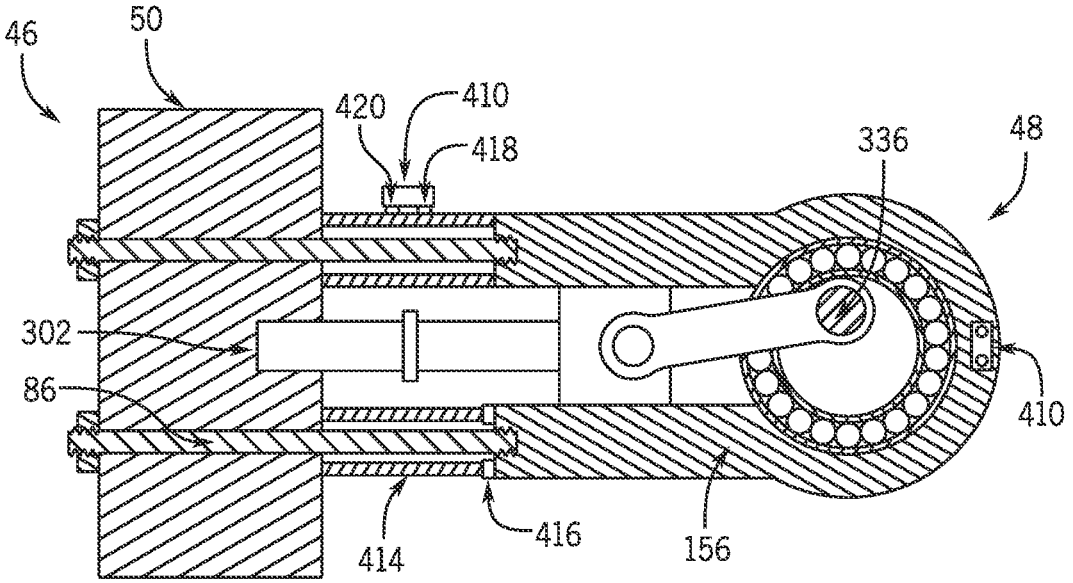
FIG. 47 is a cross-section of a pump outfitted with strain sensors and an in-line load cell in accordance with one embodiment.

In FIG. 47, a cross-section of pump 46 (e.g., a frac pump) is shown with fluid end 50. Plunger 302 is moved in and out of the fluid end 50 by an assembly driven by the crank throw 336. Load on plunger 302 is carried by varying tensile loads in bearing carrier 156. A strain sensing means (here shown as sensor 410) is coupled to the bearing carrier 156. While the sensor 410 is shown placed on the bearing carrier 156 in line with the plunger 302 and oriented to measure hoop strain, other positions and orientations on the bearing carrier 156 may be used. The strain sensor 410 may be piezoelectric, piezoresistive, a thin-film strain gauge, or any other strain sensing device, AC or DC. AC sensors, measuring only change in strain, may still be capable of producing a useful measurement. The sensor 410 can be attached in any suitable manner, such as by welding or gluing to the bearing carrier 156. By sensing the six bearing carrier stresses/strains, the rod loading may be measured on a continuous basis. Changes in rod loading are the result of changes in operation of the pump. While output pressure may change all of the rod loads in the same amount, cavitation may change the whole pump or just a few cylinders. A leaking valve can alter the loads on a few bearings.

Figure 48:
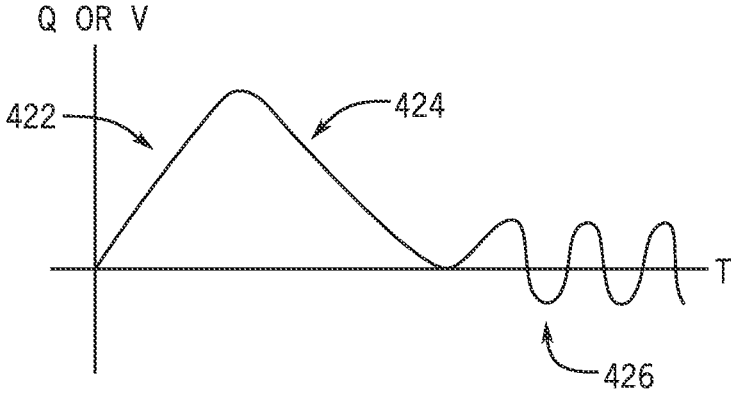
FIG. 48 depicts a measured response produced by a strain sensor of FIG. 47 in accordance with one embodiment.

In another aspect, rod load can be measured by measuring compressive load on the compression cylinders 414 of the two-piece stay rods 86 with an in-line load cell 416. As an alternative, rod load can be measured by placing a strain measuring device 410 on selected or all compression bearing cylinders 414 that make up the two-piece stay rod assemblies that connect the fluid end 50 to the power end 48. In this example, the strain sensing device 410 can be attached with glue at two locations (e.g., locations 418 and 420) or can be a different device attached by welding or by screws as the cylinder is in compression. In this case, an AC strain sensor can produce a measured response as shown in FIG. 48, which shows tightening of the stay rods (ramp 422) followed by a return to zero (ramp 424), driven by the time constant of the device. After this, continuous pumping will produce measurement oscillations (area 426), which will display discrete characteristics. Deviation from "normal" can be detected.

In other embodiments, direct measurements of rod load (or connecting rod load) can be made by mounting strain sensing devices on the rods themselves. Because the rods move relative to the power end 48 and the fluid end 50, any cable run to the sensor may be provided as a fatigue resistant connection.

Figure 49:
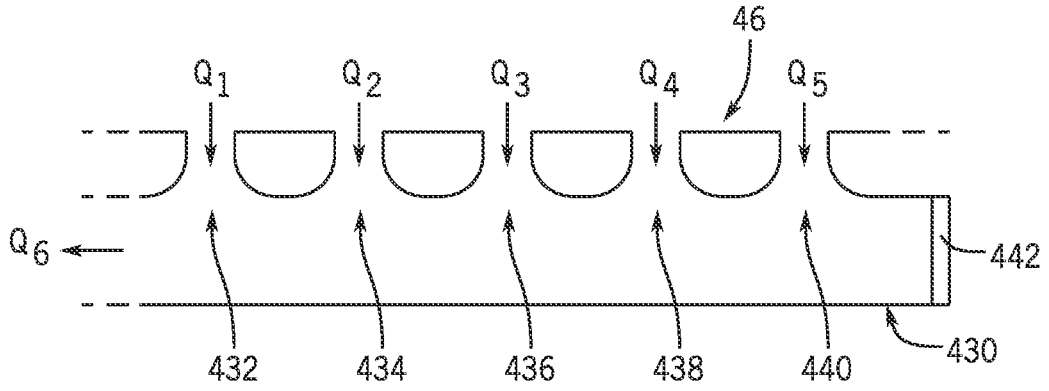
FIG. 49 depicts a drain manifold that receives oil draining from plunger sections of a quintuplex pump in accordance with one embodiment.
Figure 50:
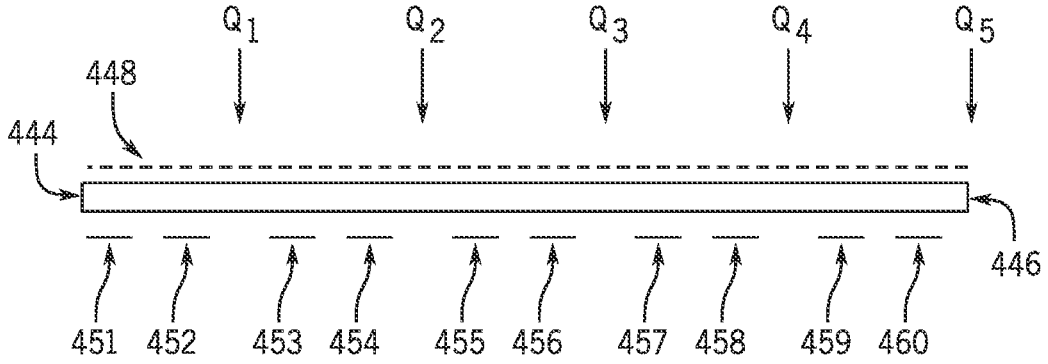
FIG. 50 depicts an elongate sensor that can be positioned in the drain manifold of FIG. 49 to be exposed to oil drain flows in accordance with one embodiment.

In some embodiments, a system detects the production of magnetic and non-magnetic particles generated in a pump 46 (e.g., a frac pump) and resolves which plunger section is responsible for the produced particles. A sensor can be provided in a drain manifold of the pump 46. Separate regions of the sensor are exposed to oil draining from separate plunger sections in the pump 46 and evaluate the flow. In FIG. 49, for instance, oil drain flows $Q_1$-$Q_5$ drain from the pump 46 into drain manifold 430. Regions 432, 434, 436, 438, and 440 are exposed to oil having content related to different pump sections. Total flow $Q_6$ leaves the manifold. An access cap 442 may be provided on the drain manifold 430. As depicted in FIG. 50, an elongate sensor 444 can include a sensor body 446 with mesh or other material 448 to produce trapping areas on the sensor 444. The sensor 444 can include sensing regions 451-460 and be positioned in the drain manifold 430 to be exposed to oil drain flows $Q_1$-$Q_5$. If positioned as generally depicted in FIG. 50, sensing regions 451 and 452 may be more sensitive to flow $Q_1$, sensing regions 453 and 454 may be more sensitive to flow $Q_2$, sensing regions 455 and 456 may be more sensitive to flow $Q_3$, sensing regions 457 and 458 may be more sensitive to flow $Q_4$, and sensing regions 459 and 460 may be more sensitive to flow $Q_5$.

Figure 51:
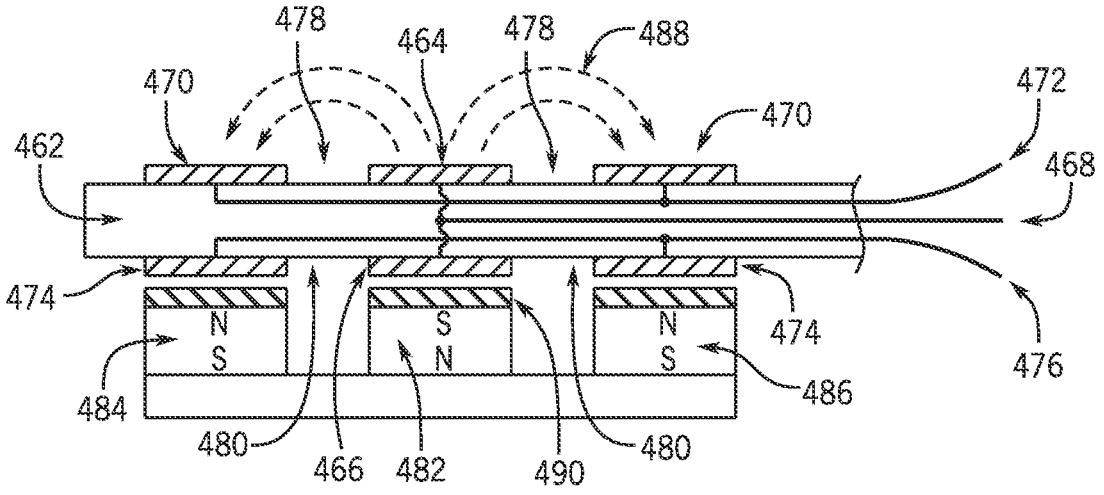
FIGS. 51 and 52 show sensors that may be used to measure particles generated in the pump in accordance with certain embodiments.

One type of sensor that may be deployed is shown in FIG. 51 as having a substrate 462 (such as a printed circuit board) with conductive regions. Said regions may be interdigitated to increase the gap length. A central conductive region 464 may be connected to central bottom region 466 and wired out to bus 468. Left and right top regions 470 are wired to bus 472. Left and right bottom regions 474 are protected from particles but exposed to oil and connected to bus 476. Top gaps 478 are exposed to oil and particles. Bottom gaps 480 are only exposed to oil. Magnets 482, 484, and 486 are used to produce magnetic fields 488 passing between the central and outer regions. Non-magnetic and non-conductive material sheets 490 are used to reduce the capacitance between the bottom regions 466 and 474 and the magnets.

The resistance may be measured between the top regions 464 and 470 to identify particle accumulation. A differential capacitance measurement comparing the top regions exposed to particles and the bottom regions isolated from particles may be used to measure quantitatively particle accumulation. Such a method may be more sensitive to low quantities of particles.

Figure 52:
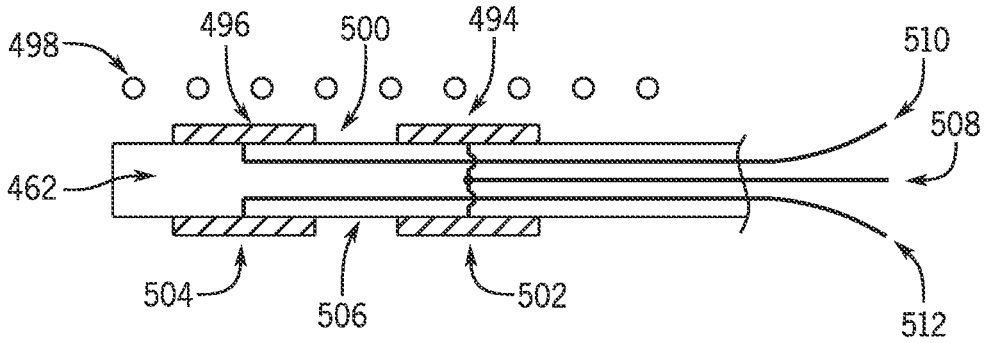

FIG. 52 shows a system to measure non-magnetic particles in accordance with one embodiment. A substrate 462 carries interdigitated electrodes 494 and 496. A trapping material 498 produces areas of low flow velocity to assist particle accumulation in top gap 500. Bottom electrodes 502 and 504, along with bottom gap 506 are exposed to oil but not to the particles. Electrodes 494 and 502 can be connected to bus 508, electrode 496 can be connected to bus 510, and electrode 504 can be connected to bus 512. The capacitance between buses 508 and 510 can be compared the capacitance between buses 508 and 512. As the top capacitance drops relative to bottom, this indicates accumulation of particles. Electrical conductivity between buses 508 and 510 (i.e., between electrodes 494 and 496 across top gap 500) would indicate very significant non-magnetic contamination.

Figure 53:
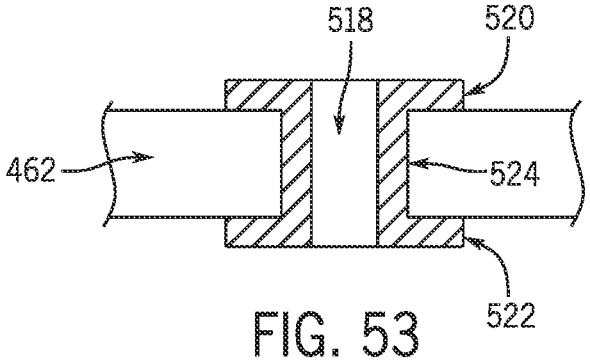
FIG. 53 depicts a plated through hole in a substrate of a sensor of FIG. 51 or 52 in accordance with one embodiment.
Figure 54:
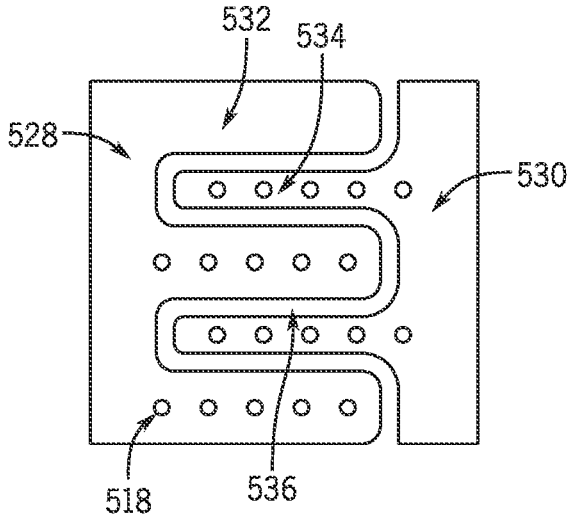
FIG. 54 depicts interdigitated conductive sensor regions with plated through holes in accordance with one embodiment

As shown in FIG. 53, plated through holes 518 in substrate 462 may be used to connect regions 520 and 522 with via 524. Such structures may be used to improve particle capture. FIG. 54 shows conductive regions 528 and 530 provided with digits 532 and 534 to increase the gap area 536. Plated through holes 518 may be used to allow connecting patterns on the top and bottom.

Figure 55:
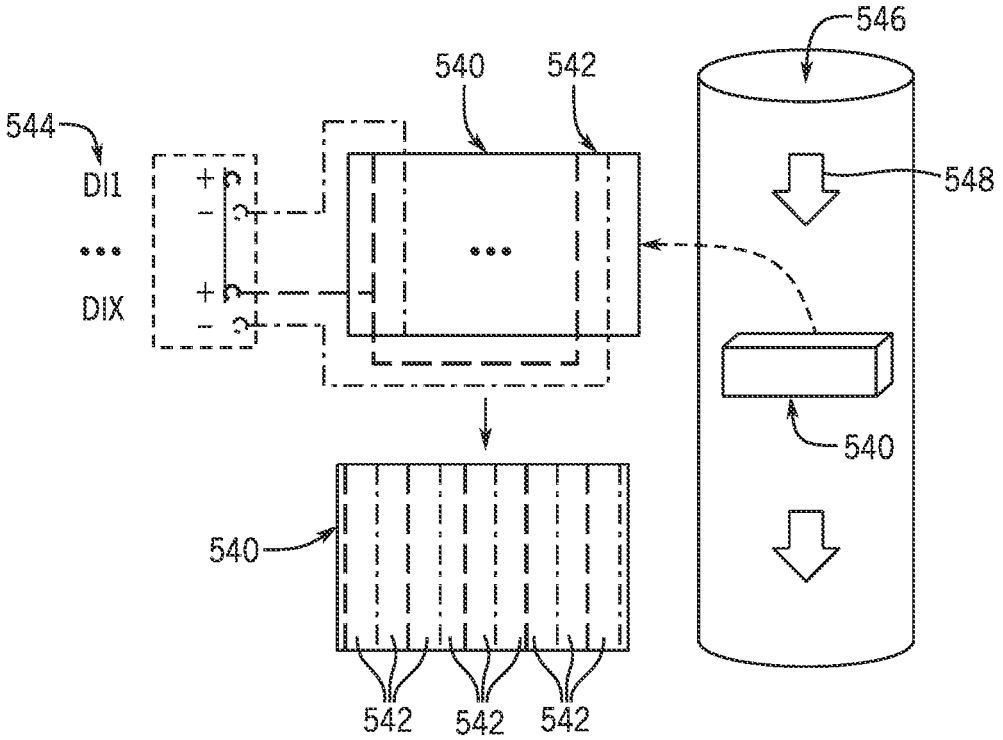
FIG. 55 shows a conductive pattern of a particle sensor in accordance with one embodiment.

FIG. 55 shows a conductive pattern 540 designed such that a single particle can only cause conductivity in one section 542 of the pattern, and the pattern is composed of multiple sections 542 to achieve a measurement such as the number of digital inputs 544 acquired with a high voltage are proportional to the amount of particles that have accumulated. Resistive measurements of this kind may result in a lower cost sensor when compared to capacitive or inductive measurements, but at low voltage the particle density needed for detection is very high due to the need for a complete conductive path. Utilizing high voltage (where the breakdown voltage of the clean gap is higher or comparable to the voltage used) means that the gap between conductive particles can be bridged by arcing, and makes the sensor detect even single particles in one embodiment. One way to apply such a sensing method is to use a low-constant-current, high-voltage supply. The supply can be turned on and the output voltage measured. If the gap is clean, the voltage will be either the limiting voltage of the supply, or the gap breakdown voltage. If the gap is dirty, partial or full breakdown will occur (with energy limiting) and the voltage will be lower. In such an application, the substrate may be chosen for minimum to no tracking potential, such as the Teflon based circuit board material used for some high frequency circuits.

Further, the circuitry for this process can be installed on the same substrate as the sensing gap, but with either a housing placed around that area, or a conformal coating may be applied. Switching elements may be used to select multiple sensing areas using a common supply. A reference gap may be provided that is protected from particles but exposed to oil to provide a specimen on uncontaminated gap breakdown. Further, the pattern may be provided with a designed-in breakdown area (protected from particles but exposed to oil) that limits the overall breakdown voltage of the pattern and controls where the breakdown occurs. Such an area may be provided with a hole in the circuit board such that breakdown does not occur on the surface but happens in the oil itself to minimize the possibility of deposition of breakdown products or tracking.

By placing the sensor in a cylindrical housing 546 such that the flow 548 is perpendicular to the conductive pattern 540, the sensor can receive particles without using a magnetic piece to attract such particles. This may make the sensor more reliable, as magnets lose strength over time and under high temperatures.

Figure 56:
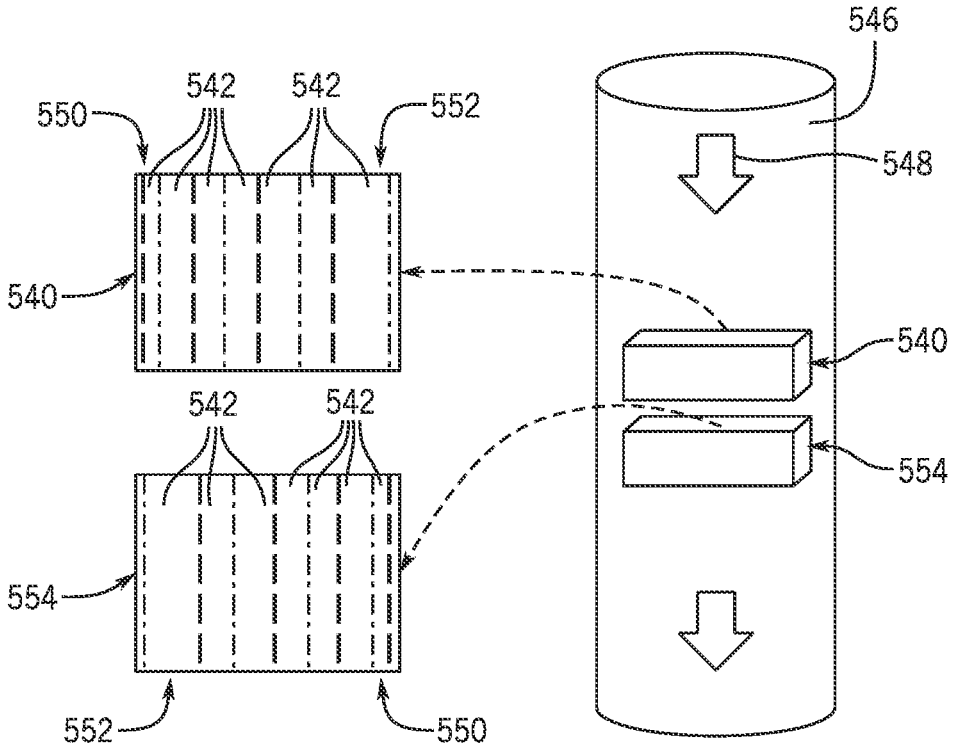
FIG. 56 shows conductive patterns for sensing particles in accordance with one embodiment.

FIG. 56 shows a similar mechanism from FIG. 55 but with the pattern 540 designed such that the conductive sections 542 start with a small gap 550 and progressively increase to a large gap 552. An additional conductive pattern 554 with an opposite gap spacing (shown in FIG. 56 with a large gap 552 on the left progressively decreasing to a small gap 550) can be placed after the first conductive pattern 540. This allows measurement of the size of the particle by virtue of comparing the digital input 544 which returns a high voltage to the gap size of the pattern connected to that digital input. The opposite patterns 540 and 554 in series allow for small particles which may pass through the large gap 552 of the first pattern 540 undetected to be detected by the small gap 550 of the second pattern 554. If a large particle first contacts a small gap section, then flow will cause it to roll off until it finds a large gap and exits the pattern; thus, if a digital input 544 goes high at the same time as another digital input 544 goes low, this is related to a particle moving through the pattern and just the last digital input high before it going low may be counted as the particle size.

Figure 57:
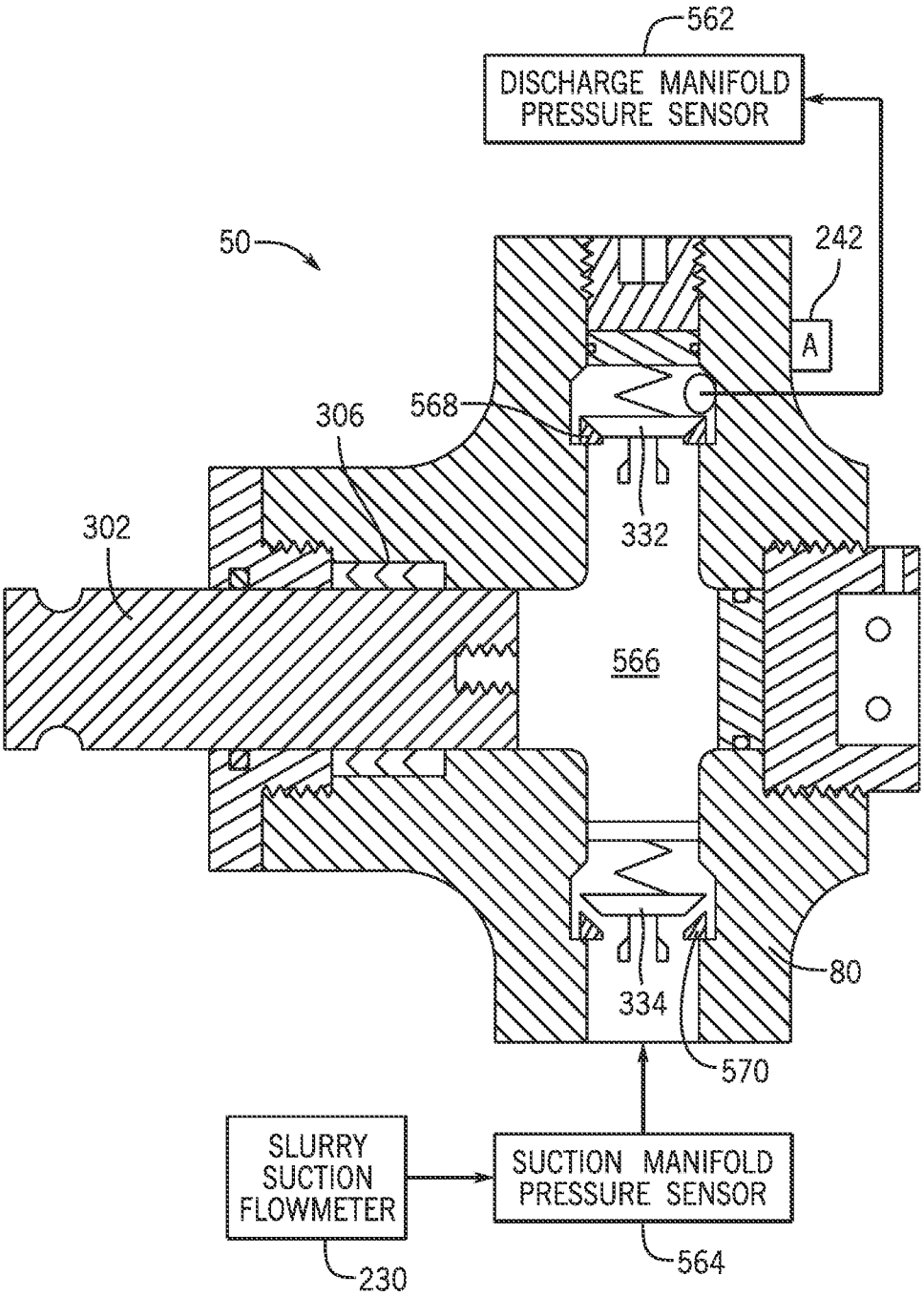
FIG. 57 depicts a fluid end of a pump instrumented with a sensor assembly including a discharge manifold pressure sensor, a suction manifold pressure sensor, a suction flowmeter, and an accelerometer in accordance with one embodiment.

In one embodiment, a system detects valve and seat wear from material erosion and pumping impacts generated in a pump 46 (e.g., a fracturing pump) and resolves the amount of wear in each of the valve-and-seat location (e.g., ten valve-and-seat locations in a quintuplex pump). In one example depicted in FIG. 57, a fluid end 50 of a pump 46 (e.g., a frac pump) is instrumented with a sensor assembly including a discharge manifold pressure sensor 562, a suction manifold pressure sensor 564, a high frequency suction flowmeter 230, an accelerometer 242 mounted on the fluid end 50, and a crankshaft encoder 104 (FIG. 5). Each of the pressure sensors 562 and 564 may be a static and dynamic pressure sensor.

Figure 58:
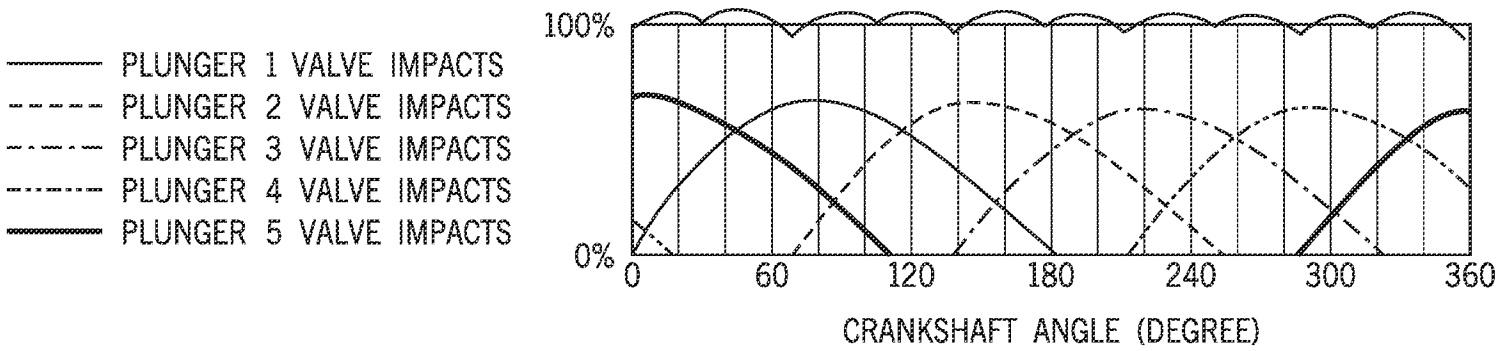
FIG. 58 is a graph depicting pressure pulses from each plunger in a quintuplex pump, along with an expected discharge pressure signature, in accordance with one embodiment.

The pressure pulses from each of the five plungers in a quintuplex frac pump overlap in the discharge manifold while acquired by discharge pressure sensor 562, forming the expected discharge pressure signature shown in FIG. 58 when plotted against the prime mover crankshaft angle acquired from the crankshaft encoder 104. The expected discharge pressure signature is at the top of FIG. 58, while the individual contributions of the five plungers are shown as dashed or solid curves are below the expected discharge signature. A similar signature is expected while plotting the signal from discharge flowrate versus the crankshaft angle. A corresponding curve of suction flowrate measured by flowmeter 230 would be that shown in FIG. 58, but phase shifted by 180 degrees. Also, a similar signature to FIG. 58 may be expected while plotting the signal from suction manifold pressure sensor 564 versus prime mover crankshaft angle though phase shifted by 180 degrees. Different pressures and flowrate setpoints, different fluid compressibility, and different valve wear levels will cause an impact to the shape of these curves.

In some embodiments, each bore of a frac pump 46 (e.g., each of the five bores of a quintuplex frac pump) is diagnosed in an independent manner to avoid the overlapping influence of the different plungers 302 in the wear identification of a valve and seat set. As a single plunger 302 moves through one full revolution, the corresponding chamber 566 goes through a suction phase and discharge phase. The discharge phase causes the corresponding discharge valve 332 to be lifted from the seat 568 and allow the fluid from the chamber 566 to be discharged into the pump outlet (discharge) manifold 84; at the same time, the corresponding suction valve 334 is pushed against the seat 570 and provides a seal keeping the fluid in the chamber 566 from going into the pump inlet (suction) manifold 82. The discharge phase causes an increase in pressure acquired by discharge pressure sensor 562 and an increase in discharge flowrate. Conversely, the suction phase causes the corresponding suction valve 334 to be lifted from the seat 570 and allow the fluid from the suction manifold 82 to go into the chamber 566; at the same time, the corresponding discharge valve 332 is pushed against the seat 568 and provides a seal keeping the fluid in the chamber 566 from being discharged into the pump outlet manifold 84. The suction phase causes an increase in flowrate sensed by suction flowmeter 230 and a decrease in suction pressure acquired by suction pressure sensor 564.

The process of lifting the discharge and suction valves 332 and 334 causes mechanical impacts that are sensed by the accelerometer 242. FIG. 58 shows the influence of corresponding valve impacts on the pressure (or flowrate) curve as a function of crankshaft angle for one pump revolution. Each suction and discharge valve set for each plunger has two impacts, which occur at the beginning and end of the solid or dashed curve for a corresponding plunger. The impact at the beginning of the solid or dashed curve for each plunger 302 corresponds to its discharge valve 332 being lifted as the plunger 302 is going through the high-pressure and flowrate phase. The impact at the end of the solid or dashed curve for each plunger corresponds to its suction valve 334 being lifted as the plunger 302 is going through the low-pressure phase. The precise acquisition of the valve impact, together with the pressure and flowrate acquisition as a function of crankshaft angle, allows analysis of the behavior of each valve individually and thus diagnosis of the wear for each valve while avoiding interference from other valves events.

When a single discharge valve 332 experiences wear, its sealing ability degrades. During the suction phase, this causes a decrease in suction flowrate and an increase in suction pressure when compared to the expected values without valve wear. And when a single suction valve 334 experiences wear, its sealing ability degrades. During the discharge phase, this causes an increase in suction pressure and a decrease in suction flowrate when compared to the expected values without valve wear.

In some embodiments, the present technique enables precisely tracking the pressure or flowrate signature of each valve 332 and 334 over time as well as each suction and discharge phase occurrence. A baseline level of flowrate and pressure characteristics are measured for each valve and each suction and discharge phase when the valves are replaced during maintenance. Over time, the deviation from the baseline level is calculated as a percentage which is considered as a wear value. Once the percentage of wear exceeds a configured threshold tested to be a safe for pump operation, the operator is alerted to request maintenance of a specific valve 332 or 334.

Figure 59:
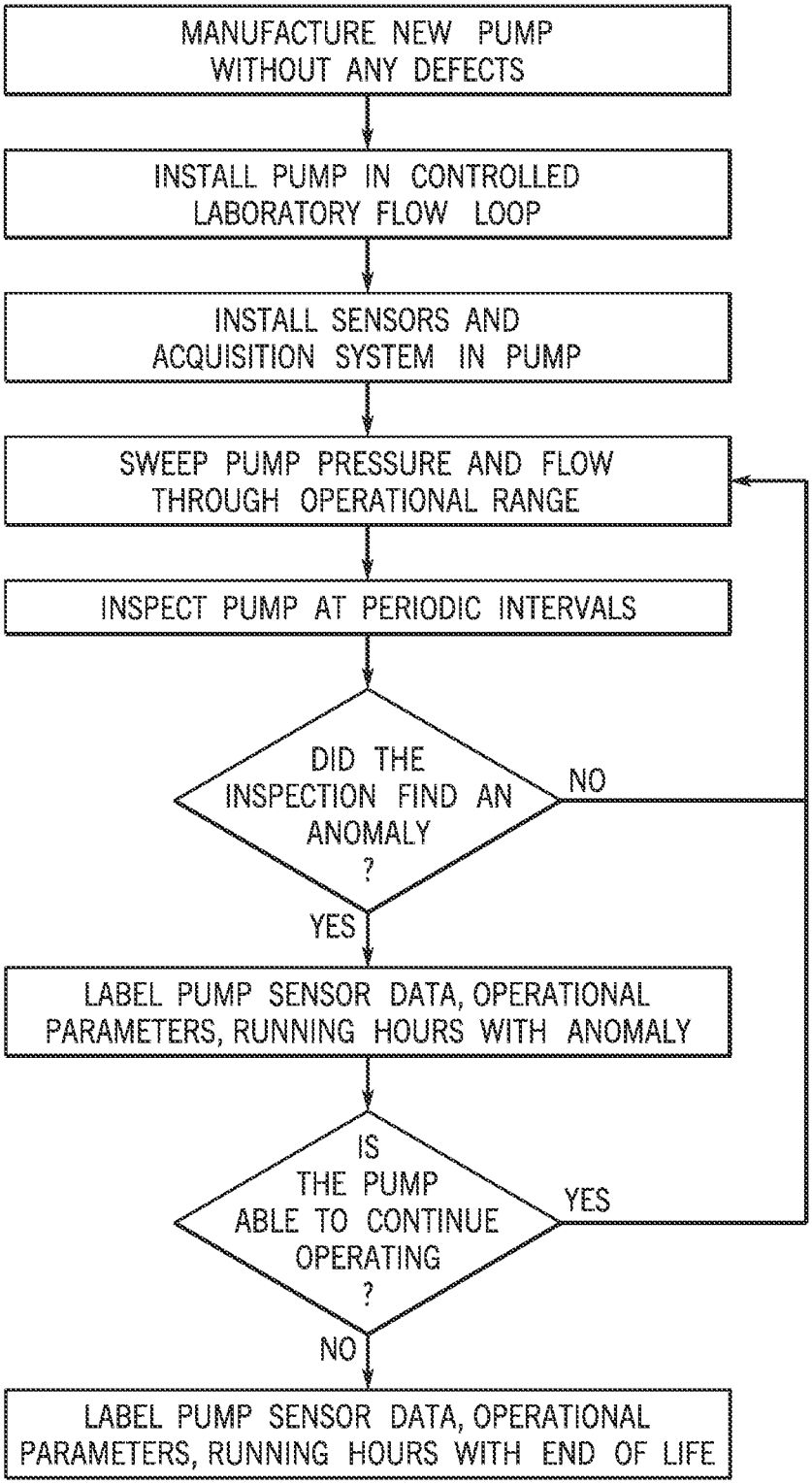
FIG. 59 is a flowchart representing a process for determining expected pump component life, operational characteristics, and anomalies during pump use in accordance with one embodiment.

A particular valve 332 or 334 has an expected life in terms of suction and discharge cycles or pump strokes, under a given pressure, flowrate, and type of fluid pumped. Expected valve life, operational characteristics, and anomalies during use can be determined in any suitable manner, an example of which is depicted in FIG. 59. Higher pressures, flowrates, and more abrasive fluids cause more valve wear and thus decrease the expected remaining useful life for a valve 332 or 334. In some embodiments, the cumulative pressure, flowrate, and suction and discharge cycles experienced by each valve may be tracked so that the remaining useful life can be estimated.

Figure 60:
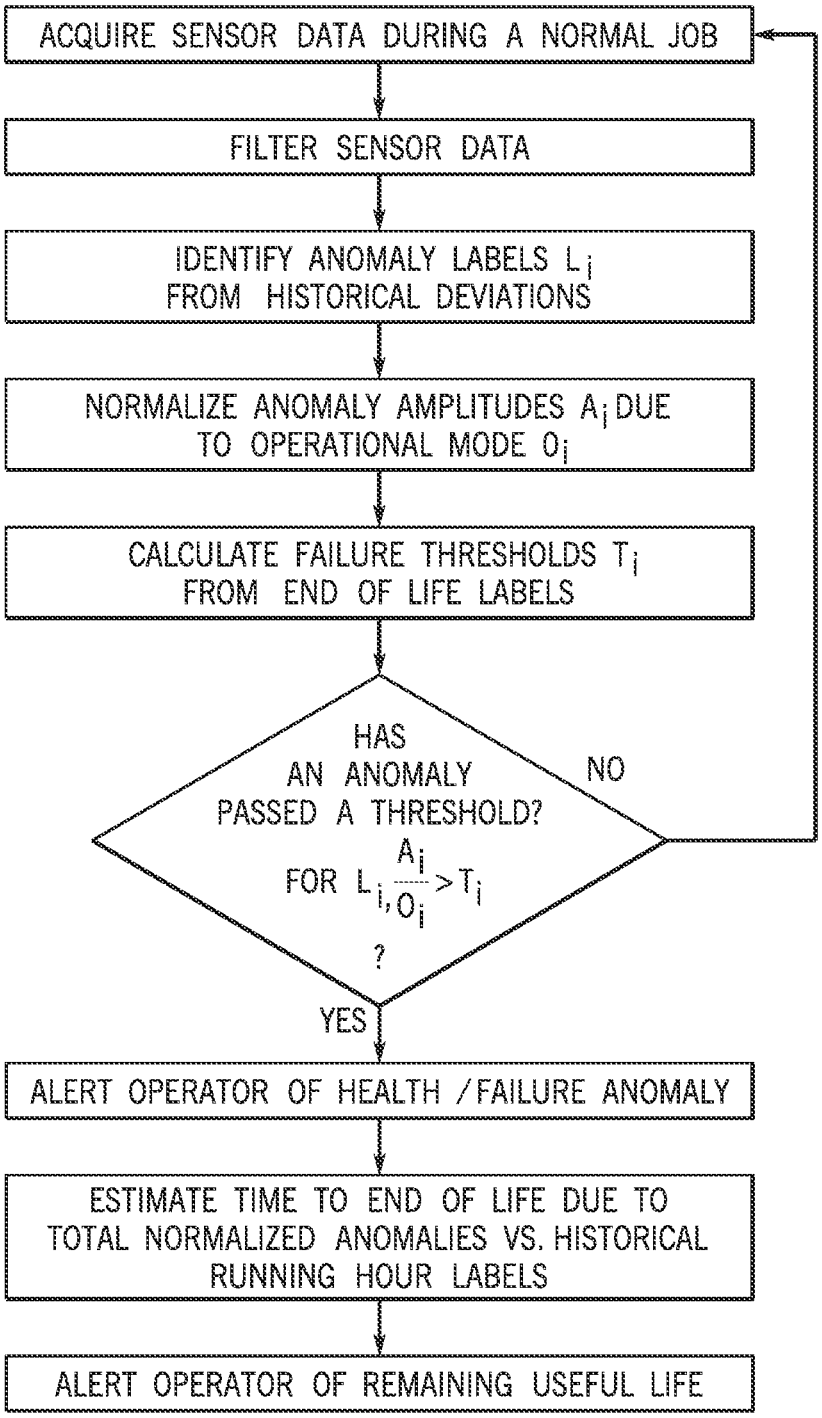
FIG. 60 is a flowchart representing a process for estimating the remaining useful life of a pump component based on historical data in accordance with one embodiment.

By way of example, a process that may be used for estimating the remaining useful life of the valve 332 or 334 based on historical data (e.g., acquired via the process of FIG. 59 or from recorded population data of similar devices) is represented by the flowchart of FIG. 60. The degree of wear calculated to the valve may be compared to the expected wear to the valve given the exposed cumulative pressure and flowrate. The difference between estimated wear and actual wear can be used to calculate an erosion score for the fluid pumped. The degree of wear calculated for the valve can be used to subtract from the expected life of a new valve to estimate remaining life for the worn valve. The erosion score for the fluid can be used to estimate the rate at which the remaining life of the valve will be consumed. Further, the remaining useful life value can be displayed for the operator and maintenance personnel to plan pump operation and maintenance routines. The processes represented in FIGS. 59 and 60 may be used with other pump components. For instance, these processes may be used for calculating expected life and estimating remaining useful life of various other pump components, such as described for additional pump components herein.

Figure 61:
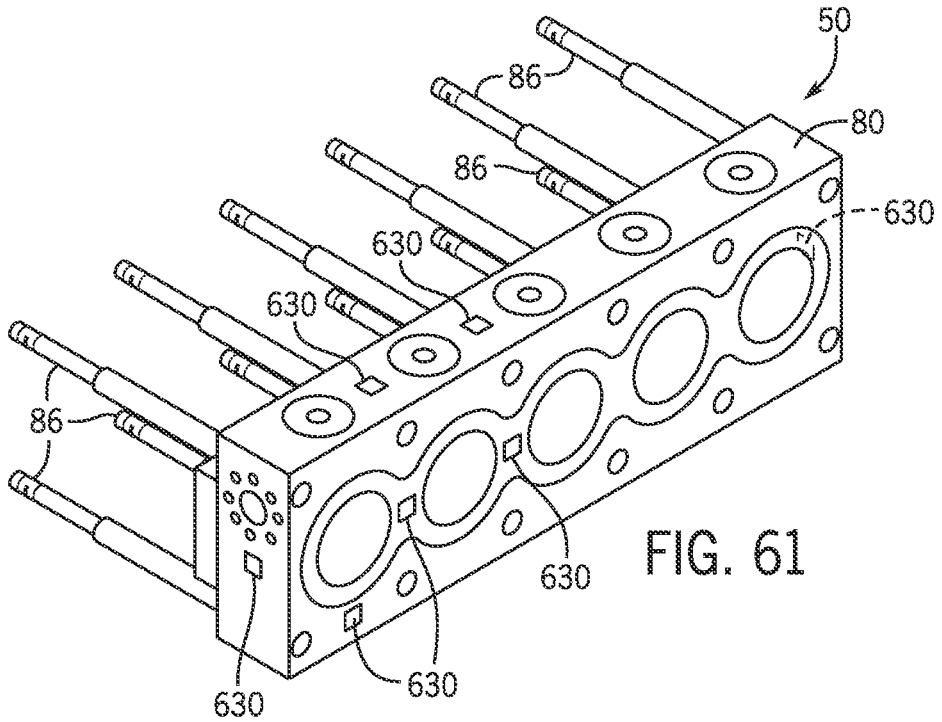
FIG. 61 depicts a monoblock body of a fluid end of a pump, in which the monoblock body is instrumented with strain gauges, in accordance with one embodiment.

In one embodiment, a system detects fluid-end monoblock wear from load induced plastic deformations in a pump 46 (e.g., a fracturing pump) and resolves the amount of wear and specific location of the wear. In one example depicted in FIG. 61, a fluid end 50 of a pump 46 includes a monoblock body 80 instrumented with strain gauges 630 at different locations. The strain gauges 630 may be provided in any suitable number or form, but in one embodiment the monoblock body 80 is instrumented with seven strain gauges 630 that are full Wheatstone bridge static strain gauges. The strain gauges 630 may be installed at locations expected to experience high stress. The pump 46 may also be instrumented with a crankshaft encoder 104 (FIG. 5).

Fluid end 50 wear occurs in the form of temporary elastic and permanent plastic deformations caused by the pressure and flowrate stress inside of the chamber as well as due to pushing and pulling plunger 302 motion from the power end 48. Deformations may eventually lead to fractures that cause a leak from the fluid end 50 and prevent it from being able to pump any more. As previously noted, a typical stress-strain curve is shown in FIG. 21.

Figure 62:
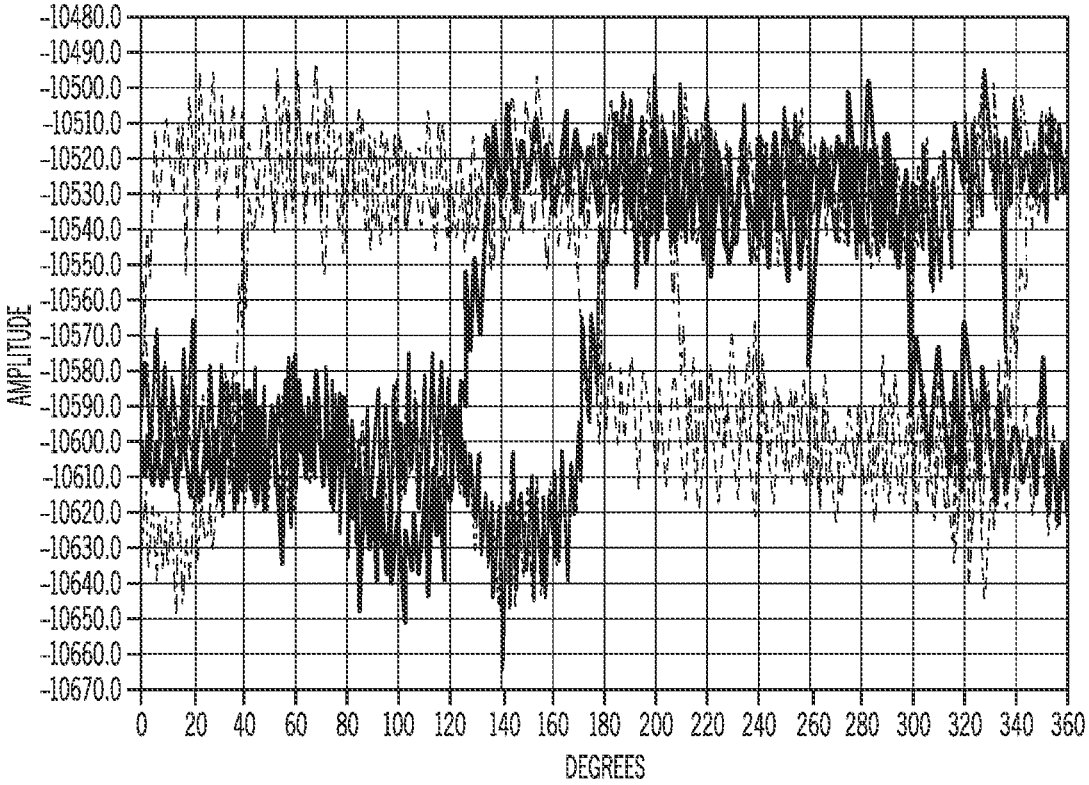
FIG. 62 is a graph with representative signatures of strain gauges on a pump in accordance with one embodiment.

The reciprocal nature of the pump 46 means that within one pump cycle, the strain gauges 630 located at different areas of the monoblock body 80 experience different amounts of stress depending on which plunger 302 is closest to the strain gauge 630. However, the amount of stress acquired will be periodic within one pump revolution as shown in FIG. 62, which depicts representative strain gauge signatures for five different strain gauge locations.

Angle domain analysis of strain gauge signatures can be used to determine whether the amount of stress is within the temporary elastic or permanent plastic deformation region and thus it is able to estimate how close to a fracture the fluid end is, where the fracture is expected to be located, and at which time the fluid end should be replaced during maintenance. Where load is present during high pressure and flowrate periods, the rate of change of strain per strain gauge per angle normalized by pressure and flowrate can be used to identify the point at which permanent plastic deformation is occurring. A constant strain rate of change is linked to elastic deformations and thus may not be considered wear. However, a change in the strain rate of change is linked to a permanent plastic deformation and can be considered wear by adding it to a monoblock wear score proportional to the magnitude of change. When load is removed during no pressure and flowrate periods, strain per angle is subtracted from no-load cases to estimate how much of the stress has become permanent. If there is a difference between the existing no-load case and the previous no-load case strain value (per strain gauge), it can be considered wear by adding it to the monoblock wear score proportional to the magnitude of change.

Each strain gauge may be treated independently while calculating a wear score for the monoblock. Once at least one strain has reached a wear threshold, the operator can be alerted to request maintenance and the location of the strain gauge can be shared to indicate which part of the monoblock is close to experiencing a crack.

A particular monoblock 80 has an expected life in terms of suction and discharge cycles or pump strokes, under a given pressure, flowrate, and type of fluid pumped. Expected life, operational characteristics, and anomalies during use can be determined in any suitable manner, which may include the process represented in FIG. 59 in some instances. Higher pressures, flowrates, and more abrasive fluids cause more monoblock wear and thus decrease the expected remaining useful life.

The cumulative pressure, flowrate, and suction and discharge cycles experienced by the monoblock 80 may be tracked so that the remaining useful life can be estimated.

The remaining useful life of the monoblock 80 can be estimated via the process represented in FIG. 60 or in any other suitable manner. The wear score for the monoblock 80 may be compared to the expected wear of the monoblock 80 given the cumulative pump strokes, pressure, and flowrate. The difference between estimated wear and actual wear can be used to calculate an erosion score for the fluid pumped. The rate of change of the wear can be used to calculate an elasticity score. The degree of wear calculated for the monoblock 80 can be used to subtract from the expected life of a new monoblock 80 to estimate remaining life. The erosion score for the fluid and the elasticity score for the monoblock 80 can be used to estimate the rate at which the remaining life of the monoblock 80 will be consumed. Further, the remaining useful life value can be displayed for the operator and maintenance personnel to plan pump operation and maintenance routines.

Figure 63:
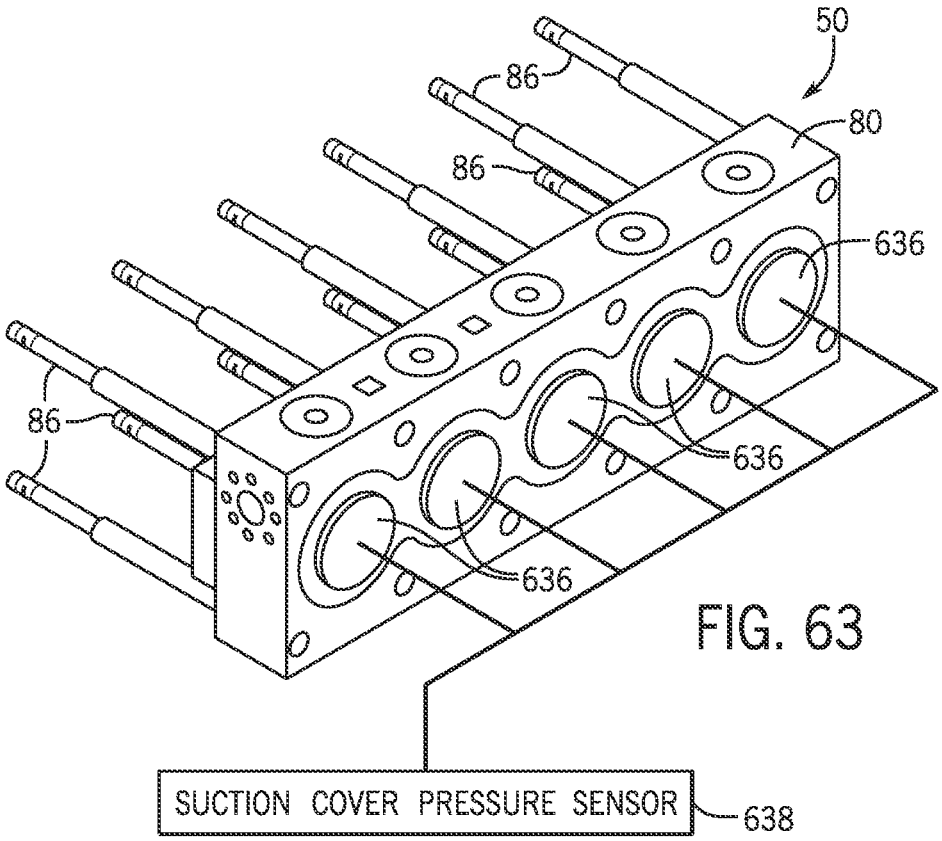
FIG. 63 depicts a fluid end of a pump having hydraulic suction covers and a suction cover pressure sensor in accordance with one embodiment.

In one embodiment, a system detects hydraulic suction cover wear from seal degradation leaks in a pump 46 (e.g., a fracturing pump) and resolves the amount of wear and specific cover location. For instance, FIG. 63 depicts a fluid end 50 of a pump 46 having hydraulic suction covers 636 and a hydraulic suction cover pressure sensor 638, which may be installed in a hydraulic suction cover manifold so that each suction cover 636 is connected to the pressure sensor 638. In some instances, the pressure sensor 638 is a static pressure sensor (e.g., a 15 k psi static pressure sensor). The pump 46 may also be instrumented with a crankshaft encoder 104 (FIG. 5).

Hydraulic suction cover 636 wear occurs in the form of seal degradation leaks which reduce the pressure in the suction cover hydraulic manifold and thus reduce the monoblock 80 pressure chamber sealing ability of the suction covers 636. Once the suction cover wear has reached the point that a suction cover 636 is unable to seal, fluid inside of the fluid end 50 leaks and the fluid end 50 may be unable to increase pressure, preventing the pump 46 from continuing to work and causing the pump 46 to be stopped.

Angle domain analysis of suction cover pressure can be used to monitor the sealing ability of the suction covers 636, and it allows to identify early leaks together with the location among the covers 636 (e.g., among the five covers 636 of a quintuplex pump).

Figure 64:
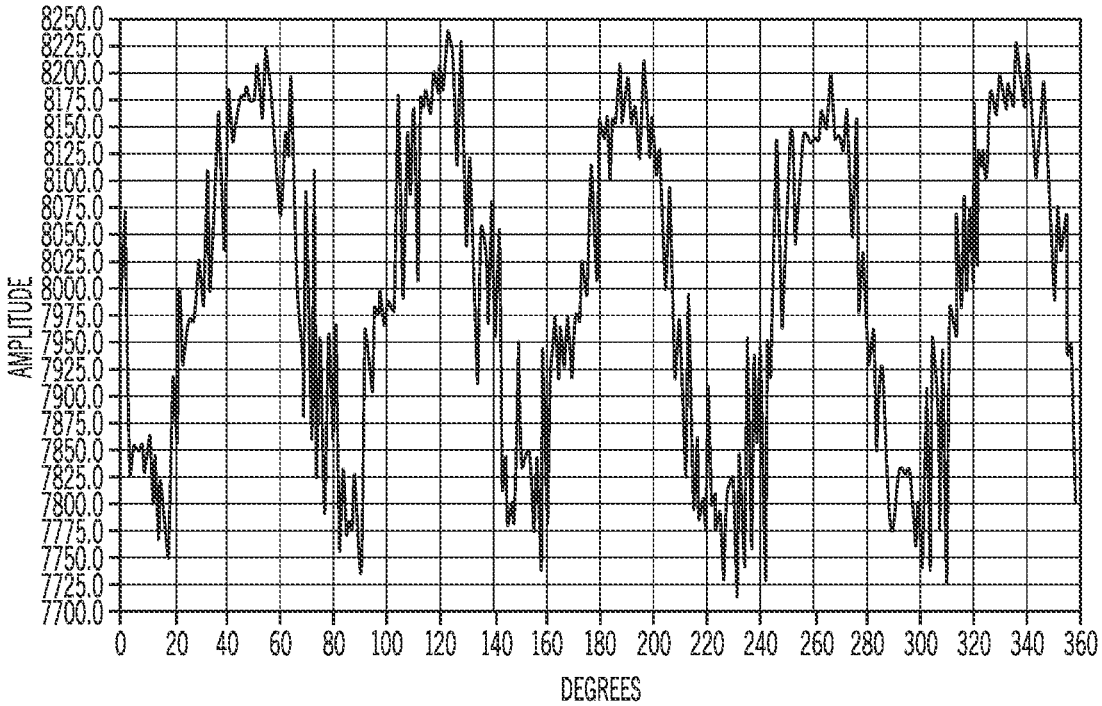
FIG. 64 is a graph of suction and discharge cycles of plungers of a pump in accordance with one embodiment.

The suction and discharge cycles of the pump 46 for each plunger may be captured by the hydraulic suction cover pressure versus crankshaft angle as shown in FIG. 64. An early suction cover leak can be identified by a decrease in the suction cover pressure for a particular crankshaft angle. A single suction cover leak will decrease the average suction cover pressure at all angles, but the rate of decrease is higher at the angle corresponding to the plunger 302 closest to the cover 636 with the leak, which allows identification of which cover 636 has the leak and alerting of the operator.

A particular hydraulic suction cover 636 seal has an expected life in terms of suction and discharge cycles or pump strokes, under a given pressure, flowrate, and type of fluid pumped. Expected life, operational characteristics, and anomalies during use can be determined in any suitable manner, which may include the process represented in FIG. 59 in some instances. Higher pressures, flowrates, and more abrasive fluids cause more hydraulic suction cover wear and thus decrease the expected remaining useful life. The cumulative pressure, flowrate, and suction and discharge cycles experienced by each hydraulic suction cover 636 may be tracked so that the remaining useful life can be estimated.

The remaining useful life for each hydraulic suction cover 636 can be estimated via the process represented in FIG. 60 or in any other suitable manner. A wear score for the hydraulic suction cover 636 may be compared to the expected wear of the hydraulic suction cover 636 given the cumulative pump strokes, pressure, and flowrate. The difference between estimated wear and actual wear can be used to calculate an erosion score for the fluid pumped. The rate of change of the wear can be used to calculate a slope score. The degree of wear calculated for the hydraulic suction cover 636 can be used to subtract from the expected life of a new hydraulic suction cover 636 to estimate remaining life. The erosion score for the fluid and the slope score for the hydraulic suction cover can be used to estimate the rate at which the remaining life of the hydraulic suction cover 636 will be consumed. The remaining useful life value can be displayed for the operator and maintenance personnel to plan pump operation and maintenance routines.

In one embodiment, a system detects power end connecting rod, crosshead, and wrist pin wear from strain, vibration, and temperature in a pump 46 (e.g., a fracturing pump) and resolves the amount of wear and specific location. In FIG. 65, for instance, a connecting rod 72, a crosshead 70, and a wrist pin 186 are instrumented with sensors. These sensors may include an RFID strain gauge 166 on the side 178 of the connecting rod 72, an accelerometer 642 within a bore 644 of the crosshead end 182 of the connecting rod 72, and an RFID temperature sensor 170 on the connecting rod 72. The sensors may also include an RFID temperature sensor 176 on the wrist pin 186 and an RFID temperature sensor 194 on the crosshead 70. While certain locations for these sensors are depicted in FIG. 65, any other suitable sensor locations may also or instead be used. Further, other sensor types (e.g., a non-RFID strain gauge 166, an RFID accelerometer 642, or non-RFID temperature sensors 170, 176, and 194) could also or instead be used. In some instances, the RFID strain gauge 166 and the RFID temperature sensors 170, 176, and 194 are wireless sensors and do not have batteries. The pump 46 may also be instrumented with a crankshaft encoder 104 (FIG. 5).

As noted above, connecting rod, crosshead, and wrist pin wear can occur in the form of temporary elastic and permanent plastic deformations caused by the structural stress resulting from crankshaft rotation and plunger motion. Deformations can eventually lead to fractures or cracks that eventually prevent the rotation of the crankshaft from pushing the plunger and thus keep the pump from moving anymore.

Connecting rod wear can be analyzed through abnormal strain and temperature wireless sensor signatures (e.g., from sensors 166 and 170). Temperatures higher than expected can be used to estimate higher wear. Also, angle domain analysis of strain gauge signatures allows determination of whether the amount of stress experienced is within the plastic or elastic region, or under an endurance limit of the connecting rod, and thus estimation of how close to a fracture the connecting rod is and at which time the connecting rod should be replaced during maintenance. When load is increased during high torque periods, the rate of change of strain per angle is used to identify a threshold at which permanent plastic deformation is occurring. When load is reduced during low torque periods, strain vs. angle is compared to previous high load cases to estimate how much stress has become permanent and thus it is accumulated as permanent plastic deformation and assigned a wear score.

As noted above, an example of a stress-strain curve is shown in FIG. 21. The reciprocal nature of the pump 46 means that within one pump cycle, the strain gauge 166 located on the connecting rod 72 experiences different amounts of stress. However, the amount of stress acquired will be periodic within one pump revolution, as shown in FIG. 22. Deformations closer to the wrist pin 186 result in abnormal vibrations and temperatures that are acquired by a wireless accelerometer 642 and wireless temperature sensor 176 located on or inside the wrist pin 186. Again, an example of a vibration signature that may be measured by an accelerometer (e.g., accelerometer 642) is shown in FIG. 23.

A particular connecting rod, crosshead, and wrist pin assembly has an expected life in terms of strain, vibration, and temperature. Expected life, operational characteristics, and anomalies during use can be determined in any suitable manner, which may include the process represented in FIG. 59 in some instances. Higher strain, vibration, and temperature cause more connecting rod, crosshead, and wrist pin wear and thus decrease the expected remaining useful life. The cumulative strain, vibration, and temperature experienced by each connecting rod, crosshead, and wrist pin location can be tracked so that the remaining useful life can be estimated.

The remaining useful life for the connecting rod 72, the crosshead 70, and the wrist pin 186 can be estimated via the process represented in FIG. 60 or in any other suitable manner. The deviation of connecting rod, crosshead, and wrist pin strain, vibration, and temperature measurements discussed previously from the expected value in a healthy connecting rod, crosshead, and wrist pin assembly can be used to assign a connecting rod, crosshead, and wrist pin wear score to the connecting rod, crosshead, and wrist pin for each location. The wear score may be compared to the expected wear to the connecting rod, crosshead, and wrist pin given the cumulative strain, vibration, and temperature. The rate of change of the wear can be used to calculate a slope score. The degree of wear calculated for the connecting rod, crosshead, and wrist pin can be used to subtract from the expected life from a new connecting rod, crosshead, and wrist pin to estimate remaining life. The slope score for the connecting rod, crosshead, and wrist pin can be used to estimate the rate at which the remaining life of the connecting rod, crosshead, and wrist pin will be consumed. Additionally, the remaining useful life value can be displayed for the operator and maintenance personnel to plan pump operation and maintenance routines.

In one embodiment, a system detects packing wear from lubrication, seal degradation, and mechanical deformations in a pump 46 (e.g., a fracturing pump) and resolves the amount of wear and specific bore location. In FIG. 66, for example, a fluid end 50 of a pump 46 is instrumented with a sensor assembly 648 for each bore (for a total of five assemblies 648 for a quintuplex pump 46) having a packing pressure sensor 650, a packing temperature sensor 652, and a packing water saturation sensor 654. In some instances, the pressure sensor 650 is a static pressure sensor, such as a 5 k psi static pressure sensor, and the temperature sensor 652 is a thermistor temperature sensor, such as a 105° C. miniature negative temperature coefficient (NTC) thermistor sensor. The pump 46 may also be instrumented with a crankshaft encoder 104 (FIG. 5).

Packing wear can occur in the form of seal degradation leaks and in the form of housing fractures. Packing wear accumulates over time due to mechanical stress from plunger movement but can grow quickly as a result of poor packing lubrication. Packing wear may be severe enough to result in complete pump failure, preventing the pump from continuing to supply pressure and flowrate during a job.

Figure 67:
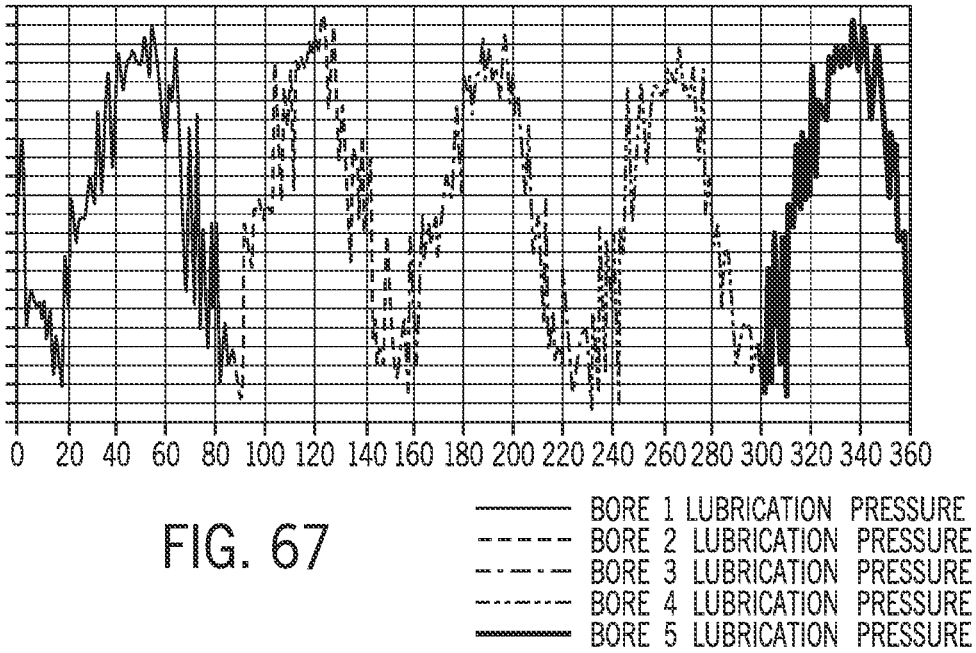
FIG. 67 is a graph of packing lubrication pressure for five bores of a quintuplex pump as a function of crankshaft angle in accordance with one embodiment.

The system of FIG. 66 can be used to diagnose the efficacy of packing lubrication and the impact it has on packing seal degradation and packing housing fractures. Packing lubrication delivery can be monitored through the packing pressure sensor 650 (one for each bore) installed after a check valve to confirm lubrication pressure delivered to each packing bore even if the check valve fails in a closed position. The packing lubrication pressure signature for a bore is such that it increases in amplitude prior to the respective plunger 302 actuation, and it decreases in amplitude after the respective plunger actuation. Therefore, lack of pressure rise in amplitude prior to the respective plunger actuation is used to confirm failure of the packing lubrication supply for the respective bore. A composite plot of packing lubrication pressure for all five bores (e.g., from five packing pressure sensors 650) versus crankshaft angle (e.g., from encoder 104) are shown in FIG. 67 as an example. Failure of packing lubrication for all five bores confirms an issue in the packing pump supply circuit while failure of less than all five bores confirms an issue with the delivery circuit of one or more specific bores. The operator can be alerted of this condition to schedule packing lubrication maintenance, which can reduce packing wear, extend packing life, and prevent early complete failure of the pump.

Figure 68:
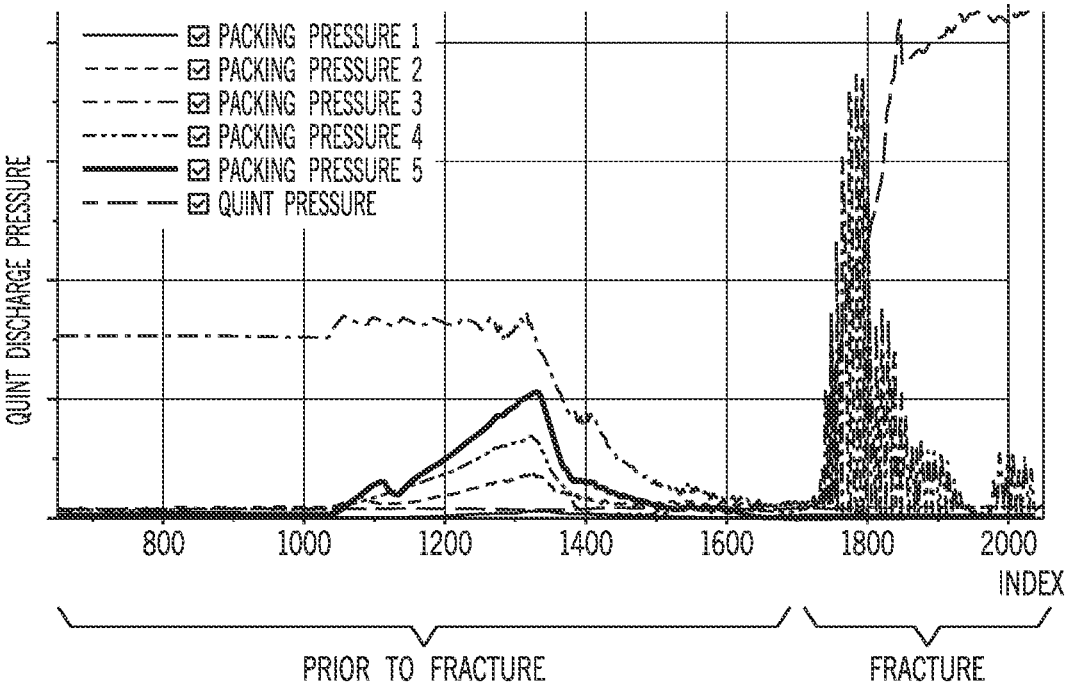
FIG. 68 is a graph of packing pressure for five bores of a quintuplex pump as a function of time in accordance with one embodiment.

Degradation of packing seal or fracture of packing housing can cause the pump 46 discharge pressure to leak through the packing 306 into the packing lubrication circuit. This results in the packing pressure sensor 650 signal for any bore to rise in amplitude after the respective plunger 302 actuation, or to rise in amplitude above the packing lubrication pump output at any time. An example of packing pressure as a function of time is shown in FIG. 68 with data prior to fracture in the left portion and post fracture in the right portion. This pressure response may also result from other events, such as a rubber goods (e.g., a rubber seal) failure. The operator can be alerted of this condition to schedule packing lubrication maintenance, which may reduce packing wear, extend packing life, and prevent early complete failure of the pump.

Packing lubrication flow can be provided by the packing lubrication pump 312 with flowrate directly proportional to the speed of the pump 46. However, different operating environments due to combination of wear, pressures, flowrates, temperatures, and fluid pumped may result in the lubrication flowrate from the pump 312 becoming unable to properly lubricate the packing 306. The efficacy of the lubrication flowrate in lubricating packing can be measured by measuring the temperature of each packing bore with the temperature sensor 652, which may be a miniature sensor placed inside of a small packing sleeve cavity in close physical proximity to the packing sleeve 304. Once the temperature for the packing sleeve cavity rises by a threshold, the flowrate factor command to the packing lubrication pump 312 can be increased in order to increase packing flowrate and improve the packing lubrication, extending its life and preventing early wear. Conversely, if the packing temperature decreases by a threshold, the flowrate factor command to the packing lubrication pump 312 can be decreased in order to decrease packing flowrate and avoid wasting packing lubrication oil, which reduces unnecessary cost of lubrication oil consumed.

When the packing seal degrades, water from the monoblock chamber leaks into the packing lubrication cavity. The packing water saturation sensor 654 can be installed in the packing lubrication cavity for each bore in the pump 46 and can detect the signature stemming from water presence in the lubrication circuit, thus providing early detection of packing wear causing leaks. Once the water saturation measured for any bore rises by a threshold, the operator can be alerted to request maintenance of the packing seal for the respective bore, extending its life and preventing early wear.

A particular packing assembly has an expected life in terms of suction and discharge cycles or pump strokes, under a given pressure, flowrate, and type of fluid pumped. Expected life, operational characteristics, and anomalies during use can be determined in any suitable manner, which may include the process represented in FIG. 59 in some instances. Higher pressures, flowrates, and more abrasive fluids cause more packing wear and thus decrease the expected remaining useful life. The cumulative pressure, flowrate, and suction and discharge cycles experienced by each packing may be tracked so that the remaining useful life can be estimated.

The remaining useful life for each packing can be estimated via the process represented in FIG. 60 or in any other suitable manner. The deviation of the packing pressure, temperature, and water concentration measurements above from the expected values in a healthy packing assembly can be used to assign a packing wear score to the packing for each bore. The wear score can be compared to the expected wear to the packing given the cumulative pump strokes, pressure, and flowrate. The difference between estimated wear and actual wear can be used to calculate an erosion score to the fluid pumped. The rate of change of the wear can be used to calculate a slope score. The degree of wear calculated for the packing can be used to subtract from the expected life from a new packing to estimate remaining life, and the erosion score for the fluid and the slope score for the packing can be used to estimate the rate at which the remaining life of the packing will be consumed. The remaining useful life value can be displayed for the operator and maintenance personnel to plan pump operation and maintenance routines.

Figure 69:
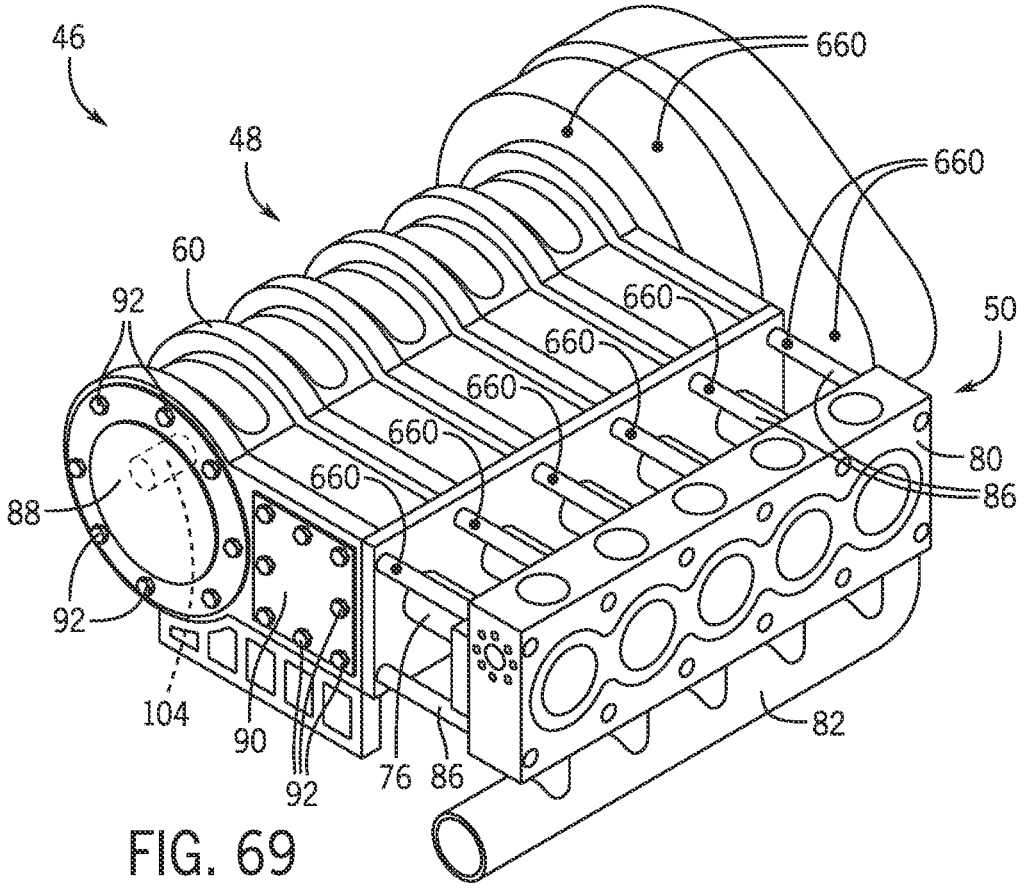
FIGS. 69 and 70 depict a quintuplex pump instrumented with sensors at various locations of a gearbox, stay rods, and a frame of the pump in accordance with one embodiment.
Figure 70:
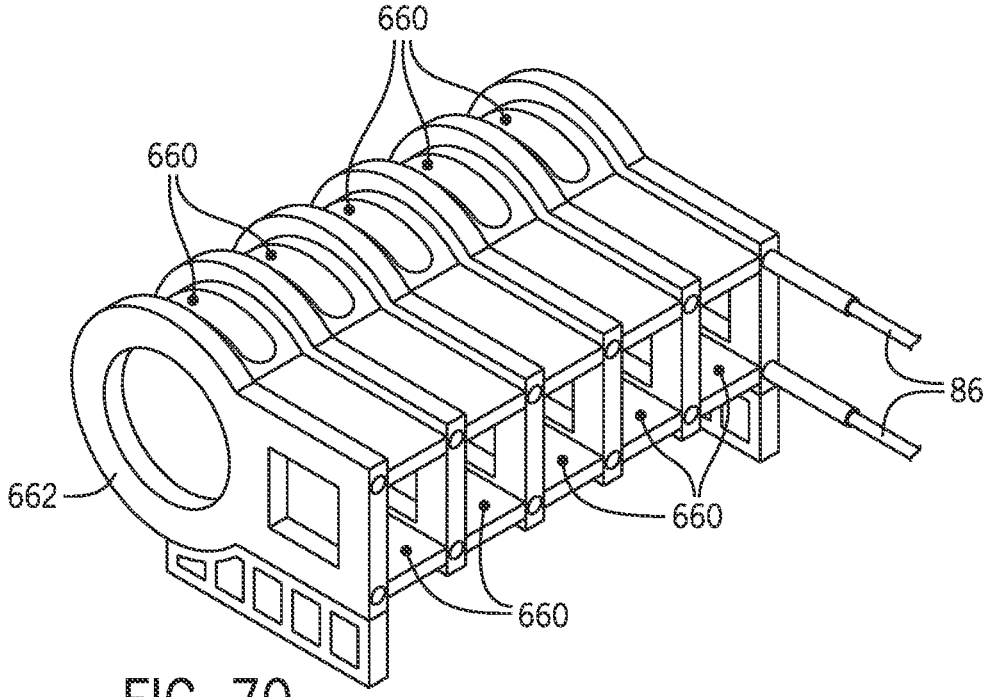

In one embodiment, a system detects power end and gearbox frame wear from lubrication and mechanical deformations in a pump 46 (e.g., a fracturing pump) and resolves the amount of wear and specific location. As shown in FIGS. 69 and 70, a pump 46 is instrumented with sensors at various locations 660 on the gearbox, stay rods 86, and frame 662 of the pump 46 to facilitate such detection. Although nineteen locations 660 are depicted in FIGS. 69 and 70, the number and position of the locations 660 may differ in other embodiments. The sensors at the locations 660 can include strain gauges and temperature sensors. In at least some instances, each location 660 includes both a strain gauge (e.g., strain gauge 630) and a temperature sensor (e.g., temperature sensor 176). The pump 46 may also be instrumented with a crankshaft encoder 104.

Power end and gearbox frame wear can occur in the form of temporary elastic and permanent plastic deformations caused by the structural stress resulting from crankshaft rotation and plunger motion. Deformations can eventually lead to fractures or frame cracks that eventually prevent the rotation of the crankshaft from pushing the plunger and thus keep the pump from moving anymore.

The efficacy of frame lubrication and the impact it has on frame fractures can be diagnosed with the above sensors. Load and angle domain analysis of strain gauge signatures allows determination of whether the amount of stress experienced is within the plastic or elastic region, or under an endurance limit of the frame, and thus estimation of how close to a fracture the frame is, where the fracture is expected to be located, and at which time the frame should be repaired during maintenance. When load is increased during high torque periods, the rate of change of strain per angle can be used to identify a threshold at which permanent plastic deformation is occurring. When load is reduced during low torque periods, strain vs. angle can be compared to previous high load cases to estimate how much stress has become permanent, which can be accumulated as permanent plastic deformation and assigned a wear score.

As noted above, an example of a stress-strain curve is shown in FIG. 21. The reciprocal nature of the pump 46 means that within one pump cycle, the strain gauges (e.g., strain gauges 630) located at different areas of the frame 662 and stay rods 86 experience different amounts of stress depending on the torque distribution closest to the strain gauge. However, the amount of stress acquired will be periodic within one pump revolution, such as shown in FIG. 62, which depicts representative signal traces for five different strain gauge locations.

Temperature measurements along the frame 662 facilitate evaluation of lubrication effectiveness. Based on the temperature measurements, the power end lubrication flowrate may be increased to compensate for increased frame temperature by sending a faster speed command to a power end lubrication pump. Alternatively, if the temperature is below a threshold, the power end lubrication speed may be lowered to reduce costs associated with related energy consumption. In some instances, this raising or lowering of the power end lubrication speed is performed automatically by the system in response to the measured temperature.

A particular frame assembly has an expected life in terms of temperature and strain. Expected life, operational characteristics, and anomalies during use can be determined in any suitable manner, which may include the process represented in FIG. 59 in some instances. Higher temperature and strain can cause more frame wear and thus decrease the expected remaining useful life. The cumulative temperature and strain experienced by each frame assembly location (e.g., on the frame 662, stay rods 86, or gearbox) may be tracked so that the remaining useful life can be estimated.

The remaining useful life for the frame assembly can be estimated via the process represented in FIG. 60 or in any other suitable manner. The deviation of frame temperature and strain measurements discussed above from the expected value in a healthy frame assembly can be used to assign a frame wear score to the frame for each location. The wear score can be compared to the expected wear to the frame given the cumulative temperature and strain. The rate of change of the wear can be used to calculate a slope score. The degree of wear calculated for the frame can be used to subtract from the expected life from a new frame to estimate remaining life, and the slope score for the frame can be used to estimate the rate at which the remaining life of the frame will be consumed. The remaining useful life value can be displayed for the operator and maintenance personnel to plan pump operation and maintenance routines.

Figure 71:
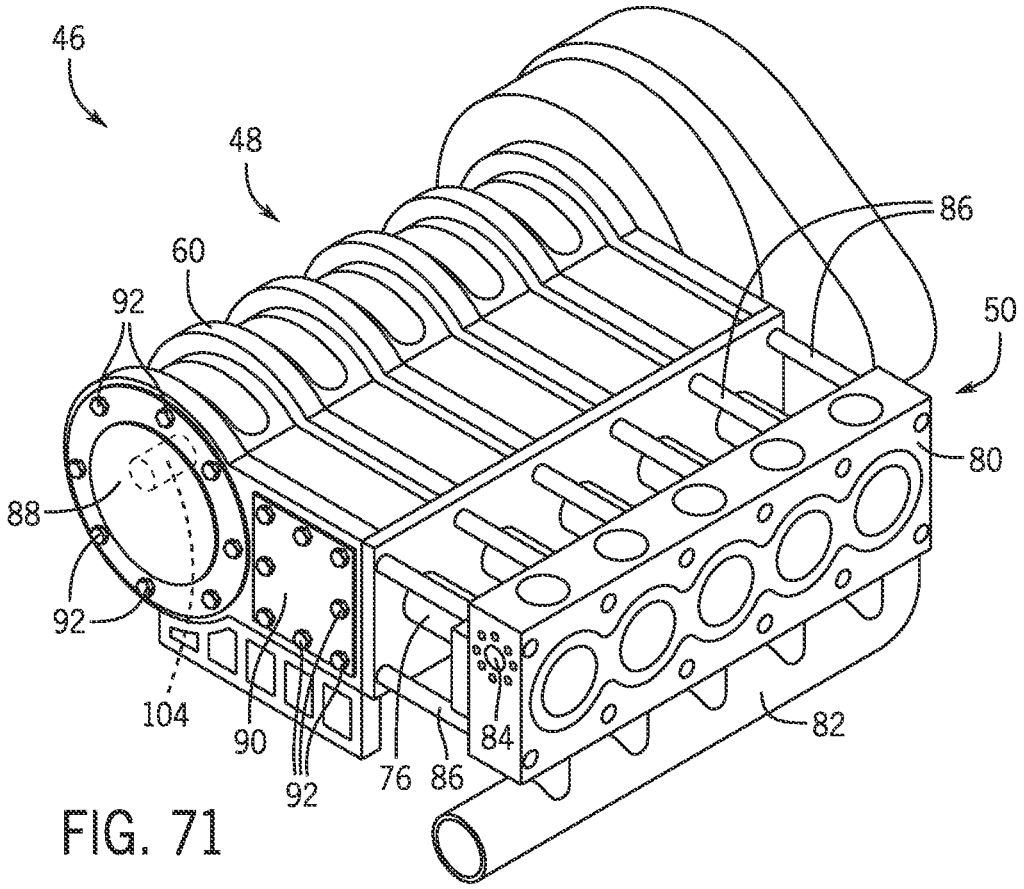
FIGS. 71 and 72 depict a quintuplex pump instrumented with a crankshaft encoder, temperature sensors, and an accelerometer in accordance with one embodiment.
Figure 72:
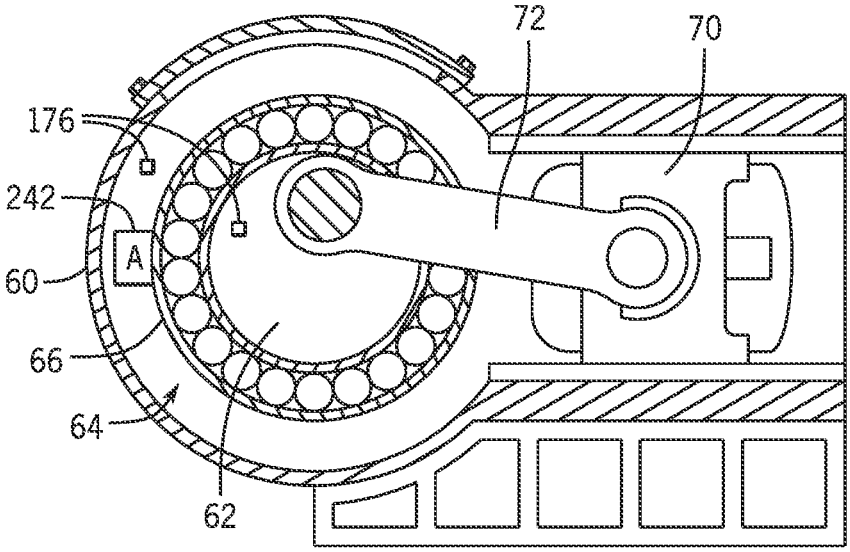

In one embodiment, a system detects power end roller bearing wear from lubrication and mechanical deformations in a pump 46 (e.g., a fracturing pump) and resolves the amount of wear and specific location. As shown in FIGS. 71 and 72, a pump 46 (e.g., a fracturing pump) is instrumented with a crankshaft encoder 104, temperature sensors 176 (e.g., RFID temperature sensors), and an accelerometer 242. The temperature sensors 176 may be RFID temperature sensors or some other form of wireless temperature sensors in some instances. The pump 46 may also include additional accelerometers, such as wireless accelerometers 130 (FIG. 13) positioned on opposing ends of the crankshaft 62.

Roller bearing 66 wear can occur in the form of deformations and cracks due to stresses and inadequate lubrication. Roller bearing wear can eventually lead to increased friction that prevents the rotation of the crankshaft 62 from pushing the plunger and thus keep the pump from moving anymore.

Inadequate roller bearing lubrication can be identified by an increased temperature from temperature sensors 176 mounted on the crankshaft 62 and in the frame near the roller bearings 66. Based on the identified increased temperature, the power end lubrication flowrate may be increased to compensate for increased roller bearing temperature by sending a faster speed command to a power end lubrication pump. Alternatively, if the temperature is below a threshold, the power end lubrication speed may be lowered to reduce costs associated with related energy consumption. In some instances, this raising or lowering of the power end lubrication speed is performed automatically by the system in response to the measured temperature.

Figure 73:
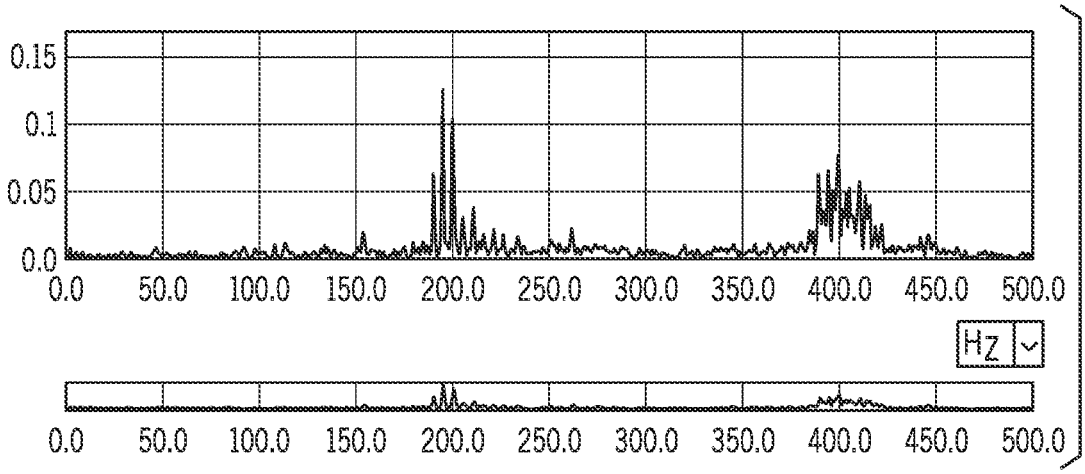
FIG. 73 is a graph of a vibration signal of the pump in the frequency domain in accordance with one embodiment.
Figure 74:
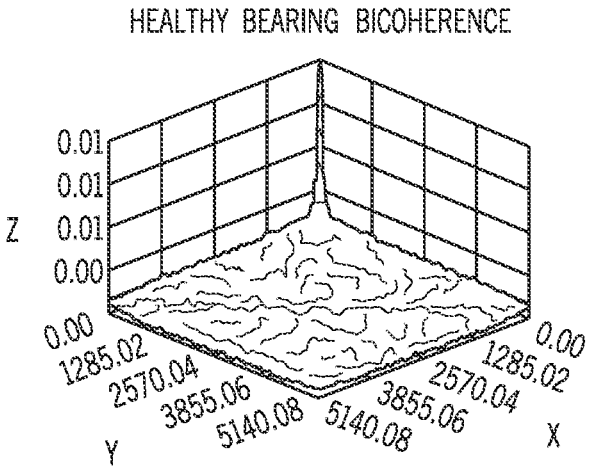
FIG. 74 is a graph of a vibration signal for a healthy pump bearing in the bicoherence domain in accordance with one embodiment.
Figure 75:
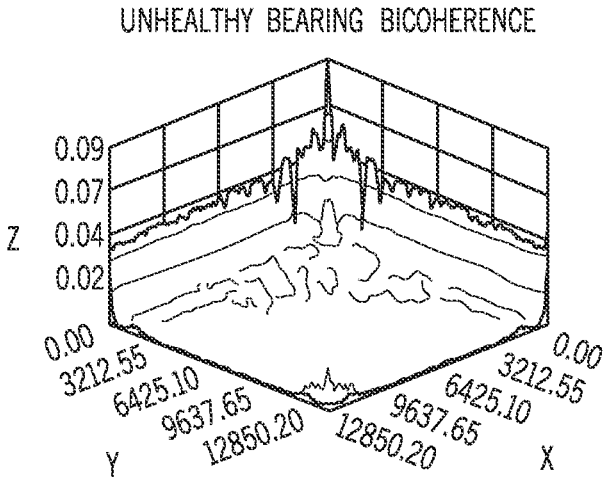
FIG. 75 is a graph of a vibration signal for an unhealthy pump bearing in the bicoherence domain in accordance with one embodiment.

Roller bearing cracks and deformations can lead to increased vibration and harmonics associated with the number of features arising in the bearing 66 that is deformed. Increased vibration can be captured by an accelerometer 242 mounted on the external surface of the bearing 66 to capture the radial motion of the bearing 66. Increased vibration can also be captured by a wireless accelerometer 130 mounted on the crankshaft 62 inside of the pump 46. Advanced digital signal processing can be used to transform the vibration signals to the angle, frequency (as shown in FIG. 73), cepstrum, and bicoherence (as shown in FIGS. 74 and 75) domains for estimation of bearing wear.

A particular roller bearing assembly has an expected life in terms of temperature and vibration. Expected life, operational characteristics, and anomalies during use can be determined in any suitable manner, which may include the process represented in FIG. 59 in some instances. Higher temperature and vibration can cause more roller bearing wear and thus decrease the expected remaining useful life. The cumulative temperature and vibration experienced by each roller bearing 66 location can be tracked so that the remaining useful life can be estimated.

The remaining useful life for the roller bearing 66 can be estimated via the process represented in FIG. 60 or in any other suitable manner. The deviation of roller bearing temperature and vibration measurements discussed above from the expected value in a healthy roller bearing assembly can be used to assign a roller bearing wear score to the roller bearing for each location. The wear score can be compared to the expected wear to the roller bearing given the cumulative temperature and vibration. The rate of change of the wear can be used to calculate a slope score. The degree of wear calculated for the roller bearing can be used to subtract from the expected life of a new roller bearing to estimate remaining life, and the slope score for the roller bearing can be used to estimate the rate at which the remaining life of the roller bearing will be consumed. The remaining useful life value can be displayed for the operator and maintenance personnel to plan pump operation and maintenance routines.

Figure 76:
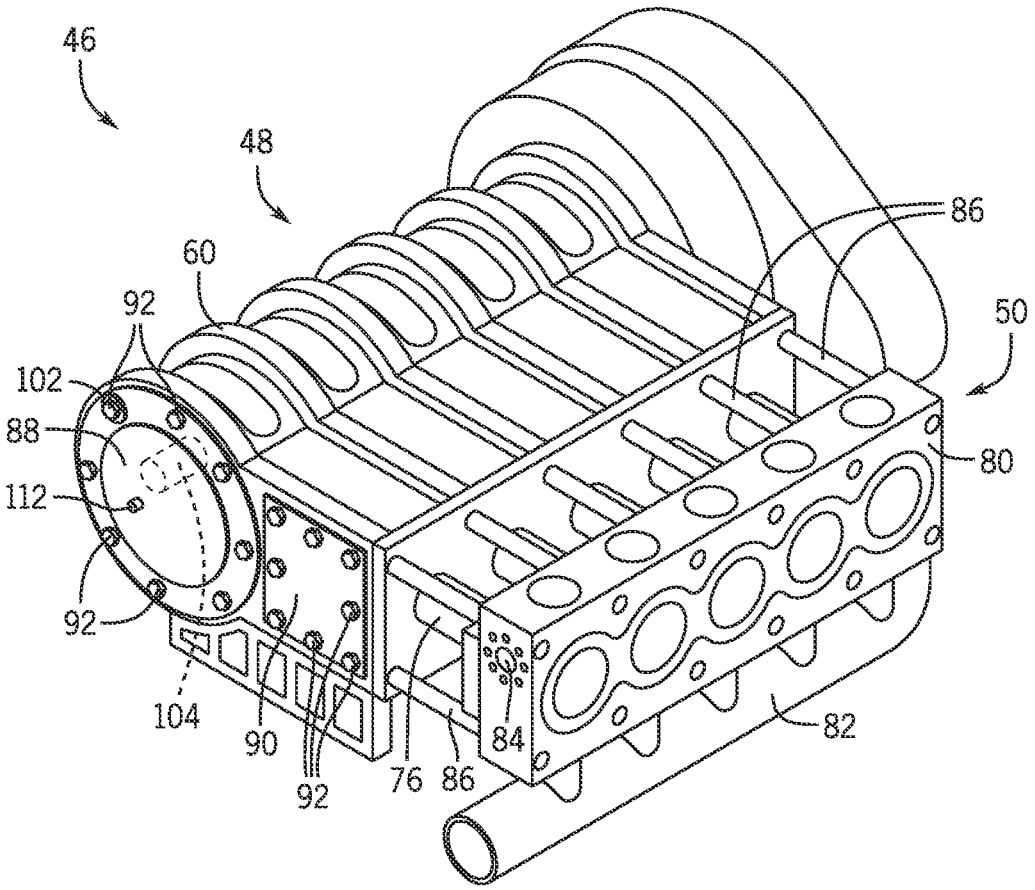
FIGS. 76 and 77 depict a quintuplex pump instrumented with various sensors in accordance with one embodiment.
Figure 77:
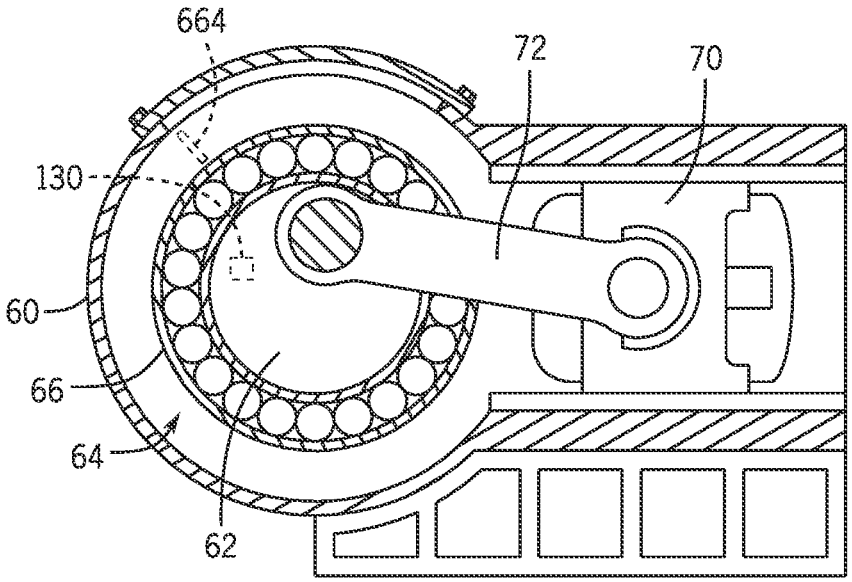

In one embodiment, a system detects power end crankshaft wear from axial thrust load, displacement, vibration, and torque in a pump 46 (e.g., a fracturing pump) and resolves the amount of wear and specific location. In FIGS. 76 and 77, a pump 46 is instrumented with a sensor assembly including a load washer 102 (for axial thrust load), a proximity sensor 112 (for axial displacement of the crankshaft 62), and a crankshaft encoder 104 (for crankshaft angle). The sensor assembly may also include two proximity switches 664 positioned near opposing ends of the crankshaft 62 (for torque) and two wireless accelerometers 130 (FIG. 13) at opposing ends of the crankshaft 62 (for torsional vibration).

Figure 78:
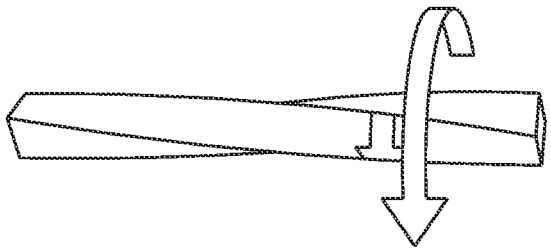
FIG. 78 generally represents behavior of a crankshaft in response to high torque stress in accordance with one embodiment.

High torque stress on the crankshaft 62 causes it to exhibit behavior akin to a torsional spring (as generally represented in FIG. 78), during which identical locations along the crankshaft 62 develop a phase shift in angle. Torsional rotation can lead to torsional vibrations, which can synchronize with the crankshaft natural frequency and thus resonate, causing large vibrations and stresses causing wear across the crankshaft 62 and the pump frame structure.

As the crankshaft torsional spring movement of the crankshaft 62 winds in one direction, the total distance of the crankshaft 62 is reduced. This can be captured as a reduction in load per crankshaft angle by the load washer 102 and can be captured as an increase in axial distance per crankshaft angle by the proximity sensor 112. Conversely, as the crankshaft unwinds in the opposite direction, this can be captured as an increase in load by the load washer 102, and a decrease in distance by the proximity sensor 112. The high-resolution angle provided by the crankshaft encoder 104 can be used to analyze the sensor data (e.g., axial load and distance) in the angle domain, such as shown in FIGS. 8 and 12 and discussed above.

The pump 46 can also be instrumented with two identical toothed wheels at opposite ends of the crankshaft 62. Proximity switches 664 acquire pulses by each tooth of the wheels as the crankshaft 62 rotates, which allows calculation of an angle of rotation for each end of the crankshaft 62. As torsional vibration develops, the phase shift between these two toothed wheel angles increases. The phase shift can also be used to calculate the amount of torque provided to the crankshaft 62 by the prime mover 42, such as motor 116 (FIG. 13).

Two wireless accelerometers 130 can be installed at opposite ends of the crankshaft 62 at identical locations and orientation. The difference of vibration measured by the accelerometers 130 can be used to calculate the amplitude of the torsional vibration (as shown in FIG. 24 and discussed above).

A particular crankshaft assembly has an expected life in terms of axial thrust load, displacement, vibration, and torque. Expected life, operational characteristics, and anomalies during use can be determined in any suitable manner, which may include the process represented in FIG. 59 in some instances. Higher axial thrust load, displacement, vibration, and torque can cause more crankshaft wear and thus decrease the expected remaining useful life. The cumulative axial thrust load, displacement, vibration, and torque experienced by each crankshaft location can be tracked so that the remaining useful life can be estimated.

The remaining useful life for the crankshaft 62 can be estimated via the process represented in FIG. 60 or in any other suitable manner. The deviation of crankshaft axial thrust load, displacement, vibration, and torque measurements discussed above from the expected value in a healthy crankshaft assembly can be used to assign a crankshaft wear score to the crankshaft for each location. The wear score can be compared to the expected wear to the crankshaft given the cumulative axial thrust load, displacement, vibration, and torque. The rate of change of the wear can be used to calculate a slope score. The degree of wear calculated for the crankshaft can be used to subtract from the expected life from a new crankshaft to estimate remaining life, and the slope score for the crankshaft can be used to estimate the rate at which the remaining life of the crankshaft will be consumed. The remaining useful life value can be displayed for the operator and maintenance personnel to plan pump operation and maintenance routines.

Figure 79:
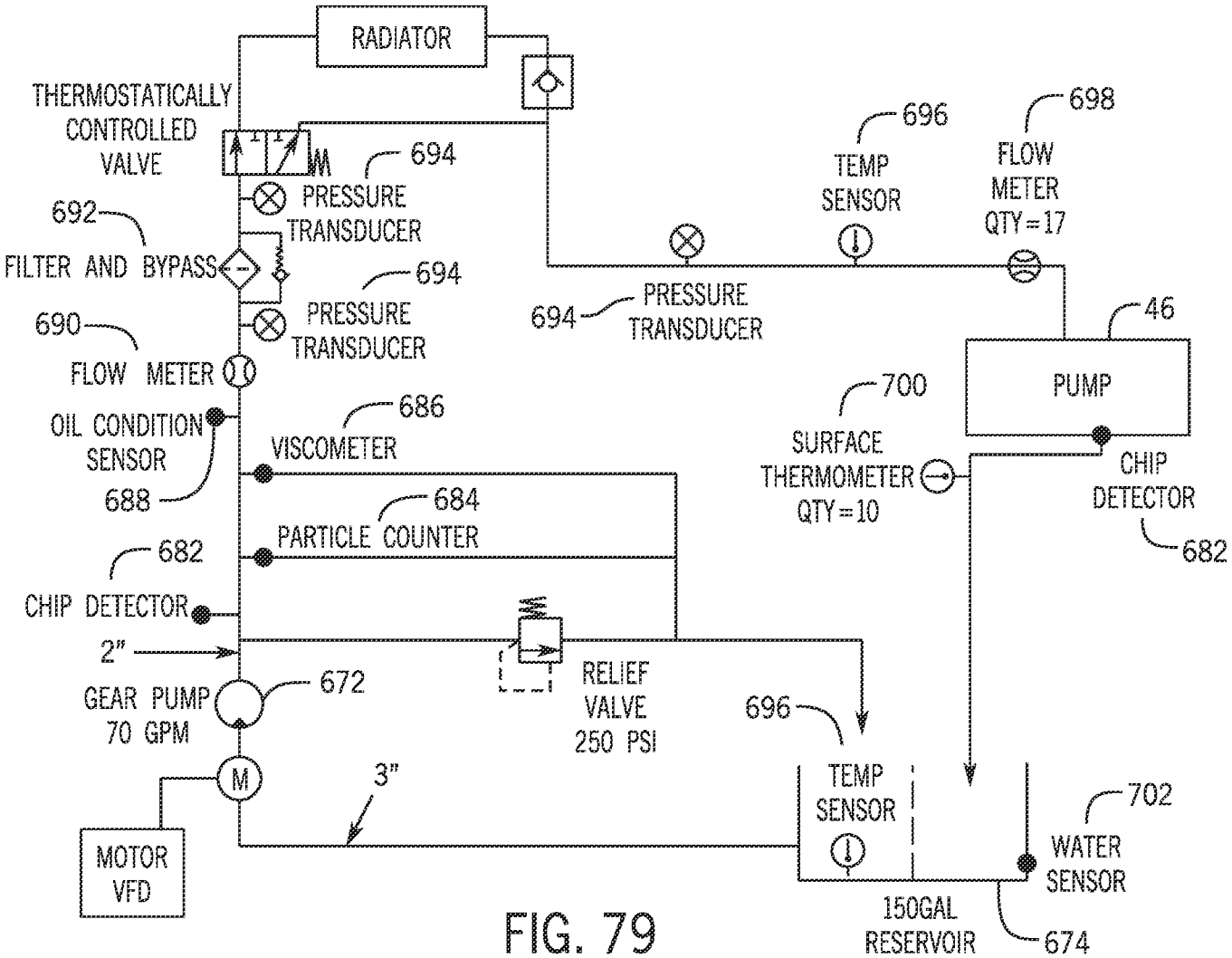
FIG. 79 depicts a pump lubrication system instrumented with various sensors and other devices in accordance with one embodiment.

In one embodiment, a system detects power end lubrication efficacy from lubrication purity, quality, and distribution in a pump 46. In FIG. 79, for example, a pump lubrication system is depicted with an oil pump 672 that pumps lubricating oil from an oil reservoir tank 674 to the pump 46 (e.g., a quintuplex fracturing pump). The pump lubrication system is instrumented with various sensors and other devices, which include chip detectors 682 at the oil pump 672 outlet and the pump 46 outlet, a particle counter 684, a viscometer 686, an oil condition sensor 688, a flowmeter 690 (e.g., a high range flowmeter) downstream of the oil pump 672 outlet, and a filter 692 with a pressure switch. The pump lubrication system also includes pressure sensors 694, probe temperature sensors 696 (some of which can be positioned at the outlets of pump 46, in addition to locations depicted in FIG. 79), flowmeters 698 (e.g., low range flowmeters), surface temperature sensors 700 positioned at various locations on the surface of pump 46, and a water sensor 702 at the bottom of the oil reservoir tank 674.

As noted above, lack of power end lubrication efficacy can result in premature wear of power end 48 components, which can result in pump failure (e.g., failure that prevents the crankshaft from pushing the plunger and an inability to provide pressure and flowrate at the discharge manifold). Power end lubrication efficacy can be measured through purity, quality, and distribution parameters.

Figure 80:
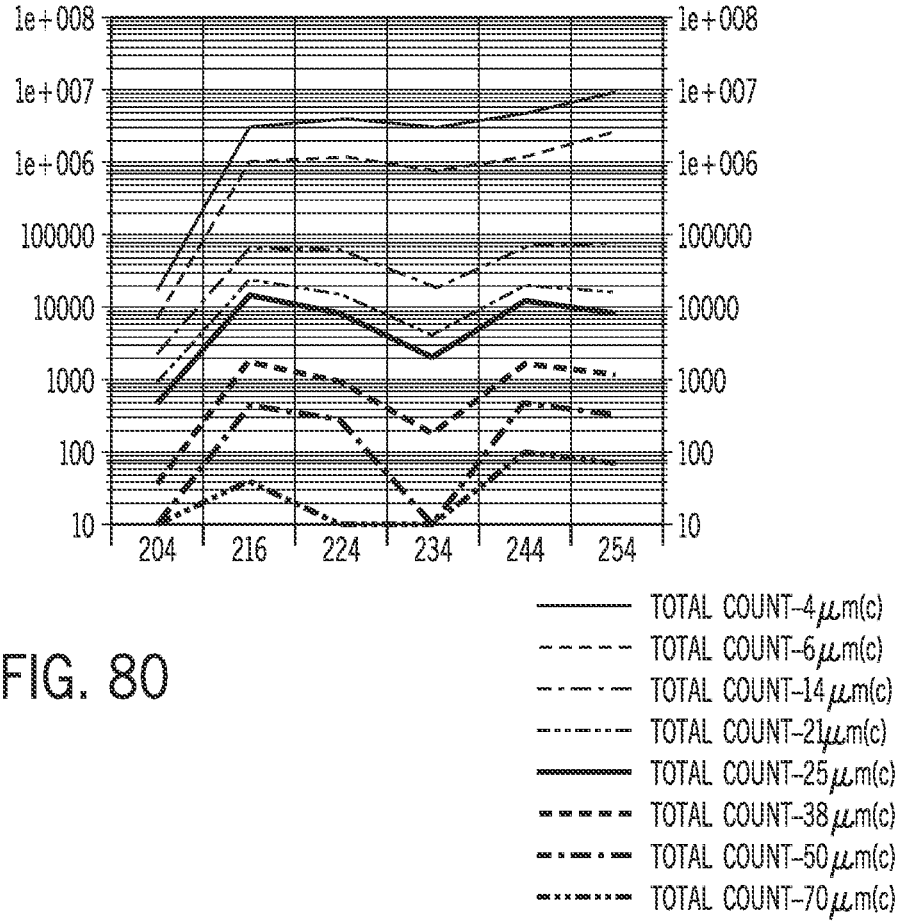
FIG. 80 is a graph of particle counts measured in the system of FIG. 79 in accordance with one embodiment.

Purity is reduced by particles accumulating in the oil due to metallic debris from pump erosion and this can be measured through particle counter 684 (e.g., as shown in FIG. 80) and chip detector 682. Eventually the filter 692 may clog and not filter particles anymore; this can be measured through the pressure difference across the filter 692 by placing one pressure sensor 694 upstream of the filter 692, placing one pressure sensor 694 downstream of the filter 692, and calculating the difference between the two pressures measured by these sensors 694. There may be a pressure difference threshold at which the filter 692 is unable to properly filter particles prior to becoming fully clogged. Once the filter 692 becomes fully clogged, the filter 692 pressure switch is activated.

Figure 81:
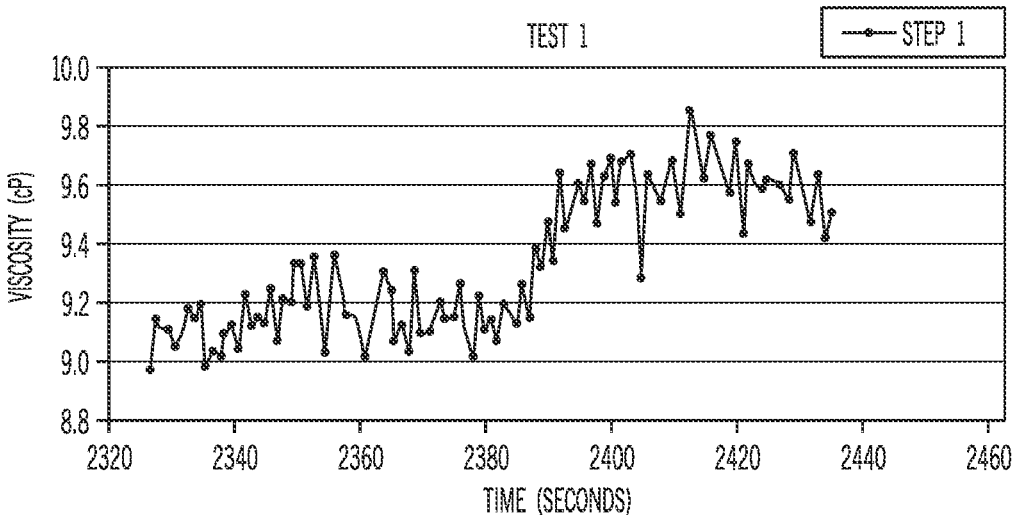
FIG. 81 is a graph of lubricant viscosity measured by a viscometer of the system of FIG. 79 in accordance with one embodiment.
Figure 82:
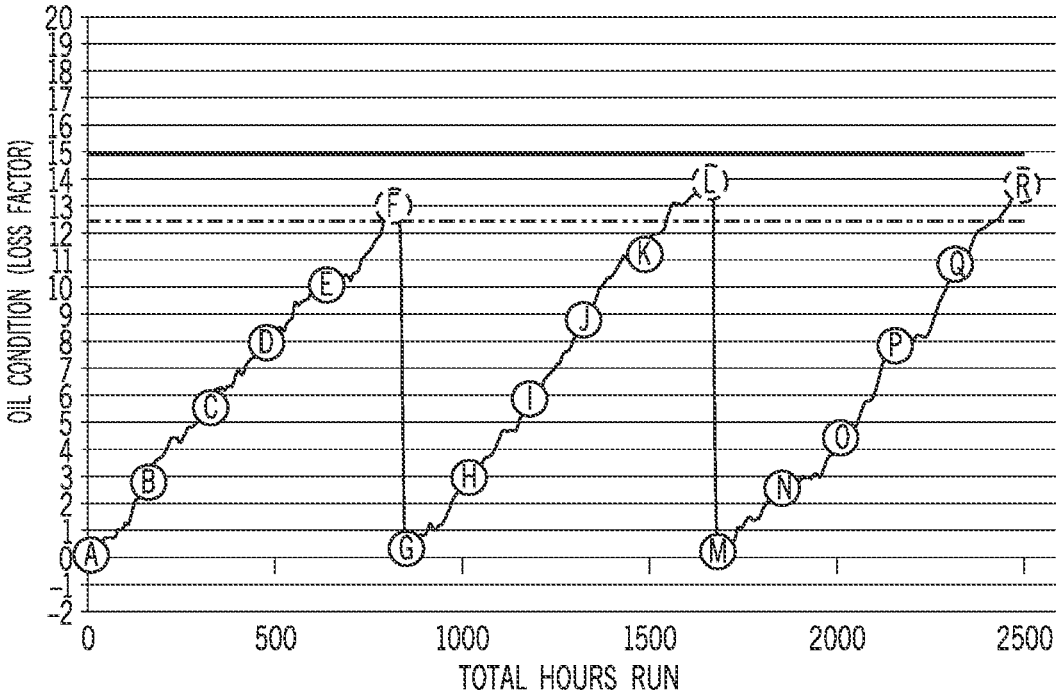
FIG. 82 is a graph of oil condition measured by an oil condition sensor of the system of FIG. 79 in accordance with one embodiment.
Figure 83:
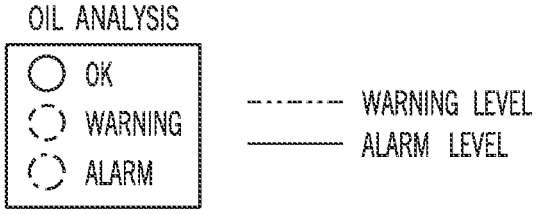
FIG. 83 is a graph of fluid resistance, which is indicative of water concentration in the lubricant and can be measured with a water sensor of the system of FIG. 79 in accordance with one embodiment.
Figure 83:
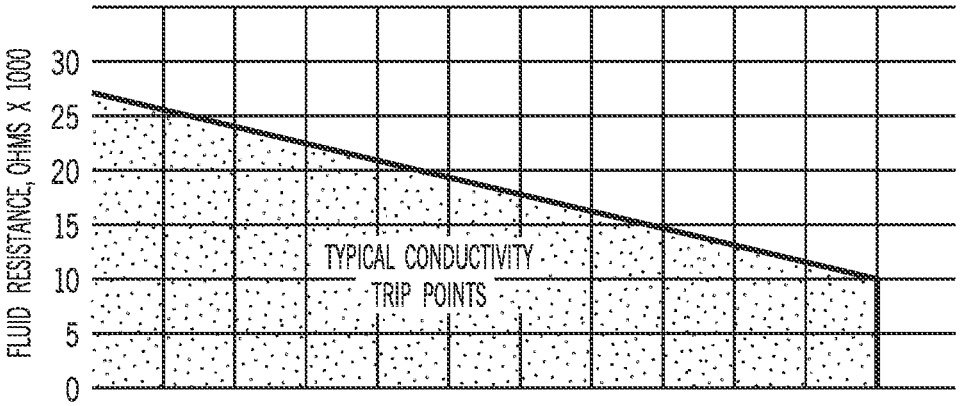

Quality is due to the lubricant (oil) possessing the right chemical and mechanical characteristics to prevent power end component wear. First, lubricant viscosity should be within a set threshold; this can be measured by viscometer 686 (such as shown in FIG. 81). Second, lubricant chemical composition resulting from the phase angle of the resistivity and capacitance of the oil should be within a set threshold; this can be measured by oil condition sensor 688 (such as shown in FIG. 82). Third, the lubricant temperature at the tank 674 and reaching the pump 46 should be within a set threshold; this can be measured by two probe temperature sensors 696. Lastly, the water concentration in the lubricant should be below a set threshold; this can be measured by water sensor 702 (such as shown in FIG. 83).

Distribution is due to the proper amount of lubricant reaching the correct locations. First, a proper amount of lubricant reaching the pump 46 can be confirmed first by an additional pressure sensor 694 placed at the inlet of the pump 46 to confirm lubrication has not been blocked in the radiator circuit or other plumbing leading up to the pump 46; a pressure reading lower than the expected pressure indicates an improper amount of lubrication. Second, a proper amount of lubricant can be confirmed by a high range oil flowmeter 690 placed at the outlet of the lubrication pump 672; a lower than expected flowrate indicates an improper amount of lubrication. Third, a proper amount of lubricant can be confirmed by placing flowmeters 698 (e.g., seventeen low range flowmeters) across the different oil inlets of the pump 46; a lower flowrate than expected at any location indicates an improper amount of lubrication at the location. Lastly, a proper amount of lubricant can be confirmed by placing surface temperature sensors 700 (e.g., ten surface temperature sensors) across different lubricated locations of the power end 48; higher than expected temperature for a location indicates an improper amount of lubrication at the location.

A particular power end lubrication assembly has an expected life in terms of lubrication purity, quality, and distribution. Expected life, operational characteristics, and anomalies during use can be determined in any suitable manner, which may include the process represented in FIG. 59 in some instances. Lack of lubrication purity, quality, and distribution cause more power end wear and thus decrease the expected remaining useful life. The cumulative lubrication purity, quality, and distribution experienced by each power end lubrication location can be tracked so that the remaining useful life of the power end 48 can be estimated.

The remaining useful life for the power end assembly can be estimated via the process represented in FIG. 60 or in any other suitable manner. The deviation of power end lubrication purity, quality, and distribution measurements discussed above from the expected values in a healthy power end assembly can be used to assign a power end lubrication efficacy score to the power end lubrication for each location. The efficacy score can be compared to the expected wear in the power end given the cumulative purity, quality, and distribution. The rate of change of the wear can be used to calculate a slope score. The degree of wear calculated for the power end can be used to subtract from the expected life of a new power end to estimate remaining life, and the slope score for the power end can be used to estimate the rate at which the remaining life of the power end will be consumed. The remaining useful life value can be displayed for the operator and maintenance personnel to plan pump operation and maintenance routines.

Figure 84:
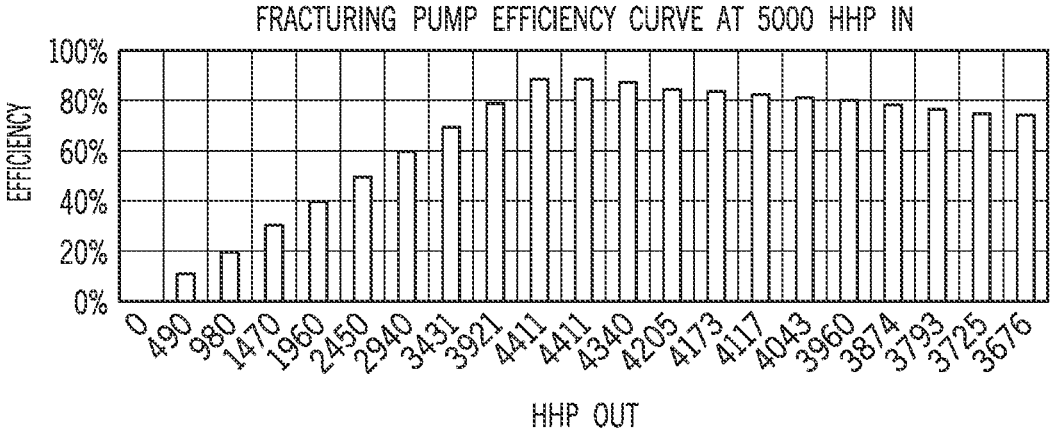
FIGS. 84 and 85 show fracturing pump efficiency curves in accordance with certain embodiments.
Figure 85:
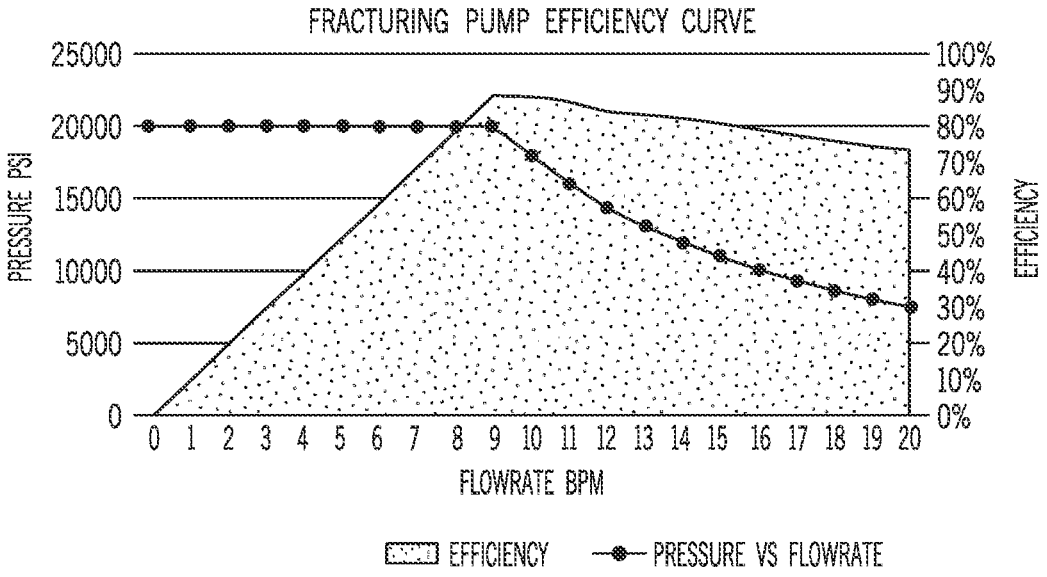

While certain examples above relate to monitoring pump health and estimating remaining life of various pump components, additional techniques may also or instead be used to improve performance of the pump 46. In one embodiment, for example, power and/or fuel consumption of a fracturing pump (or other pump 46) prime mover is reduced based on the fracturing pump performance curve efficiency. The efficiency of the fracturing pump varies based on pressure and flowrate. A fracturing operational method may be based on the power and fuel consumption efficiency measured due to different pressure and flowrate operational points, such as shown in FIGS. 84 and 85. Whether the prime mover is an electric motor powered by a variable frequency drive, or a diesel engine coupled with a transmission, there are operating points towards the right of the efficiency curve for pressure and flowrate at which the pump is at maximum efficiency and thus will consume least power and fuel, which should be preferred. Conversely, there are operating points towards the left of the efficiency curve for pressure and flowrate at which the pump is at sub-optimal efficiency and thus will consume more power and fuel, which should be avoided.

As each pump wears over time and goes through different ambient conditions, its operational curve will change. The pump operational curve can be calculated in real-time by acquiring the input torque to the pump, the pump suction flowrate, and the pump discharge pressure. The pump input horsepower can be calculated with the following equation:

$$\text{Pump Input HP} = \text{Crankshaft Torque (pound-feet)} \times \text{Crankshaft Speed (RPM)}/5252$$

The pump output horsepower can be calculated with the following equation:

$$\text{Pump Output HP} = \text{Suction Flowrate (GPM)} \times \text{Discharge Pressure (PSI)}/1714$$

The pump efficiency can be calculated with the following equation:

$$\text{Pump Efficiency} = \text{Output HP}/\text{Input HP}$$

Figure 86:
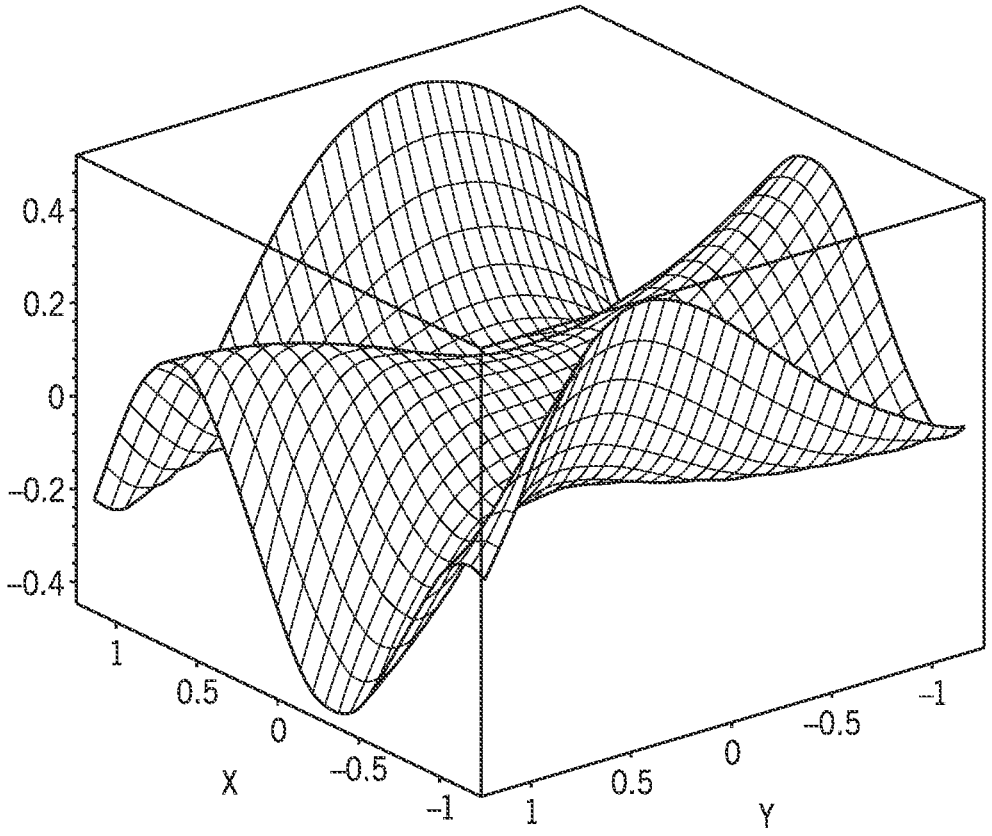
FIG. 86 generally represents application of a gradient descent optimizing algorithm to iteratively calculate and reach the operational point for each of multiple pumps at which the cumulative power and fuel consumption for a wellsite is minimized in accordance with one embodiment.

When considering a multitude of pumps 46 used in a fracturing wellsite, the cumulative power and fuel losses due to the efficiency from the operating points can be calculated by adding the efficiency loss of each pump 46 individually. An optimizing algorithm, such as gradient descent shown in FIG. 86, can be applied to iteratively calculate and reach the operational point for each pump 46 at which the cumulative power and fuel consumption for the wellsite is at its minimum.

Figure 87:
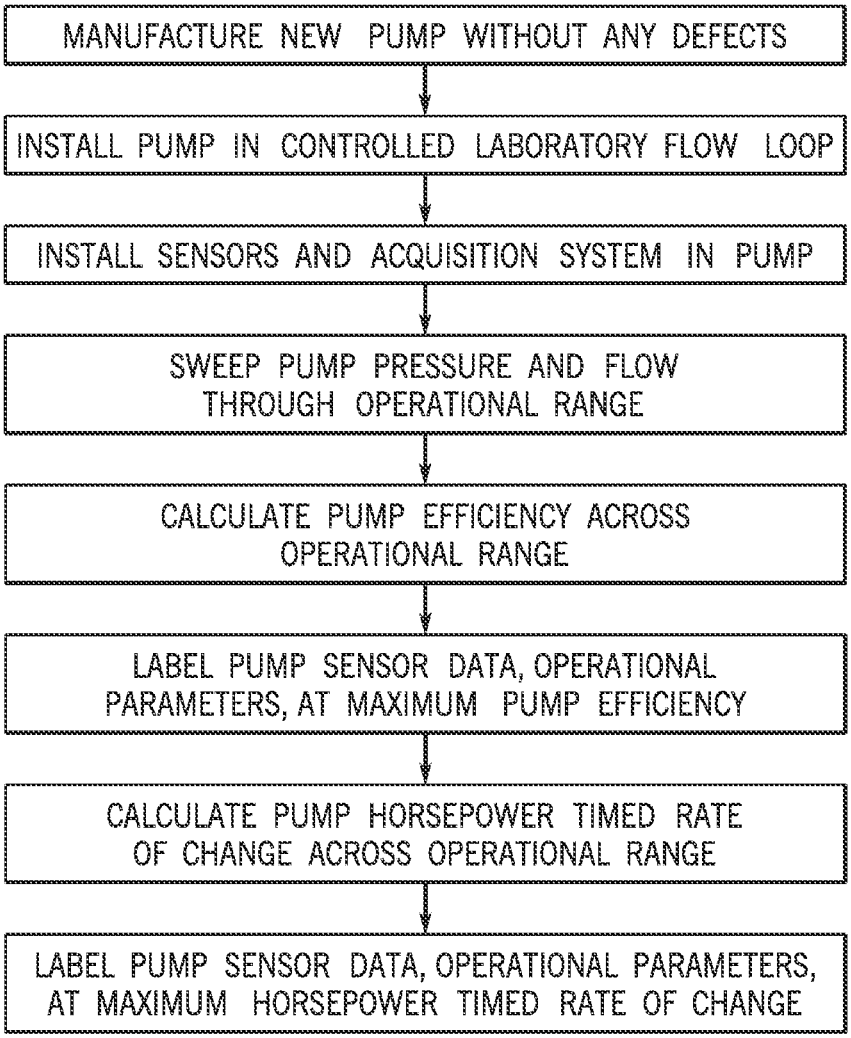
FIG. 87 is a flowchart representing a process for collecting a historical data set of pump sensor data and operational parameters in accordance with one embodiment.
Figure 88:
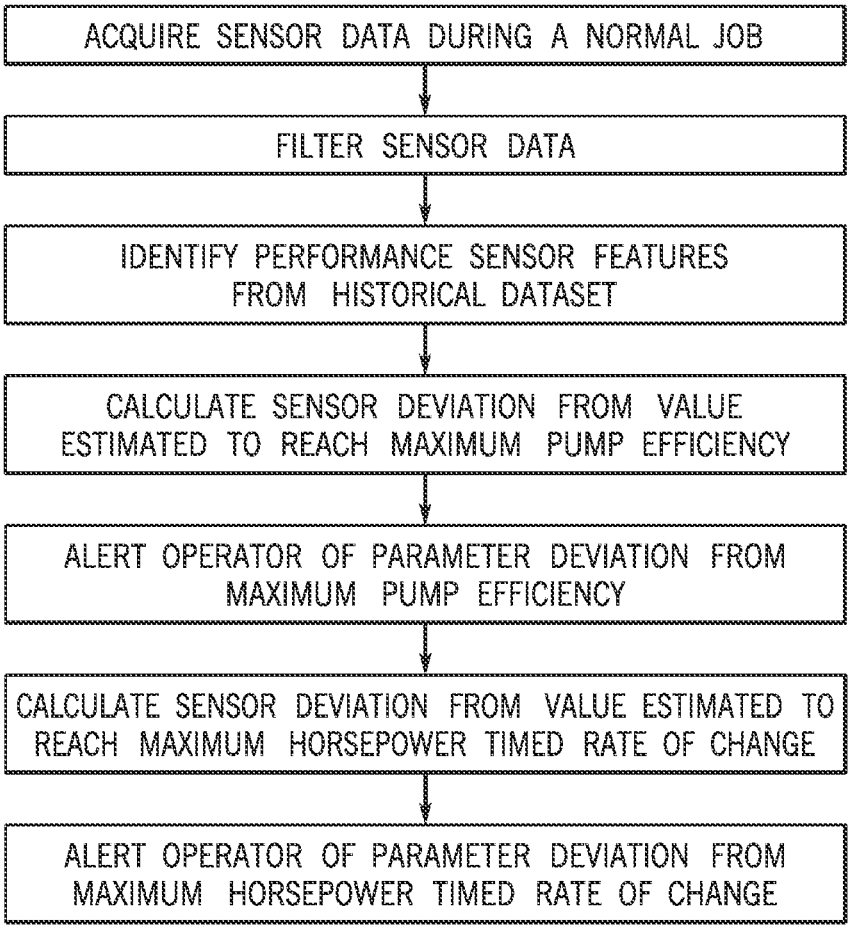
FIG. 88 is a flowchart representing a process for optimizing pump performance in accordance with one embodiment.

The rate of change of pump curves and resulting efficiencies are used in some instances to update operating points prior to a significant efficiency drop occurring and thus further optimize the power and fuel consumption for a pump 46 or wellsite. The real-time crankshaft torque, crankshaft speed, suction flowrate, discharge pressure and pump efficiencies can be input to a machine learning algorithm which then calculates the weights necessary for a neural network to estimate the operating point which will decrease power consumption a set amount of time into the future. In some instances, a historical data set of pump sensor data and operational parameters may be collected, such as via the flowchart of FIG. 87. Actual sensor data from an operating pump 46 can be compared with the historical data to identify deviations from values estimated to reach maximum pump efficiency and maximum horsepower timed rate of change and optimize pump performance, such as represented in FIG. 88.

A mathematical model can be used to estimate the fracturing pump efficiency as a function of the operational point (pressure and flowrate). As noted above, a neural network generative model may be chosen as the mathematical model to describe the dynamic of the systems. Different neural network topologies may be used, including recurrent neural networks, feed forward neural networks, convolutional neural networks, and mixtures of these types. Various hyperparameters and design choices may be investigated, including learning rate, number of units, number of layers, amount of input data, amount of training epochs, and amount of regularization. In one embodiment, the simulation tool used is a program written in Python while making use of Keras library running on top of TensorFlow library, and a convolutional recurrent neural network with a topology of an input layer of 120 inputs may be used. The topology can be trained using Adam optimizer, and mean squared error loss.

A simple neural network is composed of inputs which are multiplied by weights and added a bias term which then is taken through a non-linear activation function, such as illustrated in FIG. 37 and discussed above. In one embodiment, the input values to the neural network are the crankshaft torque, crankshaft speed, suction flowrate, discharge pressure and pump current efficiencies for different input windows to the past, and the model estimates the corresponding fracturing pump efficiency a set amount of time in the future at various operating parameters (pressure and flowrate) as the output. In this example, the model transfer functions are weights and biases and they can translate from the inputs to a corresponding output value. The neural network makes use of activation functions to capture the non-linear behavior of the system. The input parameters can be normalized between 0 to 1 while fed to the neural network and the output can be converted back to the original scale for plotting and analysis.

In one embodiment, time to target hydraulic horsepower of a pump 46 (e.g., a fracturing pump) is reduced based on the pump acceleration and vibration characteristics. In order to reduce the time it takes to reach a certain level of hydraulic horsepower (HHP) due to a pressure and flowrate operational point, it may be desirable to maximize the acceleration and deceleration rate of the pump 46. However, high acceleration involves high levels of torque which can stress the equipment to the point that it causes premature wear and eventual fractures or high vibrations that could prevent the pump 46 from continuing to operate. Additionally, high acceleration can result in over-pressuring of the equipment.

Figure 89:
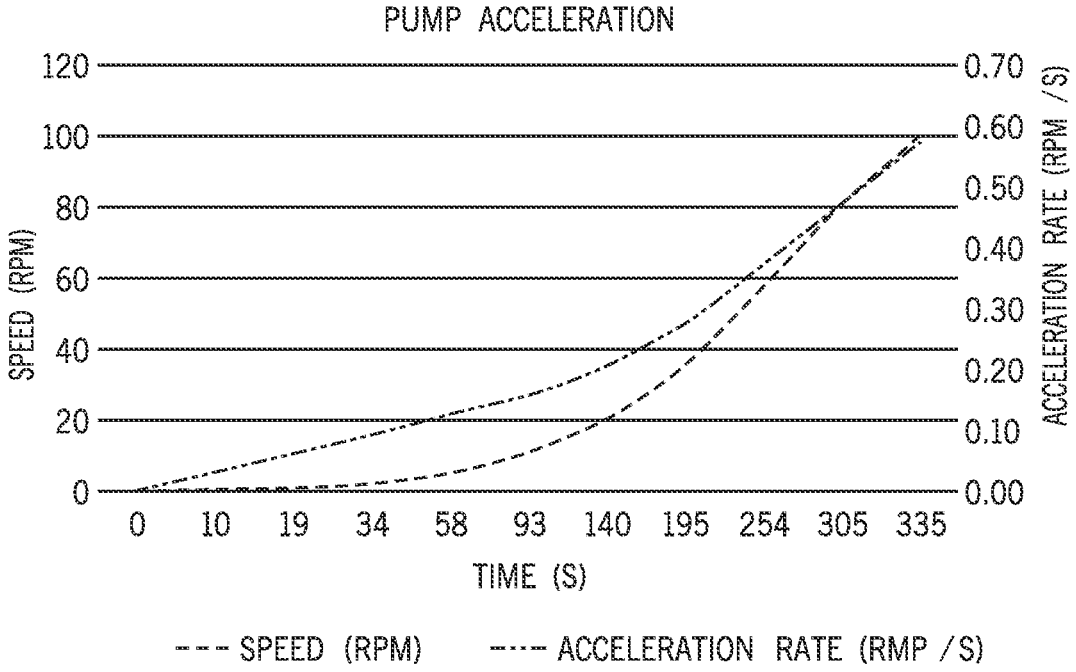
FIG. 89 is a graph of pump acceleration and speed over time in accordance with one embodiment.

In some instances, reduction of the time to target hydraulic horsepower is based on torque acceleration limits, such as shown in FIG. 89. In one example of a pump 46, the acceleration rates and torque limits found that will allow the pump to achieve reduced time to hydraulic horsepower while maintaining it within design specifications and keeping it from failing prematurely are shown in the following table:

| Description | Specification |
|---|---|
| Max Speed | 3000 RPM (982 RPM rated) |
| Min Speed | 0 RPM |
| Nominal Torque | 26,587.5 FT-LBS |
| Acceleration Rate | 20% of Max Speed/s |
| Deceleration Rate | 36% of Max Speed/s |
| Stop Ramp Deceleration Rate | 20% of Max Speed/s |
| Max Torque | 90% of Nominal Torque |
| Max Power | 5000 HP |

Figure 90:
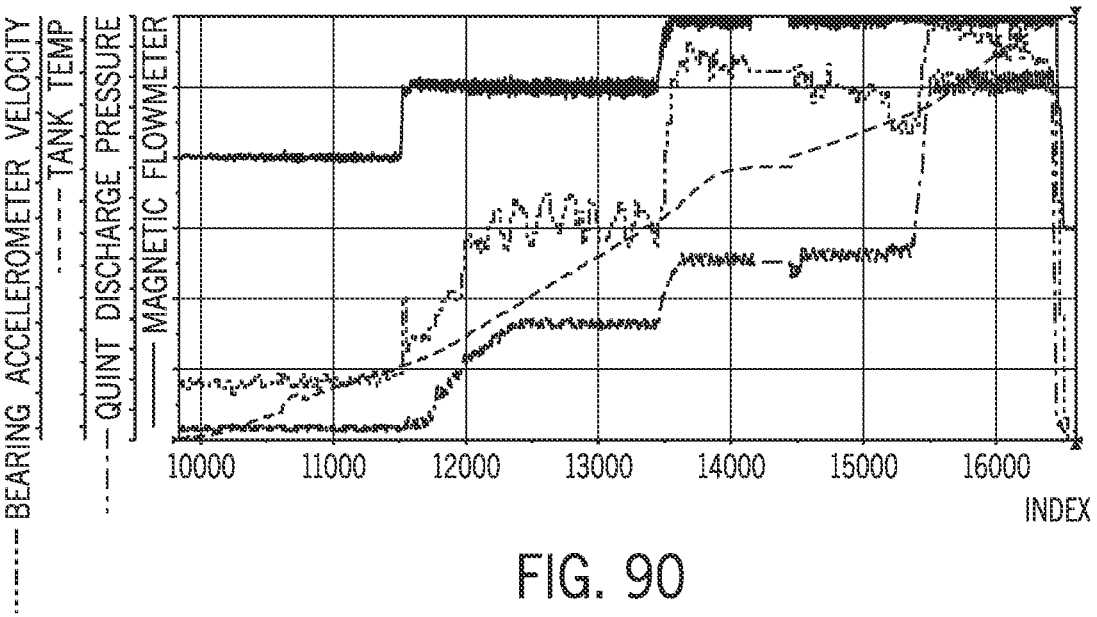
FIG. 90 is a graph of various pump sensor readings that change as hydraulic horsepower output of the pump is increased in accordance with one embodiment.

During a hydraulic horsepower test (HPP), a pump 46 is qualified due to its ability to achieve a certain HHP output for a given amount of time or cumulative HHP hours. This test reveals the performance characteristics of the pump 46 in terms of time taken to reach various HHP targets. As the pump increases in HHP output, the vibration it experiences increases as well (an example of which is shown in FIG. 90). In some instances, the system vibration acquired during healthy conditions is used to establish a threshold at which the pump acceleration rate is limited to keep the system vibration within an acceptable margin. This allows maximization of the pump acceleration while at the same time avoiding unacceptable system vibration that can result in premature pump failure. Further, as the vibration signature for a given HHP target changes over time, the limits specified for a new pump 46 (such as the limits in the preceding table) can be adjusted in proportion to the vibration difference. If the vibration decreases, the acceleration and deceleration rates can be increased proportionally, reducing the time taken to reach a new HHP setpoint. Conversely, if the vibration increases, the acceleration and deceleration rates can be reduced proportionally, increasing the time taken to reach a new HHP setpoint.

Figure 91:
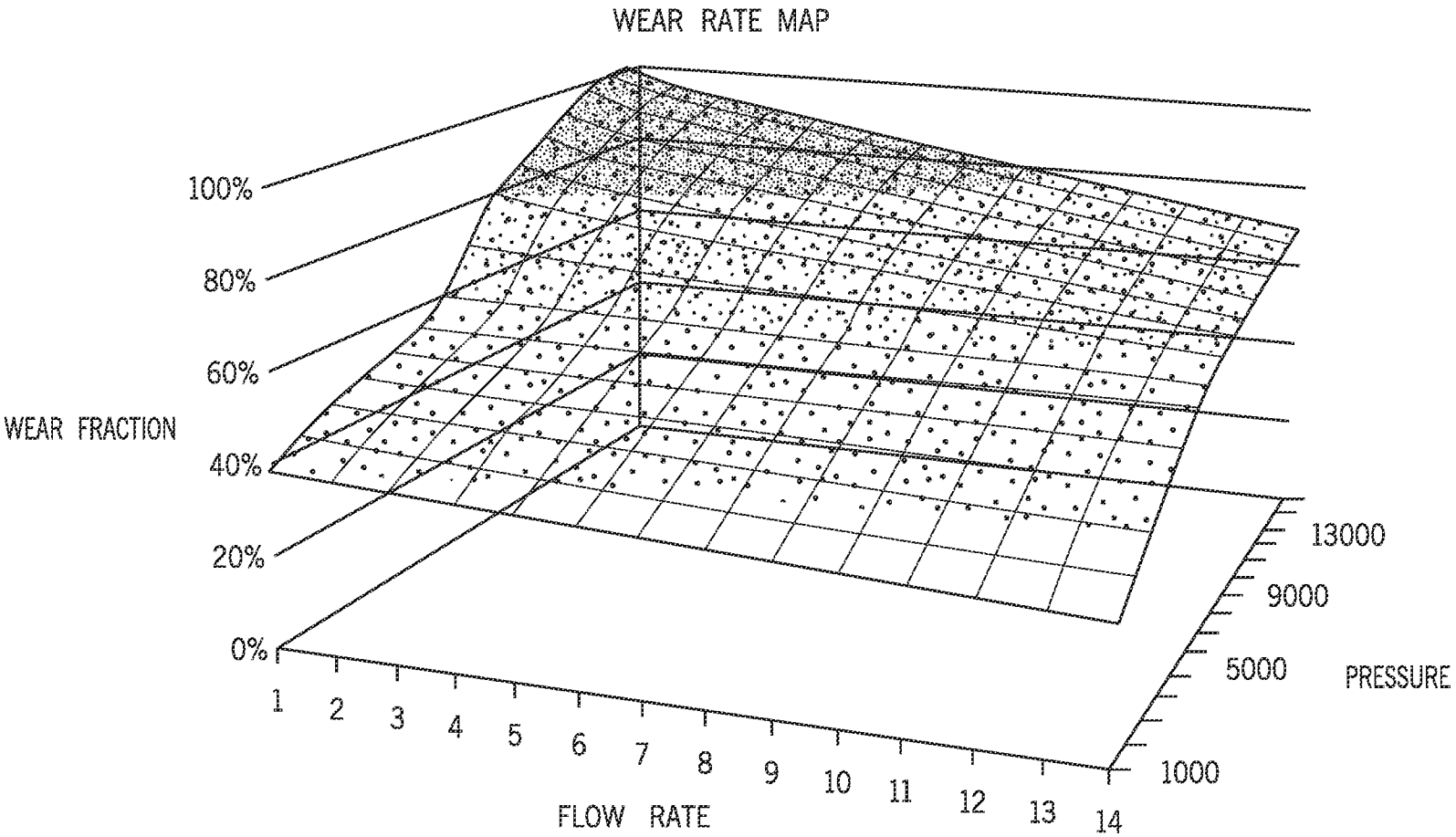
FIG. 91 is simplified map of relative wear rate of pump components in accordance with one embodiment.

In one embodiment, component wear of a fracturing pump (or other pump 46) is reduced based on the pump acceleration, pressure, and flowrate characteristics. In order to minimize the rate at which pump life is consumed, operations can be biased toward areas of the pump operating envelope that are subject to lower wear rates, particularly when such choices do not impact other job parameters. The pump operating envelope includes the upper and lower limits of discharge pressure, pump flow rate or RPM, plunger size, and output horsepower. Further, a system with multiple pumping units 46 will also have choices as to the share of the overall job flow rate each pump carries. Choices such as leaving one or more pumps 46 ready to pump but not actually pumping may mean that the remaining pumps 46 operate at higher speed. Conversely, all of the pumps 46 may be operated at the same or similar speeds. These two extremes of overall well site choices may significantly increase the wear optimization space. Wear rate of consumable components generally increases with pumping pressure. Wear rate, however, may decrease with pumping speed, or may go through a minimum wear rate at some flow rate between the upper and lower limits. A simplified map of relative wear rate is shown in FIG. 91 as an example. Changes in flow to move down on this curve may translate to longer pump life. If, for example, a flow rate of 40 barrels per minute (BPM) is desired from five pumps 46 collectively, each of the five pumps 46 could be run at 8 BPM. If, however, four pumps 46 are run at 10 BPM and one pump 46 is held in reserve, the overall wear rate of the wellsite may be reduced relative to the 8 BPM each case. The reserve pump role may be rotated among the pumps to equalize the wear in the fleet of pumps 46.

Using knowledge of the wear function, the wellsite equipment, and the desired system flow rate and pressure, an optimization may be conducted to provide an initial operating point. During the job, as changes are needed, this optimization may be used to suggest choices for how to move flow among the group of pumps 46. Finally, knowing the history of each pump 46, adjustments may be made to time maintenance intervals to align with operational breaks.

The wear function may be based on detailed knowledge of each consumable component and its wear mechanism. For ball and roller bearings these functions may be known but incorporate a significant degree of statistical uncertainty as to the exact failure point for a given bearing. For sliding bearings, detailed knowledge of the lubrication regime may be supplemented with the results of extensive wear testing and a program of rebuild inspections. Sensing means may be deployed to improve the wear predictions by monitoring the characteristics of each pump, such as in the numerous examples of sensors and monitored pump parameters provided above.

Figure 92:
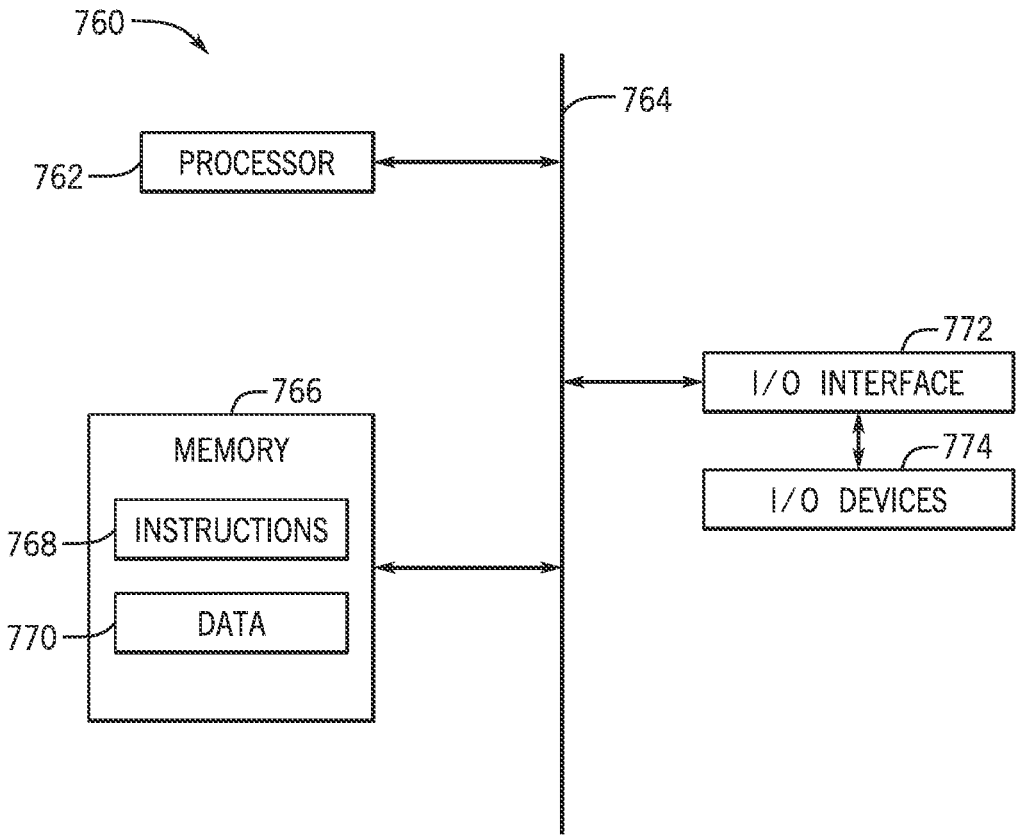
FIG. 92 is a block diagram of components of a processor-based data analyzer in accordance with one embodiment.

A data analyzer for implementing various functionality described above can be provided in any suitable form. In at least some embodiments, such a data analyzer is provided in the form of a processor-based system, such as a personal computer, a handheld computing device, or a programmed logic controller. An example of such a processor-based system is generally depicted in FIG. 92 and denoted by reference numeral 760. In this depicted embodiment, the system 760 includes a processor 762 connected by a bus 764 to a memory device 766. It will be appreciated that the system 760 could also include multiple processors or memory devices, and that such memory devices can include volatile memory (e.g., random-access memory) or non-volatile memory (e.g., flash memory or a read-only memory).

The one or more memory devices 766 are encoded with application instructions 768 (e.g., software executable by the processor 762 to perform various functionality described above), as well as with data 770 (e.g., pump component operational data, comparison thresholds, historical data, sensor types, sensor locations, and other data that facilitates analysis of sensed pump parameters). For example, the application instructions 768 can be executed to monitor health, estimate component remaining life, detect failures, or improve performance for a fracturing pump or other machine in accordance with a technique described above. In some instances, the application instructions 768 may be executed to automatically perform a procedure in response to pump sensor data, such as controlling pump operation to optimize performance or reduce wear based on sensed pump conditions. In one embodiment, the application instructions 768 are stored in a read-only memory and the data 770 is stored in a writeable non-volatile memory (e.g., a flash memory).

The system 760 also includes an interface 772 that enables communication between the processor 762 and various input or output devices 774. The interface 772 can include any suitable device that enables such communication, such as a modem or a serial port. The input and output devices 774 can include any number of suitable devices. For example, the devices 774 can include one or more sensors, such as those described above, for providing input to be used by the system 760 to monitor health, estimate component remaining life, detect failures, or improve performance. The devices 774 may also include a keyboard or other interface that allows user-input to the system 760, and a display, printer, or speaker to output information from the system 760 to a user.

Various examples of instrumented pumps are described above. In a given implementation, a pump may be instrumented with any suitable number or combination of pump sensors described herein. While a pump could be instrumented with each of the pump sensors described above, a pump may be instrumented with a smaller combination of the sensors in other instances. A pump may also or instead be instrumented with other sensors. Further, while certain examples are described above in the context of a quintuplex fracturing pump, the present techniques may also be used with pumps of other types (e.g., triplex or other plunger pumps, centrifugal pumps, or progressing cavity pumps) or purposes (e.g., other stimulation pumps, cementing pumps, mud pumps, refining pumps, or pipeline pumps), as well as with other machinery (e.g., motors, transmissions, or gearboxes). Moreover, while some pump systems may use sensors for each of monitoring health (e.g., estimating wear or remaining life), detecting failures, and improving performance, other pump systems may use the sensors for fewer (or none) of these functionalities.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An apparatus comprising:

a fracturing pump, wherein the fracturing pump is a plunger pump having a power end, and a fluid end;

at least one sensor configured to detect fracturing pump operation data associated with a loading of a crankshaft of the fracturing pump by one or more connecting rods of the fracturing pump;

a crankshaft encoder configured to detect angular position data associated with an angular position of the crankshaft; and a processor-based data analyzer configured to:

receive the fracturing pump operation data and the angular position data;

analyze the fracturing pump operation data in an angular domain based on correlating the fracturing pump operation data to the angular position data;

based on the analysis, diagnose wear of the crankshaft or estimate remaining life of the crankshaft; and based on the diagnosis, perform a procedure to control operation of the fracturing pump.

2. The apparatus of claim 1, wherein the at least one sensor includes a load washer connected at a side plate of a crankshaft housing of the fracturing pump, the load washer configured to detect an axial thrust load of the crankshaft.

3. The apparatus of claim 2, wherein the processor-based data analyzer is configured to determine an axial change in length of the crankshaft for a rotational profile of the crankshaft based on determining an axial load per crankshaft angle from the fracturing pump operation data.

4. The apparatus of claim 1, wherein the at least one sensor includes a proximity sensor connected to a side plate of a crankshaft housing of the fracturing pump, the proximity sensor configured to detect an axial displacement of the crankshaft.

5. The apparatus of claim 4, wherein the processor-based data analyzer is configured to determine an axial change in length of the crankshaft for a rotational profile of the crankshaft based on determining an axial displacement per crankshaft angle from the fracturing pump operation data.

6. The apparatus of claim 1, wherein the processor-based data analyzer is further configured to determine whether an amount of deformation of the crankshaft is within a plastic region or an elastic region based on the analysis.

7. The apparatus of claim 1, wherein the at least one sensor includes a load washer connected at a side plate of a crankshaft housing of the fracturing pump, the load washer configured to detect an axial thrust load of the crankshaft, and a proximity sensor connected to the side plate and configured to detect an axial displacement of the crankshaft.

8. A method comprising:

receiving, by a processor from at least one sensor of an instrumented fracturing pump, fracturing pump operation data associated with a deformation of one or more components of the instrumented fracturing pump;

receiving, by the processor from a crankshaft encoder, angular position data associated with an angular position of a crankshaft of the instrumented fracturing pump;

processing, by the processor, the fracturing pump operation data in an angular domain based on correlating the fracturing pump operation data to the angular position data;

based on the processing, determining, by the processor, whether the deformation of the one or more components is within a plastic region or an elastic region; and based on the determining, performing, by the processor, an action to improve operating performance of the instrumented fracturing pump.

9. The method of claim 8, comprising providing a user notification that indicates wear of the one or more components, estimated remaining life of the one or more components, or the action to improve operating performance.

10. The method of claim 8, wherein performing the action comprises automatically controlling a pump operation of the instrumented fracturing pump.

11. The method of claim 8, wherein the deformation of the one or more components includes deformation of a connecting rod of the instrumented fracturing pump, and wherein one or more sensors of the at least one sensor is positioned on the connecting rod.

12. The method of claim 8, wherein the deformation of the one or more components includes deformation of a crosshead of the instrumented fracturing pump, and wherein one or more sensors of the at least one sensor is positioned on the crosshead.

13. The method of claim 8, wherein the deformation of the one or more components includes deformation of the crankshaft of the instrumented fracturing pump, and wherein one or more sensors of the at least one sensor is positioned at the crankshaft.

14. The method of claim 8, wherein the deformation of the one or more components includes deformation of a wrist pin of the instrumented fracturing pump, and wherein one or more sensors of the at least one sensor is positioned on the wrist pin.

15. The method of claim 8, wherein the fracturing pump operation data is received from one or more of a strain gauge, an accelerometer, or a temperature sensor.

* * * * *